US006819032B2

(12) United States Patent
Matsubara

(10) Patent No.: US 6,819,032 B2
(45) Date of Patent: Nov. 16, 2004

(54) SPARK PLUG HAVING RESISTANCE AGAINST SMOLDERING, LONG LIFETIME, AND EXCELLENT IGNITABILITY

(75) Inventor: Yoshihiro Matsubara, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 56 days.

(21) Appl. No.: 10/168,008

(22) PCT Filed: Dec. 13, 2000

(86) PCT No.: PCT/JP00/08798

§ 371 (c)(1),
(2), (4) Date: Jun. 13, 2002

(87) PCT Pub. No.: WO01/43246

PCT Pub. Date: Jun. 14, 2001

(65) Prior Publication Data

US 2003/0085643 A1 May 8, 2003

(30) Foreign Application Priority Data

Dec. 13, 1999 (JP) ..... 11-353769

(51) Int. Cl.[7] ..... H01T 13/20

(52) U.S. Cl. ..... 313/141; 313/140; 313/143; 445/7

(58) Field of Search ..... 313/140, 141, 313/143, 118; 445/7

(56) References Cited

U.S. PATENT DOCUMENTS

| | | | | |
|---|---|---|---|---|
| 6,316,868 | B1 * | 11/2001 | Ishino et al. | 313/141 |
| 6,531,809 | B1 * | 3/2003 | Benedikt et al. | 313/143 |
| 6,703,770 | B2 * | 3/2004 | Suzuki et al. | 313/141 |

FOREIGN PATENT DOCUMENTS

| | | |
|---|---|---|
| CA | 1321111 | 4/1989 |
| EP | 0774812 A1 | 5/1997 |
| EP | 0774813 A1 | 5/1997 |
| EP | 0863591 A1 | 9/1998 |
| EP | 0933846 A1 | 8/1999 |
| JP | 49-120932 | 11/1974 |
| JP | 60-81784 | 5/1985 |
| JP | 62-11471 | 1/1987 |
| JP | 64-27176 | 1/1989 |
| JP | 1-264187 | 10/1989 |
| JP | 5-326107 | 12/1993 |
| JP | 6-176849 | 6/1994 |
| JP | 9-92432 | 4/1997 |
| JP | 9-199260 | 7/1997 |
| JP | 10-189212 | 7/1998 |
| JP | 10-308272 | 11/1998 |
| JP | 11-219771 | 8/1999 |
| JP | 2000-68032 | 3/2000 |
| JP | 2000-223239 | 8/2000 |
| JP | 2000-277230 | 10/2000 |
| JP | 2000-294360 | 10/2000 |

* cited by examiner

*Primary Examiner*—Edward J. Glick
*Assistant Examiner*—Elizabeth Keaney
(74) *Attorney, Agent, or Firm*—Sughrue Mion, PLLC

(57) ABSTRACT

An object is to realize a spark plug which is less affected by "carbon fouling," has a long service life, and exhibits excellent ignition characteristics.

An air gap (α) is formed between a parallel ground electrode 11 and an end face of a center electrode 2; a semi-creepage gap (β) is formed between an end face 12C of a semi-creeping discharge ground electrode 12 and a circumferential side surface 2A of the center electrode 2; and an insulator gap (γ) is formed between the end face 12C and a circumferential side surface 1E of an insulator 1. The air gap (α) and the semi-creepage gap (β) satisfy a relationship α<β; and the air gap (α) and the insulator gap (γ) satisfy a relationship α>γ. The air gap (α) is not greater than 1.1 mm; the insulator gap (γ) falls within a range of 0.5 mm to 0.7 mm; and a diametral difference (δ) between the insulator and a metallic shell as measured at the front end face of the metallic shell is not less than 3.6 mm.

27 Claims, 27 Drawing Sheets

| INJECTION END TIMING / F (mm) | BTDC° 30 — 60 |
|---|---|
| 5. 0 | 32. 5 — 55 |
| 3. 0 | 32. 5 — 55 |
| 2. 0 | 35 — 52. 5 |

| WIDTH OF PARALLEL GROUND ELECTRODE (W/FRONT END DIAMETER OF CENTER ELECTRODE) | TEST RESULTS |
|---|---|
| 2. 5 (4. 2) | ××× |
| 2. 2 (3. 7) | ○○○ |
| 1. 8 (3. 0) | ○○○ |
| 1. 4 (2. 3) | ○○○ |
| 1. 0 (1. 7) | ○○○ |
| 0. 6 (1. 0) | ○○○ |

(a)

(b)

(c)

SPARK PLUG HAVING RESISTANCE AGAINST SMOLDERING, LONG LIFETIME, AND EXCELLENT IGNITABILITY

TECHNICAL FIELD

The present invention relates to a spark plug for use in an internal combustion engine.

BACKGROUND ART

A certain conventional spark plug includes a center electrode which is disposed in an insulator in such a manner as to project from the front end face of the insulator, and a parallel ground electrode whose one end is disposed in parallel with the end face of the center electrode and whose other end is joined to a metallic shell, and the spark plug is adapted to ignite a fuel mixture gas through spark discharge across a gap between the center electrode and the parallel ground electrode.

In order to enhance an ignition property for igniting a fuel mixture gas, Japanese Patent Application Laid-Open (kokai) Nos. 5-326107 and 7-130454 propose a spark plug which includes, in addition to a ground electrode which faces the end face of a center electrode in parallel, auxiliary ground electrodes whose end faces face the circumferential side surface of the center electrode. An object of disposing the auxiliary ground electrodes is not to induce sparking across the gap between the end face of an auxiliary ground electrode and the circumferential side surface of the center electrode, but to improve distribution of electric field between the parallel ground electrode and the center electrode so as to induce sparking between the parallel ground electrode and the center electrode at a lower discharge voltage, thereby enhance ignition characteristics. The structural design of the proposed spark plugs is not intended to bring an edge of the end face of an auxiliary ground electrode in the vicinity of the front end face of an insulator.

Japanese Patent Application Laid-Open (kokai) No. 9-199260 proposes a spark plug that includes, in addition to a parallel ground electrode which faces the end face of a center electrode, auxiliary ground electrodes provided in the vicinity of the end face of an insulator.

However, the above-mentioned spark plugs described in Japanese Patent Application Laid-Open (kokai) Nos. 5-326107 and 7-130454 involve a problem in that spark discharge tends to fail to occur at a predetermined position, upon occurrence of so-called "carbon fouling." At the time of regular operation, in which an internal combustion engine is operating at a predetermined temperature and at a predetermined rotational speed or higher, the temperature of a leg portion of an insulator of a spark plug increases to an appropriate level, and the surface temperature as measured in the vicinity of the end face of the insulator located within a combustion chamber increases to about 500° C. At such a temperature, carbon adhering to the surface of the insulator is burnt out, so that the insulator surface is held clean. Therefore, a problem associated with "carbon fouling" does not arise. By contrast, at the time of low-load operation, in which the internal combustion engine is operating at low rotational speed and at extremely low temperature, the surface temperature of the insulator does not increase, and thus carbon accumulatively adheres to the surface of the insulator; i.e., the "carbon fouling" state is established. When "carbon fouling" progresses, insulation between the center electrode and the ground electrode is impaired; as a result, spark discharge is disabled, leading to engine stall.

The above-mentioned Japanese Patent Application Laid-Open (kokai) No. 9-199260 does not specify the relationships among the distance between the parallel ground electrode and the center electrode (air gap), the distance between an auxiliary ground electrode and the center electrode (semi-creepage gap), and the distance between the end face of an auxiliary ground electrode and the circumferential side surface of the insulator (insulator gap).

Japanese Patent Application Laid-Open (kokai) No. 59-71279 discloses a semi-creepage discharge spark plug configured such that a ground electrode is disposed in opposition to the circumferential side surface of an insulator. In the semi-creepage discharge spark plug, a spark creeps along the surface of the insulator, and thus carbon adhering to the insulator surface is burnt out. Therefore, "carbon fouling" does not raise a serious problem. However, since a spark continuously creeps along the surface of the insulator, the insulator surface is damaged by sparks; i.e., a so-called "channeling" problem arises, shortening the life of the spark plug.

An object of the present invention is to provide a spark plug which is less affected by "carbon fouling," exhibits excellent ignition characteristics, and reduces the amount of channeling.

DISCLOSURE OF THE INVENTION

To achieve the above object, a spark plug of the present invention assumes the following basic structure. Specifically, the spark plug of the present invention comprises an insulator having a center through-hole formed therein; a center electrode held in the center through-hole and disposed at an end portion of the insulator; a metallic shell for holding the insulator such that an end portion of the insulator projects from an end face thereof; a parallel ground electrode disposed such that one end thereof is joined to a front end face of the metallic shell, and a side face of the other end faces, in parallel, an end face of the center electrode; and a plurality of semi-creeping discharge ground electrodes disposed such that one end of each of the electrodes is joined to the metallic shell, and the other end of each of the electrodes faces a circumferential side surface of the center electrode and/or a circumferential side surface of the insulator. In the spark plug of the present invention, an air gap ($\alpha$) is formed between the parallel ground electrode and the end face of the center electrode; a semi-creepage gap ($\beta$) is formed between the end face of each of the semi-creeping discharge ground electrodes and the circumferential side surface of the center electrode; an insulator gap ($\gamma$) is formed between the end face of each of the semi-creeping discharge ground electrodes and the circumferential side surface of the insulator; a distance $\alpha$ across the air gap ($\alpha$) and a distance $\beta$ across the semi-creepage gap ($\beta$) satisfy the relationship "$\alpha<\beta$;" and the distance $\alpha$ across the air gap ($\alpha$) and a distance $\gamma$ across the insulator gap ($\gamma$) satisfy the relationship "$\alpha>\gamma$." Notably, herein, reference symbols ($\alpha$), ($\beta$), and ($\gamma$) for denoting gaps as structural elements of the invention may also be used to denote the sizes of gaps. In this connection, the following convention for usage of reference symbols may be adopted: reference symbols $G_\alpha$, $G_\beta$, and $G_\gamma$ are used to denote gaps as structural elements, whereas reference symbols $\alpha$, $\beta$, and $\gamma$ are used to denote the sizes of gaps. However, herein, in order to avoid complication of description, the same reference symbols are used to denote gaps as structural elements and the sizes of the gaps.

Satisfaction of the above-described relationships yields the following advantages. Since the distance $\alpha$ across the air gap (α) is shorter than the distance β across the semi-creepage gap (β) (α<β), in the normal state; i.e., when the "carbon fouling" state is not established, spark discharge occurs across the air gap (α) associated with the parallel ground electrode. Since the distance γ across the insulator gap (γ) is shorter than the distance α across the air gap (α), when the front end face of the insulator is fouled with carbon to thereby enter the "carbon fouling" state, spark discharge called semi-creeping discharge occurs along the end face of the insulator between an edge of the end face of the semi-creeping discharge ground electrode and the circumferential side surface of the center electrode. A spark associated with semi-creeping discharge runs across the insulator gap (γ) and then along the surface of the insulator (along the reverse route when the voltage polarity is inverted). When semi-creeping discharge is repeated several times, carbon deposited on the front end face of the insulator is burnt out, and thus the surface of the insulator is restored to a clean state, thereby restoring insulation on the surface of the insulator and eliminating "carbon fouling." As a result, the site of spark discharge returns to the air gap (α) from the semi-creepage gap (β). Notably, as shown in FIG. 2, the distance β across the semi-creepage gap (β) appearing herein means the minimum distance between the semi-creeping discharge ground electrode and the circumferential side surface of the center electrode located on the same plane as that of the front end face of the insulator, as measured along the direction perpendicular to the axis of the spark plug. The distance γ across the insulator gap (γ) means the minimum distance between the insulator and the semi-creeping discharge ground electrode.

In a spark plug having the above-described basic structure, spark discharge occurs mostly across the air gap (α) associated with the parallel ground electrode. Only when the surface of the insulator is fouled with carbon; i.e., only in the "carbon fouling" state, semi-creeping discharge occurs across the semi-creepage gap (β) associated with the semi-creeping discharge ground electrode, thereby igniting a fuel mixture gas in a combustion chamber. In such a spark plug, a fuel mixture gas is ignited mostly through spark discharge across the air gap (α), and thus the spark plug exhibits excellent ignition characteristics. Since the spark plug can perform a self-cleaning action; i.e., can burn out carbon deposited on the surface of the insulator through semi-creeping discharge, the spark plug can readily cope with "carbon fouling." Further, the frequency of semi-creeping discharge decreases, and semi-creeping discharge ends within a very short period of time. Therefore, the amount of "channeling" induced by spark decreases considerably, and channeling rarely occurs, thereby sufficiently extending the life of the spark plug.

As shown in FIG. 23, when a spark plug (100) of the present invention having two semi-creeping discharge ground electrodes (12, 12) is to be mounted on a direct-injection-type internal combustion engine (150), preferably the semi-creeping discharge ground electrodes (12, 12) are directed to an intermediate region between intake valves (201) and exhaust valves (203).

In the example of FIG. 23, when there are assumed a virtual reference plane (SP) including a center axis (O) of the spark plug (100) mounted on a cylinder head (S) and a virtual auxiliary reference plane (CSP) including the center axis (O) and perpendicularly intersecting the reference plane (SP), the intake valves (201, 201) are disposed on one side with respect to the reference plane (SP), and the exhaust valves (203, 203) are disposed on the opposite side with respect to the reference plane (SP), such that all the valves are located substantially the same distance from the reference plane (SP). One intake valve (201) and one exhaust valve (203) are disposed on one side with respect to the auxiliary reference plane (CSP), and the other intake valve (201) and the other intake valve (203) are disposed on the opposite side with respect to the auxiliary reference plane (CSP). The semi-creeping discharge ground electrode (12) is disposed such that its base end attached to a metallic shell (5) is located closer to the reference plane (SP) than to the auxiliary reference plane (CSP); in FIG. 23, the base end is located substantially on the reference plane (SP). A parallel ground electrode (11) is disposed such that its base end attached to the metallic shell (5) is located closer to the auxiliary reference plane (CSP) than to the reference plane (SP); in FIG. 23, the base end is located substantially on the auxiliary reference plane (CSP).

The above-described spark plug (100) differs in mounting orientation from an ordinary spark plug having a parallel ground electrode only. In a combustion chamber (CR) of the internal combustion engine (150), an intake air discharged from the intake valve (201) flows toward the exhaust valve (203). In this connection, according to a study conducted by the present inventors, mounting orientation of the spark plug (100) of the present invention to be applied to a direct-injection-type internal combustion engine must be determined in consideration of a vertical flow (tumble), which is induced by a cavity formed on a piston (P) biasedly extending from a central portion of the piston (P) to a side toward the intake valve, and a horizontal flow (squish), which arises from rise of the piston (P) and is directed toward the cavity from a region along the wall surface of the combustion chamber (CR); more specifically, the mounted spark plug (100) must be oriented such that the semi-creeping discharge ground electrodes (12) reliably exhibit ignition characteristics thereof. When the spark plug (100) is mounted in such a manner as to establish the above-described positional relationships, a spark generated from either of the semi-creeping discharge ground electrodes (12) is directed substantially perpendicular to a flow of intake air, although the spark is likely to be influenced by squish, in view of the semi-creeping discharge ground electrode (12) being located near the wall surface of the combustion chamber.

Particularly, in the spark plug (100) having two semi-creeping discharge electrodes (12, 12) located at opposite positions offset 90° from the parallel ground electrode (11), orienting a welded portion between the parallel ground electrode (11) and the metallic shell (5) toward a side facing the intake valve (201) is particularly effective. In other words, orienting the free end of the parallel ground electrode (11) toward a side facing the exhaust valve (203) is preferred. Since a spark generated from the parallel ground electrode (11) is influenced by both tumble and squish, the spark encounters a flow of intake air coming from a position obliquely forward of the spark plug. Since the flow of intake mixture is of a considerably high flow rate, if the parallel ground electrode (11) is oriented in reverse with respect to the orientation described above, a spark drifts away from the parallel ground electrode (11) during the course of sparking, potentially resulting in interruption of sparking. Through employment of the above-described orientation, even when a spark drifts, interruption of sparking becomes unlikely, by virtue of presence of the parallel ground electrode (11), and thus impairment in ignition characteristics becomes unlikely.

In an internal combustion engine having two intake valves (201, 201) and two exhaust valves (203, 203) (i.e., in a 4-valve internal combustion engine), the above-described arrangement may be employed, while the intake valves (201, 201) and the exhaust valves (203, 203) are handled in pairs. Specifically, the following arrangement may be employed. Generally, in a 4-valve internal combustion engine, two intake valves (201, 201) are disposed on one side of a pent-roof-type cylinder head (S), which assumes a miter roof shape as viewed from the front side of the internal combustion engine, (i.e., on one side with respect to the reference plane (SP)), and two exhaust valves (203, 203) are disposed on the opposite side. The intake valve (201) and the exhaust valve (203) that are located on the same side with respect to the auxiliary reference plane (CSP) face each other with the reference plane (SP) being interposed therebetween. The spark plug (100) may be mounted such that the semi-creeping discharge ground electrodes (12, 12) are located at intermediate angular positions about the center axis (O) between the paired, mutually facing intake and exhaust valves (201, 203).

The present inventors studied a spark plug having the basic structure described above and found that the position of sparking is not determined by solely the distance between electrodes, and that under certain conditions sparking occurs even across a large gap (herein called "inverse sparking phenomenon"). The inverse sparking phenomenon raises a problem in that upon occurrence of "carbon fouling," sparking does not occur across the insulator gap (γ) as expected, but occurs between the insulator and the front end face of the metallic shell (herein called "metallic-shell-insulator sparking"). Several configurations of a spark plug according to the present invention provide specific means for solving problems introduced by the inverse sparking phenomenon, such as metallic-shell-insulator sparking.

Prevention of, for example, metallic-shell-insulator sparking is greatly effective in the case of a direct-injection-type internal combustion engine of stratified-charge combustion system. In a direct-injection-type internal combustion engine, impairment in ignition characteristics is likely to result from sparking between the insulator and the front end face of the metallic shell, implying that the position of sparking influences ignition characteristics. Specifically, in an internal combustion engine of stratified-charge combustion system, a rich-mixture layer is present in a very narrow region within a combustion chamber. In the remaining region, the mixture becomes considerably lean. Whether or not a spark can be reliably generated in the rich-mixture layer determines whether or not the mixture is ignited normally. If a spark can be reliably generated across the regular spark discharge gap of a spark plug; i.e., across the gap between the center electrode and the ground electrode, upon arrival of the rich-mixture layer at the gap, the spark can ignite intake mixture.

However, as mentioned above, the rich-mixture layer is formed only in a very narrow region. Thus, if a spark is not generated across the regular spark discharge gap, but is generated at a different position (i.e., near the wall surface of the combustion chamber) as in the case of metallic-shell-insulator sparking, the mixture is not ignited; i.e., misfire occurs, in spite of generation of spark, since the mixture is very lean at that position. Such sparking in the vicinity of the wall surface of the combustion chamber or at a like position results in misfire in the combustion cycle, resulting in a drop in the output of the internal combustion engine and a potential failure to satisfy the emission regulations due to ejection of unburnt mixture from an exhaust pipe. Further, an unburnt gas is not completely exhausted from the exhaust pipe, but adheres to the wall surface of the combustion chamber and to the spark plug. As a result, the insulator is wetted with fuel, and thus sparking becomes more difficult in the next cycle.

Thus, if the inverse sparking phenomenon and associated metallic-shell-insulator sparking are prevented to thereby reliably induce sparking across the air gap (α) or the semi-creepage gap (β), even when "carbon fouling" occurs, deposited carbon can be burnt out through sparking by the semi-creeping discharge ground electrode. Even in a direct-injection-type internal combustion engine, if sparking is induced by the semi-creeping discharge ground electrode, impairment in ignition characteristics can be suppressed, since rich mixture is exposed to sparking. That is, the present invention is applicable not only to an ordinary internal combustion engine, but also to a direct-injection-type internal combustion engine. Particularly, application to a direct-injection-type internal combustion engine is greatly effective in suppressing "carbon fouling," reducing the amount of "channeling," and reducing ablation of the center electrode on the side surface thereof. However, the conventional art as described in the aforementioned Japanese Patent Application Laid-Open (kokai) No. 9-199260, among others, fails to propose improvement in a spark plug from the above-described point of view.

On the assumption that the above-described basic structure is employed, configurations of a spark plug of the present invention will next be described in more detail.

A first configuration is characterized by assuming the above-described basic structure, and in that:

the air gap (α) is not greater than 1.1 mm (1-(i));

the insulator gap (γ) falls within a range of 0.5 mm to 0.7 mm (1-(ii)); and a diametral difference δ between the insulator and the metallic shell as measured along the front end face of the metallic shell is not less than 3.6 mm (1-(iii)).

The present inventors carried out extensive studies and experimentally proved that, in a spark plug having the above-described basic structure, satisfaction of the above-described conditions (1-(i)) to (1-(iii)) in relation to the air gap (α), the insulator gap (γ), and the diametral difference (δ) between the insulator and the metallic shell effectively suppresses the inverse sparking phenomenon and associated metallic-shell-insulator sparking even upon occurrence of, for example, "carbon fouling," thereby ensuring sparking across the insulator gap (γ). On the basis of this finding, the invention of the first configuration was accomplished.

The air gap (α) can be designed to various values according to required ignition characteristics, air-fuel ratio of mixture, and other factors. Since the insulator gap (γ) must be smaller than the air gap (α), the insulator gap (γ) is set to a value falling within an appropriate range according to the air gap (α). In a spark plug according to the first configuration, the air gap (α) and the insulator gap (γ) are assumed to be set to values falling within the ranges (1-(i)) and (1-(ii)), respectively. The gist of the first configuration lies in that, under this assumption, the diametral difference δ between the insulator and the metallic shell as measured along the front end face of the metallic shell is set to a value falling within the range (1-(iii)). By setting the diametral difference (δ) to such a value, even when "carbon fouling" occurs, a foul substance adhering to the insulator can be burnt out through sparking induced by the semi-creeping discharge ground electrode. Even in a direct-injection-type internal combustion engine, if sparking is induced by the semi-creeping discharge ground electrode, impairment in ignition characteristics can be suppressed, since rich mixture is exposed to sparking. The distance α across the air gap (α)

cannot be reduced unconditionally. A distance α of, for example, not less than 0.6 mm is effective in view of attainment of required ignition characteristics, prevention of short circuit upon adhesion of electrically conductive foreign matter as in the case of, for example, fouling (the same also applies to spark plugs according to other configurations of the present invention). The diametral difference (δ) cannot be increased unconditionally. For example, a diametral difference (δ) not greater than 5.4 mm, preferably not greater than 5.0 mm, is effective (the same also applies to spark plugs according to other configurations of the present invention).

A spark plug according to a second configuration is characterized by assuming the previously described basic structure, and in that:

the air gap (α) falls within a range of 0.8 mm to 1.0 mm (2-(i));

the insulator gap (γ) falls within a range of 0.5 mm to 0.7 mm (2-(ii)); and the air gap (α) and the insulator gap (γ) satisfy the relationship "0.2 mm≦(α−γ)≦0.4 mm" (2-(iii)). The invention of the second configuration can be combined with the invention of the first configuration.

In the spark plug of the second configuration, in order to reduce spark voltage, the air gap (α) is set to a value falling within the somewhat narrower range (2-(i)), and the insulator gap (γ) is set to a value falling within the range (2-(ii)) (equal to that of the first configuration). The difference (α−γ) between the air gap (α) and the insulator gap (γ) is set to a value falling within the range (2-(iii)), thereby effectively suppressing the inverse sparking phenomenon and associated metallic-shell-insulator sparking. The second configuration yields the following new, additional effect. In a direct-injection-type internal combustion engine, the range of injection end timing in which no misfire occurs can be extended.

Generally, in an internal combustion engine, the greater the air gap (α), the more desirable the ignition characteristics. However, discharge voltage increases with the air gap (α). Since a direct-injection-type internal engine is considerably prone to "carbon fouling," even at the time of regular operation, "carbon fouling" occurs. When the "carbon fouling" state is established, high discharge voltage increases the possibility of misfire. In a direct-injection-type internal combustion engine, ignition characteristics are said to improve with a misfire-free range in relation to ignition timing for sparking a spark plug as represented by crank angle and fuel injection end timing as represented by crank angle.

In a direct-injection-type internal combustion engine, a rich-mixture region emerging immediately after injection diffuses within a combustion chamber while gradually moving within the chamber. Therefore, the following tendency arises: the earlier the fuel injection end timing, the greater the diffusion of the rich-mixture region, thereby becoming thin, when a spark plug is to spark. Thus, lean mixture must be ignited. Since mixture to be ignited is thin, discharge voltage increases although the spark gap remains unchanged. As mentioned above, since the spark plug is usually in the "carbon fouling" state, carbon fouling and an increase in discharge voltage induced by lean mixture make the spark plug more prone to involve sparking between the metallic shell and the insulator; i.e., occurrence of metallic-shell-insulator sparking becomes more likely. As a result, the spark plug becomes prone to misfire. By contrast, the later the fuel injection end timing, the more likely sparking is to occur in rich mixture. In this state, combustion is carried out stably. However, in spite of stable combustion, sparking in rich mixture increases a tendency toward "carbon fouling." As a result, a spark is generated between the metallic shell and the insulator, potentially causing misfire.

The present inventors carried out studies and found the following: in a common internal combustion engine, the greater the air gap (α), the more desirable the ignition characteristics, whereas, in a direct-injection-type internal combustion engine, discharge voltage increases with gap, with a resultant impairment in ignition characteristics. According to an invention of the second configuration, the air gap (α) and the insulator gap (γ) are set to values falling within the range (2-(ii)), and the air gap (α) and the insulator gap (γ) conform to the relationship (2-(ii)), thereby suppressing sparking between the insulator and the front end face of the metallic shell and thus widening the range of stable combustion.

Extending a stable combustion range is preferred for the following reason. In a direct-injection-type internal combustion engine, ignition timing and fuel injection timing are controlled according to operation conditions. However, for example, when the throttle opening is changed abruptly, control may become inconsistent with a change in atmosphere around the spark plug. In such a state, a transitional phenomenon such as deviation in fuel injection timing or ignition timing from desirable timing may cause mixture around the spark plug to become thin or thick. When there arises a tendency for an increase in the interval between fuel injection timing and ignition timing, mixture becomes thin, and thus discharge voltage increases. When there arises a tendency for a decrease in the interval between fuel injection timing and ignition timing, sparking occurs in thicker mixture, and thus carbon fouling is worsened. Therefore, use of a spark plug having a wide stable combustion range ensures good combustion without involvement of misfire, even when such a transitional phenomenon arises.

Preferably, the diameter of a front end portion of the center electrode is reduced; and the width W of the parallel ground electrode as viewed from an axially frontward side of the insulator and measured across the center point of the center electrode is not greater than 2.2 mm and is not less than two times the outside diameter of the center electrode as measured along the front end face of the center electrode. Employment of such dimensional relationship decreases discharge voltage and prevents occurrence of a so-called bridge, which is a problem such that fuel is trapped between the center electrode and the ground electrode, while maintaining ignition characteristics intact.

A third configuration is characterized by assuming the previously described basic structure, and in that:

the air gap (α) is not greater than 0.9 mm (3-(i));

the insulator gap (γ) falls within a range of 0.5 mm to 0.7 mm (3-(ii)); and the diametral difference δ between the insulator and the metallic shell as measured along the front end face of the metallic shell is not less than 2.8 mm (3-(iii)). The third configuration can be combined with at least either the first configuration or the second configuration.

In a spark plug according to the third configuration, the air gap (α) and the insulator gap (γ) are assumed to be set to values falling within the ranges (3-(i)) and (3-(ii)), respectively. The air gap (α) is set to a value falling within a range narrower than the range (1-(i)) in the first configuration, for the same reason as in the case of the second configuration. Under this assumption, by setting the diametral difference (δ) between the insulator and the metallic shell as measured along the front end face of the metallic shell to a value falling within the range (3-(iii)), even when "carbon fouling" occurs, a foul substance adhering to the insulator can be burnt out through sparking induced by the semi-creeping discharge ground electrode. Even in a direct-injection-type internal combustion engine, if sparking is induced by the semi-creeping discharge ground electrode, impairment in ignition characteristics can be suppressed, since rich mixture is exposed to sparking.

A fourth configuration is characterized by assuming the previously described basic structure, and in that:

the air gap (α) is not greater than 1.1 mm (4-(i));

the insulator gap (γ) falls within a range of 0.5 mm to 0.7 mm (4-(ii)); and three or more semi-creeping discharge ground electrodes are disposed (4-(iii)). The fourth configuration can be combined with at least any one of the first to third configurations.

In a spark plug according to the fourth configuration, the setting ranges (4-(i)) and (4-(ii)) for the air gap (α) and the insulator gap (γ), respectively, are the same as (1-(i)) and (1-(ii)) in the first configuration. The fourth configuration differs from the first configuration in that three or more semi-creeping discharge ground electrodes are disposed in place of employing a requirement for the diametral difference (δ), in order to reduce frequency of occurrence of the inverse sparking phenomenon and associated metallic-shell-insulator sparking.

An increase in the number of semi-creeping discharge ground electrodes means an increase in the probability of occurrence of sparking from a semi-creeping discharge ground electrode. Accordingly, even when a spark plug is surrounded by an atmosphere which would cause metallic-shell-insulator sparking if the number of semi-creeping discharge ground electrodes is fewer, an increase in the number of semi-creeping discharge ground electrodes located in the vicinity of the front end face of the metallic shell allows reliable generation of spark by a semi-creeping discharge ground electrode upon occurrence of "carbon fouling," thereby burning out an adhering foul substance. Even in a direct-injection-type internal combustion engine, if sparking is induced by the semi-creeping discharge ground electrode, impairment in ignition characteristics can be suppressed, since rich mixture is exposed to sparking.

When a spark plug is attached to an internal combustion engine, a front end portion of an insulator is cooled by intake air, whose temperature is relatively low, introduced into a combustion chamber through an intake valve. As the number of semi-creeping discharge ground electrodes increases, a front end portion of the insulator is hidden behind semi-creeping discharge electrodes and thus may be less cooled, potentially inducing preignition. In view of this, preferably the number of semi-creeping discharge ground electrodes to be disposed is not greater than 4. The fourth configuration can be configured so as to satisfy the requirement (1-(iii)) for the diametral difference δ in the first configuration.

A spark plug according to a fifth configuration is characterized by assuming the previously described basic structure, and in that:

a front end portion of the insulator is formed into a straight tubular portion; with the term "frontward" referring to a side toward the front end portion of the insulator along the axial direction of the insulator, a rear edge of the end face of the semi-creeping discharge ground electrode is aligned with or is located frontward of the rear end position of the straight tubular portion; and the level difference E (unit: mm) along the axial direction between the front end face of the insulator and the rear edge of the end face of the semi-creeping discharge ground electrode, and the radius of curvature R (unit: mm) of a curved surface extending from the front end face of the insulator to the circumferential side surface of the insulator satisfy the relationship indicative of a difference therebetween "$R-E \leqq 0.1$ mm" (5-(i)). The fifth configuration can be combined with at least any one of the first to fourth configurations. The sign condition for the level difference E is defined such that a direction toward the front end of the insulator along the center axis of the insulator is positive. Accordingly, when the front end face of the insulator is located frontward of the rear edge of the end face of the semi-creeping discharge ground electrode, the level difference E assumes a positive value. In the reverse case, the level difference E assumes a negative value.

According to the fifth configuration, a spark directed from the rear edge of the end face of the semi-creeping discharge ground electrode to the center electrode is blocked off by a front end portion of the insulator, and thus the spark does not travel straight from a spark generation position on the semi-creeping discharge ground electrode to the center electrode, but is caused to change traveling directions and to creep along the circumferential surface of the insulator. As a result, the discharge path of spark changes every sparking, and thus the range of creepage of spark on the front end face of the insulator is widened, thereby reducing the amount of channeling and eliminating "carbon fouling" over a wide range of insulator surface through spark-utilized cleaning.

A spark caused to change traveling directions and to creep along the circumferential surface of the insulator involves an elongated discharge path and an increased spark generation voltage. Thus, in order to avoid such sparking, the frequency of sparking from the front edge, rather than from the rear edge, of the end face of the semi-creeping discharge ground electrode tends to increase, a spark from the front edge attacking the insulator more softly. Such a tendency also contributes to suppression of channeling. Sparking from the front edge effectively improves ignition characteristics, thereby effectively suppress misfire and a like problem. Particularly, when the level difference E is small; i.e., a lap along the direction of the center axis between the end face of the semi-creeping discharge ground electrode and the circumferential side surface of the insulator is narrow, sparking from the rear edge of the end face of the semi-creeping discharge ground electrode becomes likely, since sparking distance becomes relatively short. However, by adjusting the level difference E and the radius of curvature R of a curved surface extending from the front end face of the insulator to the circumferential side surface of the insulator so as to establish the relationship (5-(i)), the frequency of sparking from the front edge can be increased, thereby contributing to suppression of channeling or to enhancement of ignition characteristics. The present configuration is particularly effective for a spark plug having a narrow lap; specifically, a level difference E of not greater than 0.5 mm. The lower limit of the E value is appropriately determined such that semi-creeping discharge is not disabled. For example, when the E value is negative as shown in FIG. 4, the E value is determined such that an absolute value thereof becomes smaller than the air gap a.

In the present configuration, the insulator includes a straight tubular portion. Forming an front end portion of the insulator into a straight tubular shape suppresses transmission of heat received by the front end portion in the course of a combustion cycle of an internal combustion engine, to a retainment portion of the insulator retained by the metallic shell, thereby facilitating increase of the front end temperature of the insulator. Therefore, even in a direct-injection-type internal combustion engine, which encounters difficulty in raising the front end temperature of the insulator, there can be facilitated increase of the front end temperature of the insulator, thereby facilitating burning out of an adhering foul substance such as carbon which has been deposited through "carbon fouling." In such a configuration, since the thermal volume of a front end portion of the insulator is small, the insulator is likely to be cooled by an intake gas of relatively low temperature introduced from an intake pipe. Therefore, the front end temperature of the insulator is unlikely to increase to a level at which preignition occurs in the course of a combustion cycle in an internal combustion engine.

When the rear edge of the end face of the semi-creeping discharge ground electrode is located rearward of the rear end position of the straight tubular portion, dimensional setting of gaps becomes difficult. Therefore, the positional relationship between the straight tubular portion and the semi-creeping discharge ground electrode is set such that the rear edge of the end face of the creeping discharge ground electrode is aligned with or located frontward of the rear end position of the straight tubular portion. When the straight tubular portion becomes too long, a spark generated by the semi-creeping discharge ground electrode tends to be considerably dragged backward along the straight tubular portion, possibly impairing ignition characteristics. The straight tubular portion must be at least 0.5 mm long; otherwise, dimensional setting of gaps becomes difficult, and the above-described effect may not be sufficiently yielded. Preferably, the straight tubular portion is set to a length of 0.5 mm to 1.5 mm.

A spark plug according to a sixth configuration is characterized by assuming the previously described basic structure, and in that:

a projection amount F of the insulator projecting frontward beyond dimension A specified in an applicable JIS Standard (JIS B 8031) or a corresponding ISO Standard (ISO1910, ISO2704, ISO2346, ISO/DIS8479, ISO2705, ISO2344, ISO2345, ISO2347, or ISO3412) comparatively described in the JIS Standard falls within a range of 3.0 mm to 5.0 mm (6-(i)). The sixth configuration can be combined with at least any one of the first to fifth configurations.

According to the sixth configuration, the projection amount F of the insulator is set to a value falling within the range (6-(i)), thereby enhancing ignition characteristics and increasing the front end temperature of the insulator. As compared with an atmosphere around a spark generation position, an atmosphere between the insulator and the front end face of the metallic shell exhibits very low mixture concentration. However, employment of a projection amount F falling within the range (6-(i)) causes increase of voltage required to generate a spark in the atmosphere of low mixture concentration between the insulator and the front end face of the metallic shell, thereby suppressing sparking in the atmosphere. As a result, the range of injection end timing in which no misfire occurs can be extended.

A spark plug according to a seventh configuration is characterized by assuming the previously described basic structure, and in that:

the air gap ($\alpha$) is not greater than 1.1 mm (7-(i));

the insulator gap ($\gamma$) falls within a range of 0.5 mm to 0.7 mm (7-(ii));

and the difference $\psi$ (unit: mm) between an insulator front-end diameter $\phi D$ (unit: mm) and the width of the semi-creeping discharge ground electrode is not greater than 1.8 mm, where, in an orthogonal projection of the insulator onto a virtual plane in parallel with the axis of the insulator, the insulator front-end diameter $\phi D$ is defined as the distance between two points of intersection of a first extension line formed through outward extension of a line indicative of the front end face of the insulator and two second extension lines formed through frontward extension of two lines indicative of the circumferential side surface of the insulator located in opposition to each other with respect to the axis of the insulator and facing the semi-creepage gap ($\beta$) (7-(iii)). The seventh configuration can be combined with at least any one of the first to sixth configurations.

By reducing the difference $\psi$ between the insulator front-end diameter $\phi D$ and the width of the semi-creeping discharge ground electrode, a tendency for a spark generated from the semi-creeping discharge ground electrode to be considerably dragged rearward can be prevented. As a result, the range of injection end timing in which no misfire occurs can be extended, and ignition characteristics in a fuel lean state can be enhanced. An increase in the difference causes a spark to considerably detour along the outer circumferential surface of a front end portion of the insulator when sparking occurs between the semi-creeping discharge ground electrode and the center electrode, conceivably for the following reason. When a spark is generated obliquely rearward from a rear corner portion of the end face of the semi-creeping discharge ground electrode, the spark hits against a front end portion of the insulator and then reaches the center electrode. When the spark hits against a front end portion of the insulator, the spark creeps rearward along the outer circumferential surface of the insulator and then changes directions to creep toward the circumferential side surface of the front end of the center electrode. Therefore, if the difference between the insulator front-end diameter and the width of the semi-creeping discharge ground electrode is large, there increases the amount of creepage of a spark when the spark creeps obliquely rearward along the outer circumferential surface of the insulator, with a resultant great rearward drag of the spark.

In order for the difference $\psi$ between the width of the semi-creeping discharge ground electrode and the distance between two points of intersection of the first extension line and the two second extension lines to satisfy the relationship (7-(iii)), preferably the insulator front-end wall thickness $\rho$—which is defined as the minimum distance between a point of intersection of the first extension line and the second extension line formed through frontward extension of the line indicative of the circumferential side surface of the insulator facing the semi-creepage gap ($\beta$) and a point of intersection of the first extension line and an extension line indicative of the wall of the center through-hole—is not greater than 0.9 mm (7-(iv)).

Since satisfaction of the above-described relationship allows reduction of the insulator front-end wall thickness, discharge voltage can be decreased through concentration of electric field intensity, and the amount of channeling can be reduced through suppression of discharge voltage associated with the semi-creepage gap ($\beta$). Since the temperature of the front end of the insulator readily increases, in application to a direct-injection-type internal combustion engine, which is prone to carbon fouling, self-cleaning property is enhanced considerably. Since the entire insulator can be thin-walled, a wide clearance can be established between the metallic shell and the insulator, particularly in a spark plug of small diameter. When the wall thickness of the insulator becomes too thin, a spark may penetrate through the insulator at high possibility. Thus, the insulator front-end wall thickness $\rho$ is preferably not less than 0.6 mm, more preferably not less than 0.7 mm.

A spark plug according to an eighth configuration is characterized by assuming the previously described basic structure, and in that:

the projection amount H of the center electrode projecting from the front end face of the insulator is not greater than 1.25 mm (8-(i)). The eighth configuration can be combined with at least any one of the first to seventh configurations.

Particularly in a direct-injection-type internal combustion engine, sparking across the semi-creepage gap (β) during high-speed operation causes narrowing of the range of injection end timing in which no misfire occurs. However, according to the eighth configuration, the projection amount H of the center electrode projecting from the front end face of the insulator is set to the range (8-(i)), thereby allowing further reduction in the distance between the position of the air gap (α), which is a regular spark discharge gap, and a spark generation position associated with the semi-creeping discharge ground electrode. Thus, even in a direct-injection-type internal combustion engine, in which ignition characteristics tends to vary depending on a spark generation position, a spark which is generated from the semi-creeping discharge ground electrode upon occurrence of "carbon fouling" provides sufficient ignition characteristics. Preferably, the projection amount H of the center electrode projecting from the front end face of the insulator is not greater than 0.5 mm. Employment of such H value facilitates dispersion of spark propagation paths around the center electrode, thereby enhancing resistance to channeling and cleaning property for eliminating "carbon fouling." The H value may be negative; i.e., the center electrode may be retracted from the front end face of the insulator. In this case, an H value not less than −0.3 mm is preferred (a depth of recess not greater than 0.3 mm is preferred), in view of further enhancement of resistance to channeling and cleaning property for eliminating "carbon fouling."

A spark plug according to a ninth configuration is characterized by assuming the previously described basic structure, and in that the air gap (α), the semi-creepage gap (β), and the insulator gap (γ) satisfy the relationship "$\alpha \leqq 0.4\times(\beta-\gamma)+\gamma$" (9-(i)). The ninth configuration can be combined with at least any one of the first to eighth configurations.

The air gap (α), the semi-creepage gap (β), and the insulator gap (γ) satisfying the relationship (9-(i)) effectively suppresses inverse sparking and associated metallic-shell-insulator sparking. When an ambient gas around a gap of a spark plug is flowing as in application to an actual internal combustion engine, sparking is more likely to occur between the insulator and the front end face of the metallic shell; thus, satisfaction of the relationship (9-(i)) is favorable to suppression of such sparking.

In the ninth configuration, preferably the air gap (α) and the insulator gap (γ) satisfy the relationship "$(\alpha-\gamma)\leqq 0.4$ mm. Satisfaction of the relationship can reduce the amount of channeling in an internal combustion engine involving severe channeling conditions such as an internal combustion engine with a supercharger or an internal combustion engine with high compression ratio. However, when the (α−γ) value is less than 0.2 mm, the frequency of discharge induced by the semi-creeping discharge ground electrode decreases, potentially impairing cleaning property for eliminating "carbon fouling." Therefore, preferably, the (α−γ) value is not less than 0.2 mm.

Generally, even when a spark plug is not suffering "carbon fouling," a spark is not generated only across the air gap (α), but may also be generated across the insulator gap (γ). Even when an internal combustion engine is operating under the same conditions, voltage required for initiating sparking differ among gaps of a spark plug, since an ambient atmosphere differs among the gaps. Accordingly, when the air gap (α) is lower in voltage required for sparking than the insulator gap (γ), sparking arises across the air gap (α).

Since voltage required for sparking varies in each gap, measurement of minimum and maximum voltages required for sparking reveals that the spans of voltage required for sparking across the air gap (α) and the insulator gap (γ) may overlap with each other. The span of overlap substantially depends on the size of the gaps. When discharge voltage required for initiating sparking increases to a level of the overlap according to an ambient atmosphere around a gap of a spark plug, whether sparking is initiated across the air gap (α) or across the insulator gap (γ) becomes uncertain. In such a case, sparking across the insulator gap (γ) tends to induce channeling because of its high discharge voltage.

When, in order to prevent such channeling, the air gap (α) is narrowed so as to decrease the difference between the air gap (α) and the insulator gap (γ), the maximum voltage required for initiating sparking across the air gap (α) decreases, and thus the overlap is narrowed. As a result, unnecessary sparking across the insulator gap (γ) can be suppressed, and discharge voltage at the time of sparking across the insulator gap (γ) decreases to thereby reduce the amount of channeling. Employment of an air gap (α) not greater than 0.9 mm can suppress voltage required for initiating sparking to a low level, and thus is particularly effective for a high-thermal-value-type plug (a plug whose distance between the front end of an insulator and a retainment portion of the insulator retained by a metallic shell is short), whose insulation resistance between a center electrode and a metallic shell is prone to decrease upon occurrence of "carbon fouling."

A spark plug according to a tenth configuration is characterized by assuming the previously described basic structure, and in that the width of the semi-creeping discharge ground electrode as viewed from an axially frontward side of the insulator and measured at at least the end face thereof is greater than the diameter of the center through-hole of the insulator as measured at the front end thereof. The tenth configuration can be combined with at least any one of the first to ninth configurations.

According to the tenth configuration, the semi-creeping discharge ground electrode is formed such that the width of the semi-creeping discharge ground electrode as measured at at least the end face thereof is greater than the diameter of the center through-hole of the insulator as measured at the front end thereof (thus is greater than the outside diameter of the front end face of the center electrode or that of the front end face of a noble metal chip, which will be described later). Thus, a spark creeping along the front end face of the insulator covers a wide range of insulator surface, thereby reducing the amount of channeling and eliminating "carbon fouling" over a wide range of insulator surface through spark-utilized cleaning.

A spark plug according to an eleventh configuration is characterized by assuming the previously described basic structure, and in that a front end portion of the insulator is formed into a straight tubular portion having a reduced diameter, and a portion of the insulator located axially rearward of and adjacent to the straight tubular portion is formed into a bulge portion having a diameter greater than that of the straight tubular portion;

the length of the straight tubular portion is not greater than 1.5 mm; and on a virtual plane including the axis of the insulator and a midpoint of the rear edge, as viewed along the axial direction of the insulator, of the end face of the semi-creeping discharge ground electrode, the bulge portion is located entirely outside a circle with a center thereof at the midpoint of the rear edge and a radius of ($\gamma$+0.1) mm, where $\gamma$ (unit: mm) is a distance across the insulator gap. The eleventh configuration can be combined with at least any one of the first to tenth configurations.

The eleventh configuration also employs the straight tubular portion having a length not greater than 1.5 mm (preferably not less than 0.5 mm). The effect of the straight tubular portion is as described above in the section of the fifth configuration. For a structural reason, the bulge portion having a diameter greater than that of the straight tubular portion is formed axially rearward of and adjacent to the straight tubular portion. If the bulge portion is too close to the rear edge of the end face of the semi-creeping discharge ground electrode, a spark from the rear edge tends to be directed toward an electric field concentration part of the bulge portion (particularly an edge of a shoulder portion, the edge being radiused or machined in a like manner) and thus be dragged rearward, potentially impairing ignition characteristics.

In order to cope with the problem, according to the eleventh configuration, on a virtual plane including the axis of the insulator and a midpoint of the rear edge, as viewed along the axial direction of the insulator, of the end face (which serves as a discharge face for discharge across the semi-creepage gap) of the semi-creeping discharge ground electrode, the bulge portion is located entirely outside a circle with a center thereof at the midpoint of the rear edge and a radius of ($\gamma$+0.1) mm, where $\gamma$ (unit: mm) is a distance across the insulator gap. In this manner, the bulge portion is located away from the rear edge of the end face of the semi-creeping discharge ground electrode, thereby effectively suppressing a rearward drag on a spark from the semi-creeping discharge ground electrode and thus maintaining good ignition characteristics.

A spark plug according to a twelfth configuration is characterized by assuming the previously described basic structure, and in that the diameter of the center through-hole of the insulator is reduced at a front end portion of the insulator. The twelfth configuration can be combined with at least any one of the first to eleventh configurations. Since a spark plug of the present invention includes semi-creeping discharge ground electrodes, the twelfth configuration appropriately suppress a tendency for heat received by a front end portion of the insulator in the course of a combustion cycle in an internal combustion engine to be released to the center electrode, thereby facilitating increase of the front end temperature of the insulator. Therefore, even in a direct-injection-type internal combustion engine, which encounters difficulty in raising the front end temperature of the insulator during regular operation, there can be facilitated increase of the front end temperature of the insulator, thereby facilitating burning out of carbon which has been deposited through "carbon fouling." This prevents generation of a spark between the insulator and the front end face of the metallic shell and generation of a spark in the vicinity of a retainment portion. Thus, even in application to a direct-injection-type internal combustion engine, the range of stable combustion can be widened. Preferably, the twelfth configuration satisfies Additional Requirement 3, which will be described later.

A spark plug according to a thirteenth configuration is characterized by assuming the previously described basic structure, and in that, with the term "frontward" referring to a side toward the front end portion of the insulator along the axial direction of the insulator and with a plane of projection being defined as a plane including the axis of the insulator and perpendicularly intersecting a virtual plane including the axis of the insulator and a midpoint of the rear edge of the end face of the semi-creeping discharge ground electrode, the end face as orthogonally projected on the plane of projection is shaped such that, on the plane of projection, with X referring to a point of intersection of the axis and the rear edge, Y referring to a point of intersection of the axis and the front edge, and a reference line being defined as a line passing through a midpoint of segment XY and perpendicularly intersecting the axis, area S1 of a domain located frontward of the reference line is greater than area S2 of a domain located rearward of the reference line. The thirteenth configuration can be combined with at least any one of the first to twelfth configurations.

In view of suppression of channeling and enhancement of ignition characteristics, preferably sparking from the semi-creeping discharge ground electrode is such that, on the end face thereof serving as a discharge face, the frequency of sparking from the front edge rather than from the rear edge is increased, since a spark from the front edge attacks the insulator more softly. Thus, the end face of the semi-creeping discharge ground electrode is shaped such that area S1 of a domain located frontward of the reference line, which is located at an intermediate position between the front edge and the rear edge, is greater than area S2 of a domain located rearward of the reference line, thereby increasing the frequency of sparking from the front edge of the end face and thus contributing to suppression of channeling or to enhancement of ignition characteristics.

A spark plug according to a fourteenth configuration is characterized in that, with the term "frontward" referring to a side toward the front end portion of the insulator along the axial direction of the insulator and with a plane of projection being defined as a plane including the axis of the insulator and perpendicularly intersecting a virtual plane including the axis of the insulator and a midpoint of the rear edge of the end face of the semi-creeping discharge ground electrode, the end face as orthogonally projected on the plane of projection is shaped such that, on the plane of projection, with X referring to a point of intersection of the axis and the rear edge, Y referring to a point of intersection of the axis and the front edge, and a reference line being defined as a line passing through a midpoint of segment XY and perpendicularly intersecting the axis, at least a corner portion of a domain located rearward of the reference line is radiused at a radius of curvature of not less than 0.2 mm or chamfered at a width of not less than 0.2 mm, or two sides defining the corner portion form an angle greater than 90 degrees. The fourteenth configuration can be combined with at least any one of the first to thirteenth configurations.

The gist of the fourteenth configuration is to suppress sparking from the rear edge of the end face, which serves as a discharge face, of the semi-creeping discharge ground electrode. When a sharp corner portion is present, the portion tends to serve as a starting point of sparking. Elimination of such a sharp corner portion from the domain located rearward of the reference line suppresses sparking from the rear edge of the end face. As a result, the frequency of sparking from the front edge can be increased, thereby contributing to suppression of channeling or to enhancement of ignition characteristics. When such a sharp corner portion is formed at each end of the rear edge, the sharp corner portions may serve as starting points of sparking such that sparks from the corner portions are obliquely dragged backward to a great extent, potentially resulting in significantly impaired ignition characteristics. The fourteenth configuration eliminates a sharp corner portion from the rear edge, thereby preventing or suppressing such a problem. Combination of the fourteenth configuration with the thirteenth configuration suppresses channeling or enhances ignition characteristics far more effectively.

Next will be described additional requirements, which are common among spark plugs according to the above-described first to fourteenth configurations (including combination thereof).

(Additional Requirement 1)

A front end portion of the insulator can be formed into a straight tubular portion such that the straight tubular portion extends rearward of the front end face of the metallic shell. This configuration allows establishment of a further increased diametral difference between the insulator and the front end face of the metallic shell, thereby facilitating suppression of sparking at the position of the front end face. Preferably, the length of the straight tubular portion is up to 1.5 mm. Action and effect in relation to formation of the straight tubular portion are similar to those described in the section of the eleventh configuration.

(Additional Requirement 2)

A noble metal chip formed of a noble metal or noble metal alloy having a melting point not lower than 1600° C. can be joined to a front end portion of a base material of the center electrode. In this case, a joint of the chip and the base material is located within the center through-hole. Disposing the joint inside the center through-hole allows sparking between the semi-creeping discharge ground electrode and the noble metal chip not only when sparking arises across the air gap (α) but also when sparking arises across the semi-creepage gap (β). Accordingly, durability is enhanced regardless of whether sparking arises across either gap. In addition to Pt and Ir, noble metal alloys having a melting point not lower than 1600° C. such as Pt alloys and Ir alloys; specifically, Pt—Ir, Ir—Rh, Ir—Pt, and Ir—$Y_2O_3$, are preferred.

(Additional Requirement 3)

Preferably, the minimum bore diameter (D3) of the center through-hole as measured at a front end portion of the insulator located frontward of a retainment portion of the metallic shell, the insulator being engaged with and retained by the retainment portion, is not greater than 2.1 mm. Such reduction of the bore diameter of the insulator allows reduction of the outside diameter of the center electrode. Thus, heat received by a front end portion of the insulator in the course of a combustion cycle in an internal combustion engine encounters some difficulty in being released toward the center electrode, thereby facilitating increase of the front end temperature of the insulator. Therefore, even in a direct-injection-type internal combustion engine, which encounters difficulty in raising the front end temperature of the insulator during regular operation, there can be facilitated increase of the front end temperature of the insulator, thereby facilitating burning out of carbon which has been deposited through "carbon fouling." This prevents generation of a spark between the insulator and the front end face of the metallic shell and generation of a spark in the vicinity of the retainment portion. Thus, even in application to a direct-injection-type internal combustion engine, the range of stable combustion can be widened. However, in view of prevention of channeling, the D3 value is preferably not less than 0.8 mm.

(Additional Requirement 4)

When the above-mentioned noble metal chip is to be used, the noble metal chip can be configured such that the outside diameter of a joint portion between the noble metal chip and the base material of the center electrode is greater than that of a front end portion used to define the air gap (α). Through employment of such a configuration, even when a spark is generated across the semi-creepage gap (β), dropping off of the noble metal chip from the base material of the center electrode can be prevented. Specifically, when sparking arises across the semi-creepage gap (β), a spark is generated between the side surface of the noble metal chip and the semi-creeping discharge ground electrode. Frequent sparking at this position causes the noble metal chip to be ablated in the vicinity of the front end face of the insulator; as a result, the diameter of the ablated portion becomes smaller than that of a front end portion of the noble metal chip. Thus, sparking across the semi-creepage gap (β) is repeated, a front end portion of the noble metal chip may finally drop off. However, through increase of the diameter of a joint portion of the chip, such a phenomenon can be suppressed.

Since the diameter of a front end portion of the noble metal chip is smaller than that of a joint portion of the chip, discharge voltage at the time of sparking across the air gap (α) can be decreased, thereby enhancing ignition characteristics. Particularly, in application to a direct-injection-type internal combustion engine, the range of stable combustion can be widened. A diametrally enlarged portion of the noble metal chip may be retracted inward from the front end face of the insulator. In this case, when a spark is generated across the semi-creepage gap (β), the spark creeps along the front end face of the insulator and then along the inner wall of the center through-hole of the insulator, and then reaches the diametrally enlarged portion of the noble metal chip. Therefore, even though the diametrally enlarged portion is located within the center through-hole of the insulator, a spark is generated between the diametrally enlarged portion and the semi-creeping discharge ground electrode, thereby yielding the above-described effect.

(Additional Requirement 5)

The minimum diametral difference between the outside diameter of the noble metal chip and the bore diameter of the center through-hole can be not greater than 0.2 mm. This facilitates suppression of ablation of the base material of the center electrode, the ablation potentially being induced by spark discharge. As described above, when a spark is generated across the semi-creepage gap (β), the spark creeps along the inner wall of the center through-hole of the insulator. At this time, if the diametral difference between the outside diameter of the noble metal chip and the bore diameter of the center through-hole of the insulator is large, the spark may not head for the noble metal chip, but may creep deep into the center through-hole up to the base material of the center electrode. The base material of the center electrode is lower in spark ablation resistance than the noble metal chip, and thus is prone to quick ablation, potentially resulting in dropping off of the chip. Therefore, reduction of the diametral difference suppresses a phenomenon that a spark reaches the base material of the center electrode, thereby enhancing durability. Notably, herein the expression "minimum diametral difference" represents the following diametral difference. When the outside diameter of the noble metal chip and the bore diameter of the center through-hole are uniform along the axial direction, the diametral difference becomes substantially uniform along the axial direction. However, when either the outside diameter of the noble metal chip or the bore diameter of the center through-hole is not uniform along the axial direction (for example, when the center through-hole is slightly tapered), the minimum diametral difference as measured along the axial direction is employed as a representative value.

BEST MODE FOR CARRYING OUT THE INVENTION

Modes of the present invention will next be described with reference to the drawings.

Figure 1:
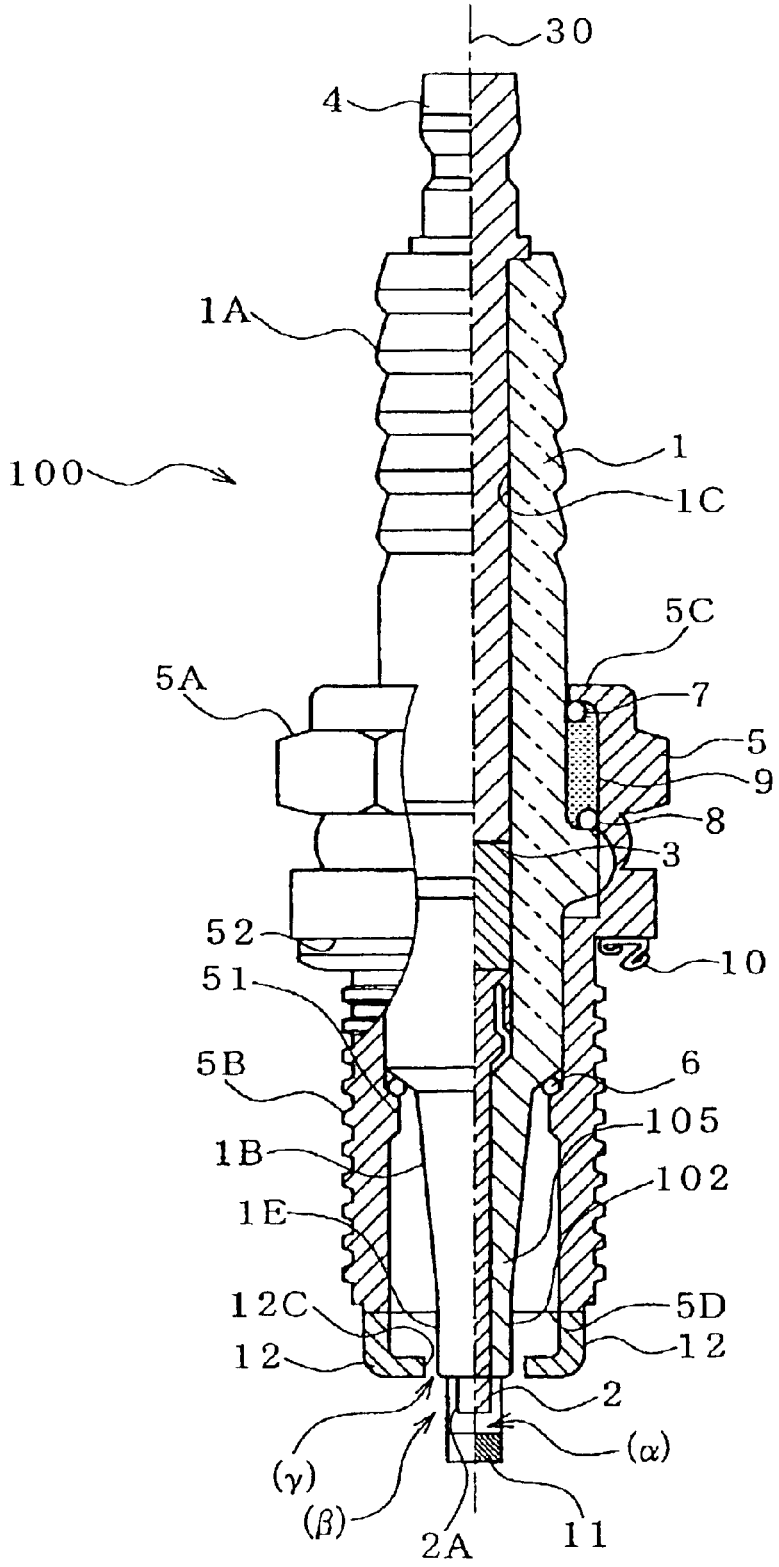
FIG. 1 is a partially sectional view of a spark plug according to a first mode of the present invention.

FIG. 1 is a partially sectional view of a spark plug 100 according to a first mode of the present invention. As well known, an insulator 1 formed of alumina or the like includes corrugations 1A provided at a rear end portion thereof for increasing a creepage distance; a leg portion 1B provided at a front end portion thereof and to be exposed to the combustion chamber of an internal combustion engine; and a center through-hole 1C formed along the center axis. The center through-hole 1C holds therein a center electrode 2. When the center electrode 2 employs a noble metal chip, the center electrode 2 is formed of INCONEL (trade name). When the center electrode 2 does not employ a noble metal chip, in order to ensure spark ablation resistance, the center electrode 2 is formed of 95% mass nickel (balance: e.g., chromium, manganese, silicon, aluminum, and iron), a nickel-type metal containing nickel in an amount of not less than 85% by mass, or a like metal. The center electrode 2 is provided in such a manner as to project from the front end face of the insulator 1.

The center electrode 2 is electrically connected to an upper metallic terminal member 4 via a ceramic resistor 3 provided within the center through-hole 1C. An unillustrated high-voltage cable is connected to the metallic terminal member 4 so as to apply high voltage to the metallic terminal member 4. The insulator 1 is enclosed by a metallic shell 5 and supported by a retainment portion 51 and a crimped portion 5C of the metallic shell 5. The metallic shell 5 is made of low-carbon steel and includes a hexagonal portion 5A to be engaged with a spark wrench, and a male-threaded portion 5B of a nominal size of, for example, M14S. The metallic shell 5 is crimped to the insulator 1 by means of the crimped portion 5C, whereby the metallic shell 5 and the insulator 1 are united. In order to complement hermetic seal effected by crimping, a sheetlike packing member 6 and a wirelike sealing members 7 and 8 are interposed between the metallic shell 5 and the insulator 1. A space provided between the sealing members 7 and 8 is filled with a powdered talc 9. A gasket 10 rests on the rear end of the male-threaded portion 5B; i.e., on a seat surface 52 of the metallic shell 5.

Figure 24:
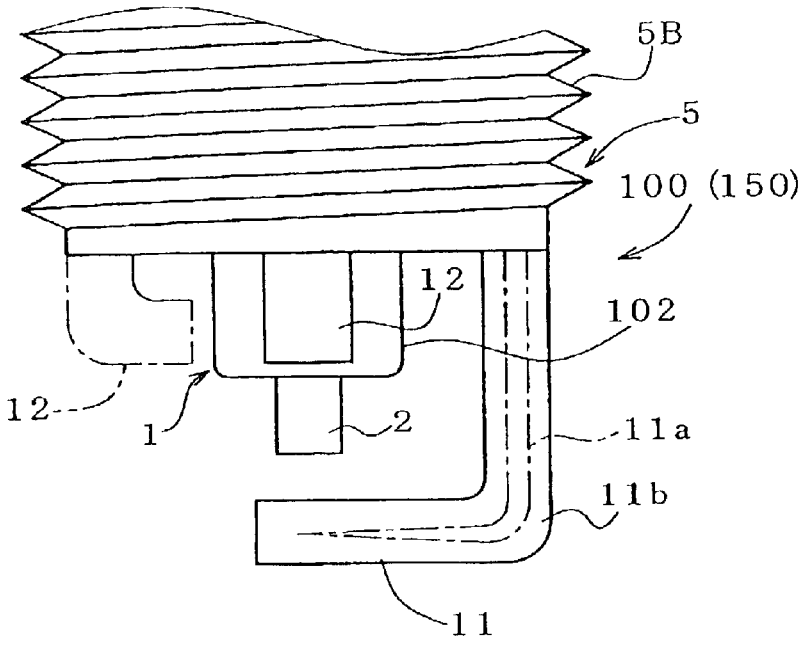
FIG. 24 is a side view showing an essential portion of an example spark plug including three semi-creeping discharge electrodes and a parallel ground electrode having a material of good heat conduction disposed therein.

A parallel ground electrode 11 is welded to a front end face 5D of the metallic shell 5. A base material used to form at least a surface layer portion of the parallel ground electrode 11 is a nickel alloy. The parallel ground electrode 11 axially faces the front end face of the center electrode 2 to thereby form an air gap (α) therebetween. The distance between opposed sides of the hexagonal portion 5A is 16 mm, and the length between the seat 52 and the front end face 5D of the metallic shell 5 is set to, for example, 19 mm. The set dimension is a basic dimension of a spark plug having a small hexagon size of 14 mm and a dimension A of 19 mm as prescribed in JIS B 8031. As shown in FIG. 24, in order to lower the temperature of a front end portion of the parallel ground electrode 11 for suppressing spark ablation, a material of good heat conduction 11*a* (e.g., Cu, pure Ni, or a composite material thereof) higher in thermal conductivity than a base material 11*b* may be provided within the parallel ground electrode 11. The above-mentioned configuration is similar to that of a conventional spark plug.

Figure 2:
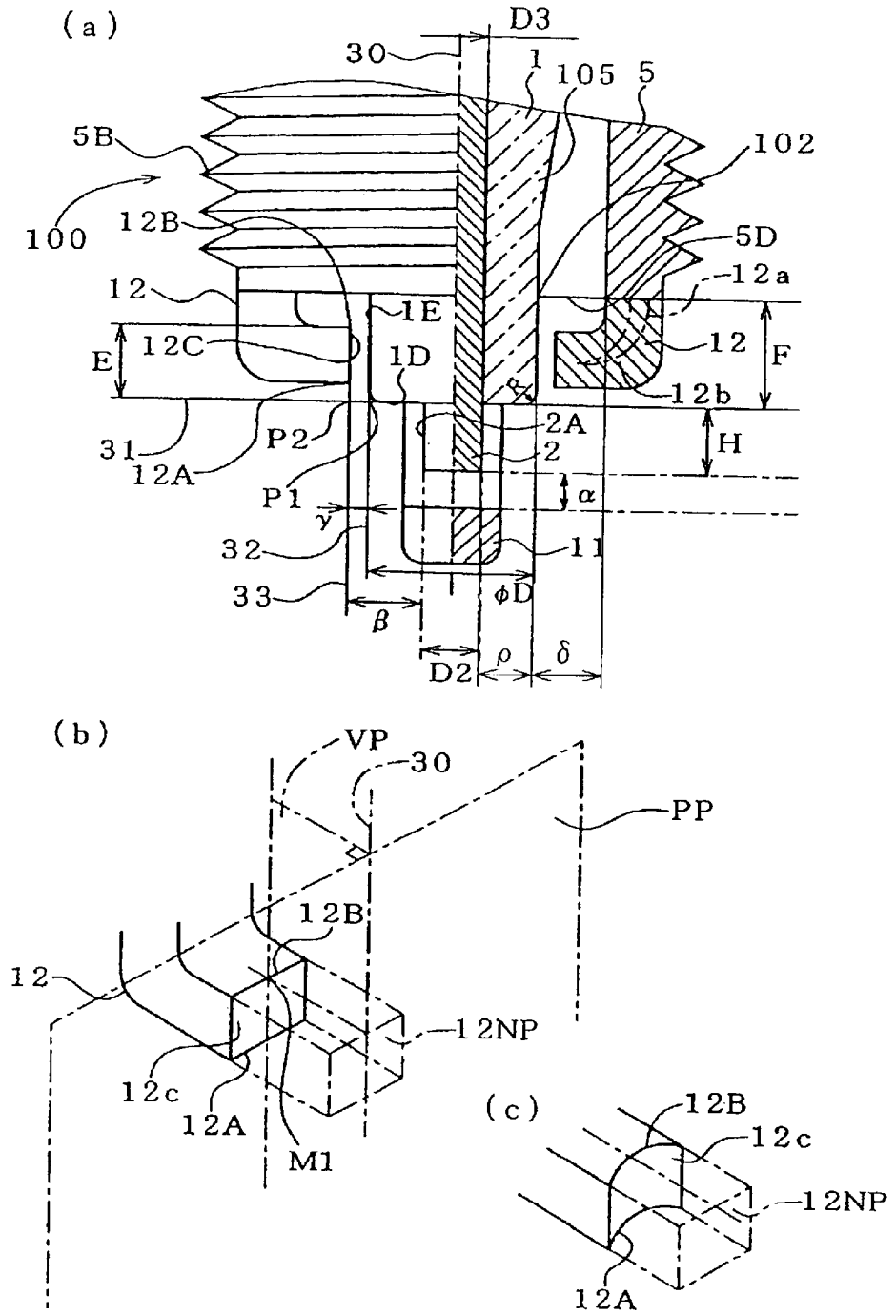
FIG. 2(*a*) is an enlarged partially sectional view showing electrodes and their peripheral portions of a spark plug according to a first embodiment of the first mode, and FIGS. 2(*b*) and 2(*c*) are views for explaining projection of a semi-creeping discharge ground electrode 12 onto plane PP.
Figure 26:
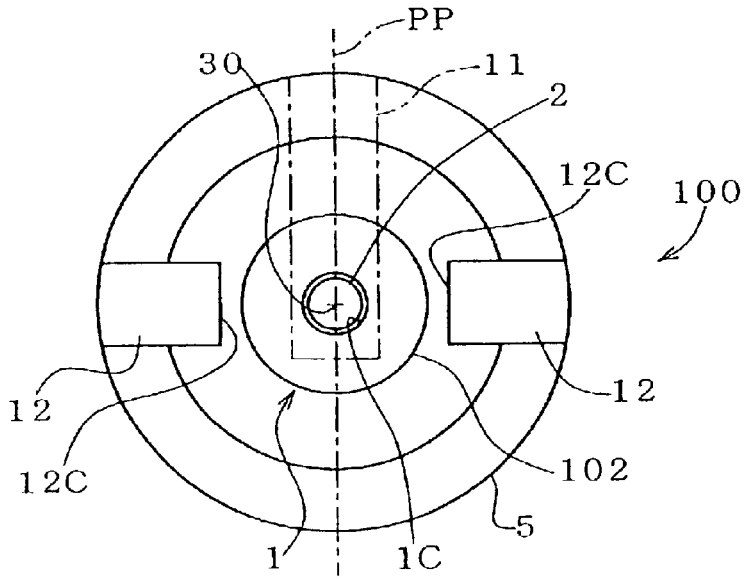
FIG. 26 is a bottom view of the spark plug of FIG. 2.

The spark plug 100 according to the present mode includes a plurality of semi-creeping discharge ground electrodes 12 in addition to the parallel ground electrode 11. Each of the semi-creeping discharge ground electrodes 12 is configured such that a base material 12*b* (see FIG. 2(*a*)) used to form at least a surface layer portion thereof is a nickel alloy; one end is welded to the front end face 5D of the metallic shell 5; and an end face 12C of the other end faces either a circumferential side surface 2A of the center electrode 2 or a circumferential side surface 1E of the leg portion 1B. As shown in FIG. 26, two semi-creeping discharge ground electrodes 12 are circumferentially shifted by 90° from the parallel ground electrode 11 while being circumferentially shifted by substantially 180° from each other. FIG. 26 shows a state in which a front end portion of the insulator 1 is viewed from the front side along an axis 30. The end face 12C of each semi-creeping discharge ground electrode 12 has a width greater than the diameter of an opening of the center through-hole 1C as measured along the front end face of the insulator 1. As shown in FIG. 2, a semi-creepage gap (β) is formed between the end face 12C of each semi-creeping discharge ground electrode 12 and the circumferential side surface 2A of the center electrode 2; and an insulator gap (γ) is formed between the end face 12C of each semi-creeping discharge ground electrode 12 and the circumferential side surface 1E of the leg portion 1B.

Figure 27:
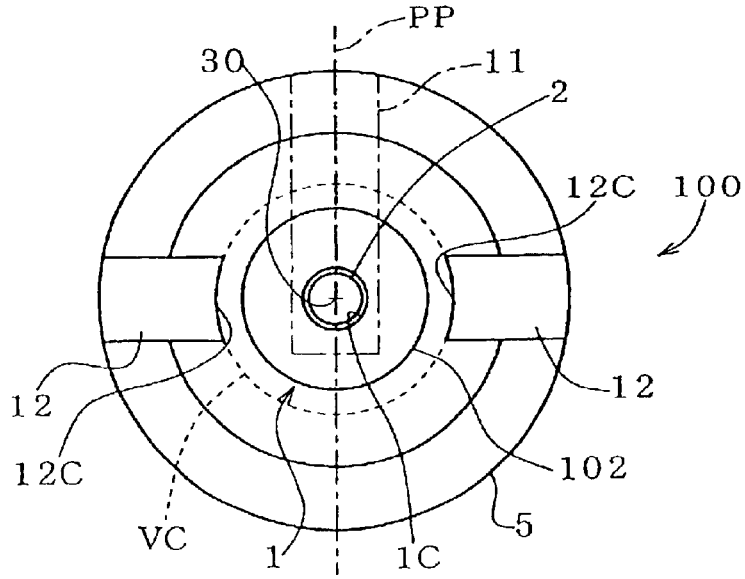
FIG. 27 is a bottom view showing an example of a semi-creeping discharge ground electrode whose end face assumes the form of a cylindrical surface in FIG. 26.

In FIG. 26, the end face 12C of the semi-creeping discharge ground electrode 12 is formed flat. However, as shown in FIG. 27, in order to form a substantially uniform semi-creepage gap along the circumferential side surface of the insulator 2, the end face 12C may be formed into a cylindrical shape while the axis (30 in FIG. 2) of the insulator 2 serves as the center of the cylindrical shape, through, for example, blanking.

As in the case of the parallel ground electrode 11, a material of good heat conduction 12*a*, such as Cu, pure Ni, or a composite material thereof, may be provided within the semi-creeping discharge ground electrode 12. In this case, the semi-creeping discharge ground electrode 12 includes the base material 12*b* used to form a surface layer portion and the material of good heat conduction 12*a* used to form an inner layer portion and having thermal conductivity higher than that of the base material 12*b*.

FIG. 2(*a*) is an enlarged partially sectional view showing the center electrode 2, the parallel ground electrode 11, the semi-creeping discharge ground electrodes 12, and their peripheral portions of a spark plug according to a first embodiment of the first mode. FIG. 2(*b*) is an explanatory enlarged view showing the semi-creeping discharge ground electrode 12. In FIG. 2(*a*), the letter a represents the distance across the air gap (α) between the front end face of the center electrode 2 and the parallel ground electrode 11, and the letter β represents the distance across the semi-creepage gap (β) between the circumferential side surface 2A of the center electrode 2 and the end face 12C of the semi-creeping discharge ground electrode 12 as measured along the front end face 1D of the insulator 1. FIG. 2(*a*) defines a first extension line 31, a second extension line 32, and a third extension line 33 in the case where the semi-creeping discharge ground electrode 12 and the insulator 1 are sectioned along the center axis 30; specifically, a line indicative of the front end face 1D of the insulator 1 is extended outward to thereby form the first extension line 31; a line indicative of the circumferential side surface 1E located in the vicinity of the semi-creepage gap (β) of the insulator 1 is extended toward the front end face 1D to thereby form the second extension line 32; and a line indicative of the end face 12C of the semi-creeping discharge ground electrode 12 is extended frontward to thereby form the third extension line 33. A distance γ across the insulator gap (γ) is defined as the distance between a point of intersection P1 of the first extension line 31 and the second extension line 32 and a point of intersection P2 of the first extension line 31 and the third extension line 33. The distance γ represents the shortest distance between the insulator 1 and the semi-creeping discharge ground electrode 12. The distances α, β, and γ satisfy the relationships "α<β" and "γ<α."

Through setting of the gaps as described above, at the time of regular operation, which establishes high insulation on the surface of the insulator 1, discharge can be performed across the air gap (α) associated with the parallel ground electrode 11, whereas, at the time of "carbon fouling," which involves low insulation on the surface of the insulator 1, discharge can be performed across the semi-creepage gap (β) associated with the semi-creeping discharge ground electrode 12. The letter E represents the level difference between the front end face 1D of the insulator 1 and a rear edge 12B of the end face 12C of the semi-creeping discharge ground electrode 12; the letter F represents the projection amount of the insulator 1 projecting from the front end face 5D of the metallic shell 5; and the letter H represents the projection amount of the center electrode 2 from the front end face 1D of the insulator 1. The projection amount F of the insulator 1 from the front end face 5D of the metallic shell 5 in the present mode corresponds to a projection amount of an insulator projecting frontward beyond dimension A specified in an applicable JIS Standard (JIS B 8031) or a corresponding ISO Standard comparatively described in the JIS Standard.

A front end portion of the insulator 1 is formed into a straight tubular portion 102 (a portion whose outer circumferential surface assumes a right cylindrical shape with the center axis 30 as its center axis), and the straight tubular portion 102 extends rearward of the front end face 5D of the metallic shell 5. This configuration allows establishment of a further increased diametral difference between the insulator 1 and the front end face 5D of the metallic shell 5, thereby facilitating suppression of sparking at the position of the front end face 5D. Since a front end portion of the insulator 1 is formed into a straight tubular shape, heat received by the front end portion of the insulator 1 in the course of a combustion cycle in an internal combustion engine encounters some difficulty in being released toward a portion of the insulator 1 to be retained by the retainment portion 51 of the metallic shell 5, thereby facilitating increase of the front end temperature of the insulator 1. Therefore, even in a direct-injection-type internal combustion engine, which encounters difficulty in raising the front end temperature of the insulator 1 during regular operation, there can be facilitated increase of the front end temperature of the insulator 1, thereby facilitating burning out of carbon which has been deposited through "carbon fouling." In such a configuration, since the thermal volume of the front end portion of the insulator 1 is small, the insulator 1 is likely to be cooled by an intake gas of relatively low temperature introduced from an intake pipe. Therefore, the front end temperature of the insulator 1 is unlikely to increase to a level at which preignition occurs in the course of a combustion cycle in an internal combustion engine. Notably, the rear edge of the end face 12C of the semi-creeping discharge ground electrode 12 is located frontward of the rear end of the straight tubular portion 102.

In the present embodiment, unless otherwise specified, the projection amount F of the insulator 1 is 3.0 mm, and a trunk diameter D2 of the center electrode 2 is 2.0 mm. The semi-creeping discharge ground electrode 12 has a width of 2.2 mm and a thickness of 1.0 mm. The parallel ground electrode 11 has a width of 2.5 mm and a thickness of 1.4 mm.

Figure 3:
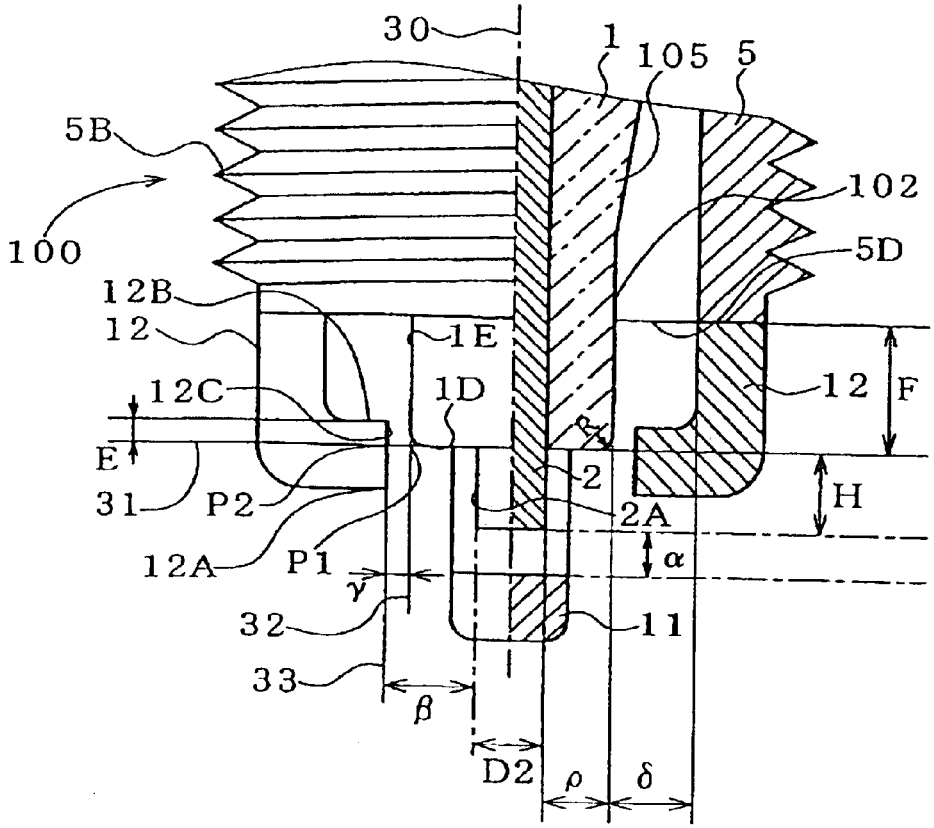
FIG. 3 is an enlarged partially sectional view showing electrodes and their peripheral portions of a spark plug according to a second embodiment of the first mode.
Figures 4, 5:
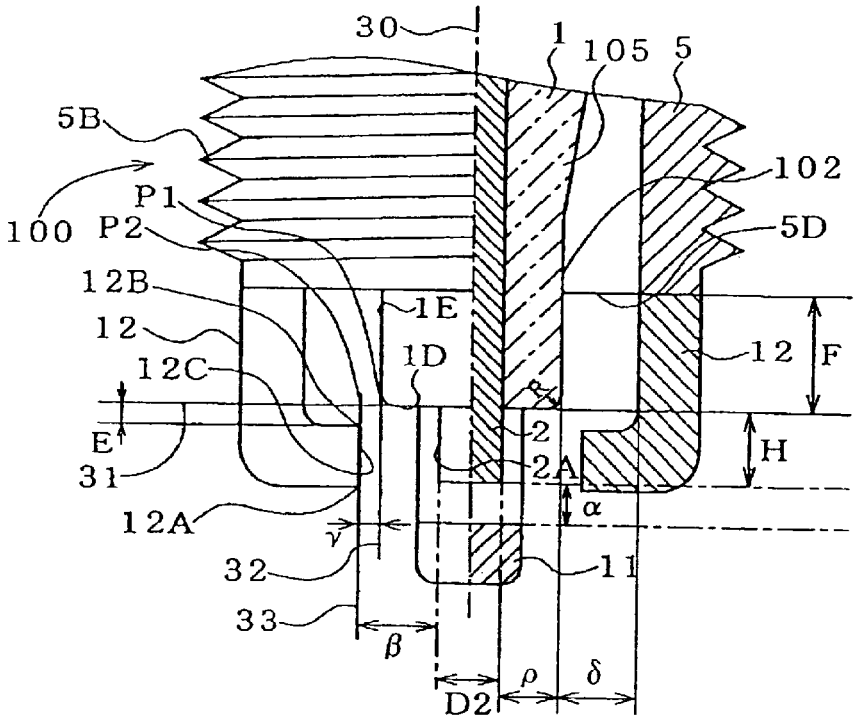
FIG. 4 is an enlarged partially sectional view showing electrodes and their peripheral portions of a spark plug according to a third embodiment of the first mode.
FIG. 5 is a graph showing the relationship between the range of injection end timing in which combustion is stabilized, and the projection amount (F) of an insulator projecting frontward beyond dimension A specified in an applicable JIS Standard (JIS B 8031) or a corresponding ISO Standard comparatively described in the JIS Standard.

The level difference E between the front end face 1D of the insulator 1 and the rear edge 12B of the end face 12C of the semi-creeping discharge ground electrode 12 involves three types in terms of the level of the semi-creeping discharge ground electrode 12. Specifically, in the first type, as shown in FIG. 2(*a*), the rear edge 12B and the front edge 12A (FIG. 2(*b*)) of the semi-creeping discharge ground electrode 12 are located rearward of the front end face 1D of the insulator 1. In the second type, as shown in FIG. 3 illustrating a spark plug according to a second embodiment of the first mode, only the rear edge 12B of the semi-creeping discharge ground electrode 12 is located rearward of the front end face 1D of the insulator 1. In the third type, as shown in FIG. 4 illustrating a spark plug according to a third embodiment of the first mode, the rear edge 12B of the semi-creeping discharge ground electrode 12 is located frontward of the front end face 1D of the insulator 1.

In any one of the above-described types, preferably, the level of either the rear edge 12B or the front edge 12A of the end face 12C of the semi-creeping discharge ground electrode 12 is in the vicinity of that of the front end face 1D of the insulator 1. That is, a small level difference E is preferred, for the following reason. According to a conceivable mechanism of semi-creeping discharge, sparks are generated from the rear edge 12B and the front edge 12A of the semi-creeping discharge ground electrode 12, since the edges are sharp, and thus electric field is concentrated on the edges. By bringing sparks generated from the rear edge 12B and the front edge 12A close to the front end face 1D of the insulator 1, there can be enhanced self-cleaning property for burning out carbon deposited on the surface of the insulator 1.

Dimensions or dimensional relationships of the above-described spark plug 100 are determined as appropriate depending on which configuration described above in the "Means for Solving the Problems and Action and Effect" section is employed. Relevant specific configurations will next be described together with the results of experiments conducted to support their action and effect.

(Experiment 1: Basis for First Configuration (α<1.1 mm, 0.5 mm≦γ≦0.7 mm, δ≧3.6 mm))

Various spark plugs were prepared under the following conditions: air gap (α) 1.1 mm; two semi-creeping discharge ground electrodes 12 disposed as shown in FIG. 26; insulator gap (γ) 0.6 mm; semi-creepage gap (β) 1.6 mm; and the bore diameter of a front end portion of the metallic shell 5 located frontward of the retainment portion 51 of the metallic shell 5 was set to various values. Table 1 shows the results of Experiment 1 on the frequency of spark discharge between the front end face 5D of the metallic shell 5 and the insulator 1 (metallic-shell-insulator sparking) as measured at different values of the diametral difference (δ) between the insulator 1 and the metallic shell 5 as measured along the front end face 5D of the metallic shell 5. Experiment 1 was carried out by use of a car having a 1800 cc, straight 4-cylinder, direct-injection-type internal combustion engine, under the following conditions: shift lever at D range; and idling at 600 rpm. Ignition timing of a spark plug was fixed to 15° before top dead center (hereinafter called "BTDC"), and fuel injection end timing was fixed to 300 BTDC. The criteria of evaluation are as follows: the frequency of metallic-shell-insulator sparking was 3 times or more per minute: X; 1 or 2 times: Δ; and metallic-shell-insulator sparking did not occur at all: ○.

TABLE 1

| Diametral difference δ (mm) | 2.8 | 3.0 | 3.2 | 3.4 | 3.6 |
|---|---|---|---|---|---|
| Sparking frequency | X | X | X | Δ | ○ |

At a diametral difference (δ) of not greater than 3.4 mm between the insulator 1 and the metallic shell 5 as measured along the front end face 5D of the metallic shell 5, sparking occurred at least once at the position of the front end face 5D. This indicates that, through employment of a diametral difference of not less than 3.6 mm, even when "carbon fouling" occurs, a spark can be generated across the insulator gap (γ) without involvement of sparking between the insulator 1 and the front end face 5D of the metallic shell 5. Effect to be yielded through suppression of metallic-shell-insulator sparking, particularly that in a direct-injection-type internal combustion engine of stratified-charge combustion system, has already been described.

(Experiment 2: Basis for Third Configuration (α≦0.9 mm, 0.5 mm≦γ≦0.7 mm, δ≧2.8 mm))

Various spark plugs were prepared under the following conditions: diametral difference (δ) between the insulator 1 and the metallic shell 5 as measured along the front end face 5D of the metallic shell 5 2.8 mm; two semi-creeping discharge ground electrodes 12; insulator gap (γ) 0.6 mm; semi-creepage gap (β) 1.6 mm; and the air gap (α) was set to various values. Except for use of these spark plugs, Experiment 2 was carried out under the same conditions as those of Experiment 1. The same criteria were used for evaluation. Table 2 shows the results.

TABLE 2

| Air gap (α) (mm) | 0.8 | 0.9 | 1.0 | 1.1 |
|---|---|---|---|---|
| Sparking frequency | ○ | ○ | Δ | X |

As is apparent from Table 2, at an air gap (α) not less than 1.0 mm, metallic-shell-insulator sparking occurs at least once at the position of the front end face 5D of the metallic shell 5. This indicates that, through employment of an air gap (α) not greater than 0.9 mm, a spark can be generated across the insulator gap (γ) without involvement of metallic-shell-insulator sparking.

(Experiment 3: Basis for Fourth Configuration (Three or More Semi-Creeping Discharge Ground Electrodes Are Disposed))

Various spark plugs were prepared under the following conditions: air gap (α) 1.1 mm; diametral difference (b) between the insulator 1 and the metallic shell 5 as measured along the front end face 5D of the metallic shell 5 2.8 mm; insulator gap (γ) 0.6 mm; semi-creepage gap (β) 1.6 mm; and the number of semi-creeping discharge ground electrodes 12 was set to various values. Except for use of these spark plugs, Experiment 3 was carried out under the same conditions as those of Experiment 1. The same criteria were used for evaluation. Table 3 shows the results.

TABLE 3

| Number of semi-creeping ground electrodes | 1 | 2 | 3 | 4 |
|---|---|---|---|---|
| Sparking frequency | X | X | ○ | ○ |

Figure 25:
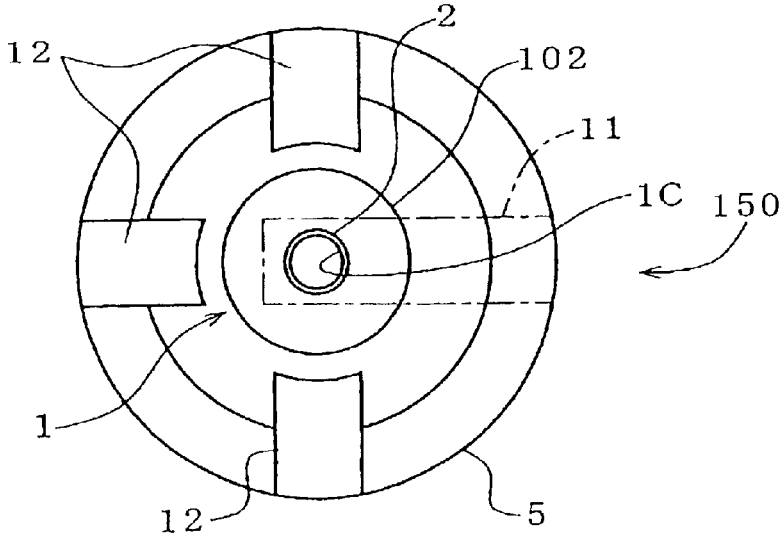
FIG. 25 is a bottom view showing an example spark plug including three semi-creeping discharge electrodes.

As is apparent from Table 3, even under the conditions of an air gap (α) of 1.1 mm and a diametral difference δ of 2.8 mm, under which Experiment 1 exhibited an unacceptable result, disposition of three or more semi-creeping discharge ground electrodes 12 effectively suppresses metallic-shell-insulator sparking at the position of the front end face 5D of the metallic shell 5. This indicates that, through disposition of three or more semi-creeping discharge ground electrodes 12, even when "carbon fouling" arises, a spark can be generated across the insulator gap (γ) without involvement of metallic-shell-insulator sparking. FIG. 24 shows addition of a third semi-creeping discharge ground electrode 12 (represented by the dot-and-dash line) to the spark plug 100 of FIG. 2. FIG. 25 is a plan view of FIG. 24, showing three semi-creeping discharge ground electrodes 12 and the parallel ground electrode 11 arranged at substantially 90° intervals around the center axis of an insulator 30.

(Experiment 4: Basis for Fifth Configuration (the Level Difference E Between the Front End Face of the Insulator and the Rear Edge of the End Face of the Semi-creeping Discharge Ground Electrode, and the Radius of Curvature R of a Curved Surface Extending from the Front End Face of the Insulator to the Circumferential Side Surface of the Insulator Satisfy the Relationship Indicative of a Difference Therebetween "R−E≦0.1 mm"))

Various spark plugs of FIG. 2 were prepared under the following conditions: the parallel ground electrode 11 was removed; two semi-creeping discharge ground electrodes 12; insulator gap (γ) 0.6 mm; semi-creepage gap (β) 1.6 mm; and the level difference E between the front end face 1D of the insulator 1 and the rear edge 12B of the end face 12C of the semi-creeping discharge ground electrode 12, and the radius of curvature R of a curved surface extending from the front end face 1D of the insulator 1 to the circumferential side surface 1E of the insulator 1 were varied. In order to evaluate channeling resistance of these spark plugs, Experiment 4 was carried out in the following manner. Each of the spark plugs was attached to a chamber; the interior of the chamber was pressurized to 0.6 MPa; and sparking was induced at a frequency of 60 times per second for 100 hours by use of a full-transistor power supply. After the test operation, the spark plugs were measured for the depth of a channeling groove. The depth of a channeling groove was evaluated as follows: less than 0.2 mm: minor (○); 0.2–0.4 mm: medium (Δ); and in excess of 0.4 mm: serious (X). The results are shown in Table 4.

TABLE 4

| | E (mm) | | | |
|---|---|---|---|---|
| R (mm) | 0.1 | 0.2 | 0.3 | 0.4 |
| 0.2 | ○ | ○ | ○ | ○ |
| 0.3 | X | ○ | ○ | ○ |
| 0.4 | X | Δ | ○ | ○ |

As is apparent from Table 4, when the air gap (α) and the semi-creeping gap (β) satisfy the relationship "α<β," and the air gap (α) and the insulator gap (γ) satisfy the relationship "α>γ," establishment of the relationship "R−E≦0.1 mm" can effectively reduce channeling. Conceivably, a spark directed from the rear edge 12B of the end face of the semi-creeping discharge ground electrode 12 to the center electrode 2 is blocked off by a front end portion of the insulator 1, and thus the spark does not travel straight from a spark generation position on the semi-creeping discharge ground electrode 12 to the center electrode 2, but is caused to change traveling directions and to creep along the circumferential surface of the insulator 1. As a result, the discharge path of spark changes every sparking, and thus the range of creepage of spark on the front end face 1D of the insulator 1 is widened, thereby reducing the amount of channeling and eliminating "carbon fouling" over a wide range of insulator surface through spark-utilized cleaning. Notably, a spark plug of the present invention originally includes the parallel ground electrode 11. However, use of the parallel ground electrode 11 in the experiment raises a problem in that sparking from the semi-creeping discharge ground electrode 12 does not occur unless fouling progresses. Even though fouling arises, sparking from the semi-creeping discharge ground electrode 12 is interrupted upon foul deposit being burnt off, thus consuming a very long period of time for the channeling evaluation test. Therefore, in order to accelerate channeling behavior associated with the semi-creeping discharge ground electrode 12, the parallel ground electrode 11 was intentionally removed for evaluation.

E values were selected from a range of 0.1–0.7 mm. For each of the selected E values, the channeling groove depth δ0 (mm) at an (R−E) value of 0.2 mm and the channeling groove depth δ1 (mm) at an (R−E) value of 0 mm were measured. The anti-channeling improvement width λ as expressed below was calculated.

$$\lambda = \delta 0 - \delta 1 \text{ (mm)}$$

On the basis of the thus-calculated λ value, there was estimated to what extent anti-channeling effect is improved through reduction of the (R−E) value from 0.2 mm to 0 mm. The results are shown in Table 5.

TABLE 5

| E (mm) | 0.1 | 0.3 | 0.5 | 0.7 |
|---|---|---|---|---|
| λ (mm) | 0.1 or more | 0.1 or more | 0.1–0.05 | less than 0.05 |

As is apparent from Table 5, employment of a level difference E not greater than 0.5 mm yields particularly high anti-channeling effect.

(Experiment 5: Basis for Sixth Configuration (the Projection Amount F of the Insulator 1 Falls within a Range of 3.0 mm to 5.0 mm))

Various spark plugs were prepared under the following conditions: air gap (α) 1.1 mm; diametral difference (δ) between the insulator 1 and the metallic shell 5 as measured along the front end face 5D of the metallic shell 5 2.8 mm; two semi-creeping discharge ground electrodes 12; insulator gap (γ) 0.6 mm; semi-creepage gap (β) 1.6 mm; and the projection amount (F) of the insulator 1 projecting frontward beyond dimension A specified in an applicable JIS Standard (JIS B 8031) or a corresponding ISO Standard comparatively described in the JIS Standard were varied. As in the case of Experiment 1, Experiment 5 was carried out by use of a car having a 1800 cc, straight 4-cylinder, direct-injection-type internal combustion engine, under the following conditions: shift lever at D range; and idling at 600 rpm. Ignition timing of a spark plug was fixed to 15° BTDC. At each of selected values of the projection amount (F) of the insulator 1, there was measured the range of injection end timing in which the frequency of misfire per minute becomes substantially zero (the range of stable combustion). In the case of a direct-injection-type internal combustion engine, this range serves as a scale for determining ignition characteristics.

Figure 6:
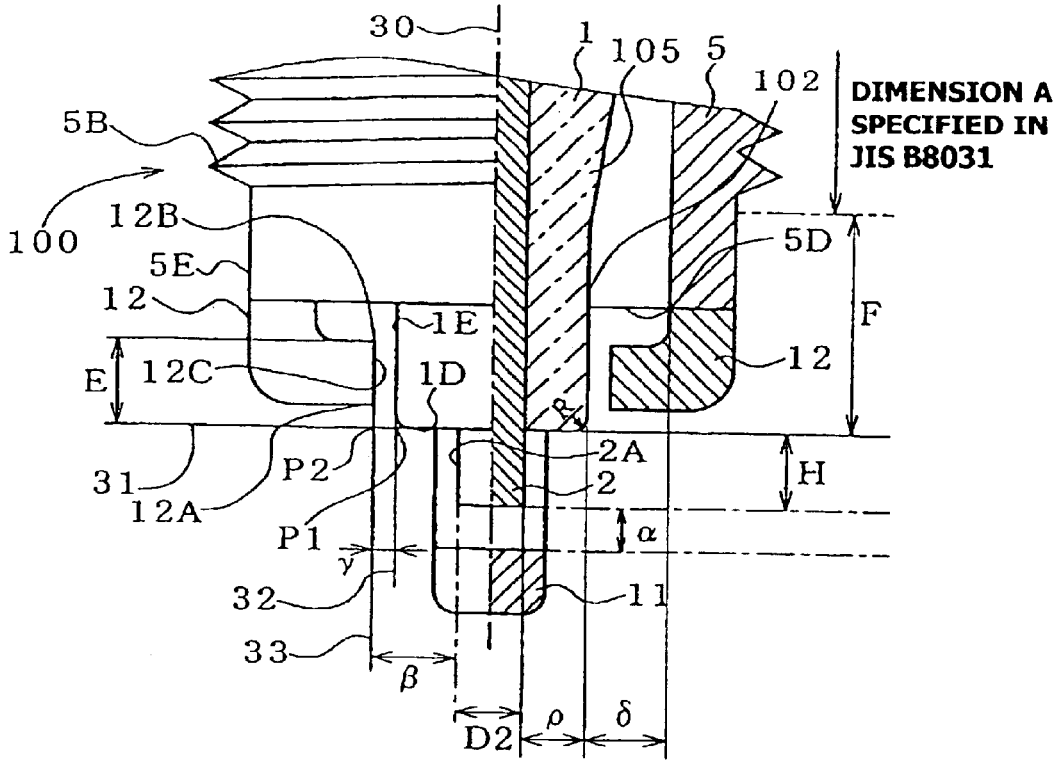
FIG. 6 is an enlarged partially sectional view showing electrodes and their peripheral portions of a spark plug according to a fourth embodiment of the first mode.

FIG. 5 shows the results. As is apparent from FIG. 5, employment of a projection amount (F) of the insulator 1 falling within a range of 3.0 mm to 5.0 mm can widen the range of fuel injection end timing in which no misfire occurs (i.e., the width of the range of stable combustion). Similar test results are also obtained in the case of an extended-shell-type spark plug according to the fourth embodiment of the first mode as shown in FIG. 6, in which a front end portion 5E of the metallic shell 5 located frontward of the male-threaded portion 5B is extended. However, in this case, the projection amount (F) of the insulator 1 is not a dimension as measured from the front end face 5D of the metallic shell 5, but is the dimension plus an extended length of the front end portion 5E; i.e., the dimension plus the length of a front end portion projecting forward beyond dimension A specified in the JIS Standard.

(Experiment 6: Basis for Eighth Configuration (the Projection Amount (H) of the Center Electrode 2 Projecting from the Insulator 1 is Not Greater than 1.25 mm))

Various spark plugs were prepared under the following conditions: air gap (α) 1.1 mm; two semi-creeping discharge ground electrodes 12; insulator gap (γ) 0.6 mm; semi-creepage gap (β) 1.6 mm; diameter of center electrode 2.5 mm; and the projection amount (H) of the center electrode 2 projecting from the front end face 1D of the insulator 1 was set to various values. These spark plugs were subjected to Experiment 6 by use of a car similar to that used in Experiment 5, and were measured for the range of stable combustion. However, Experiment 6 was not carried out under the idling condition, but was carried out through running on the proving ground at 100 km/h (to simulate high-speed operation). Ignition timing of a spark plug was fixed to 25° BTDC. Other conditions were similar to those of Experiment 5. At each of selected values of the projection amount (H) of the center electrode 2, there was measured the range of injection end timing in which the frequency of misfire per minute becomes substantially zero. The results are shown in FIG. 7.

Figure 7:
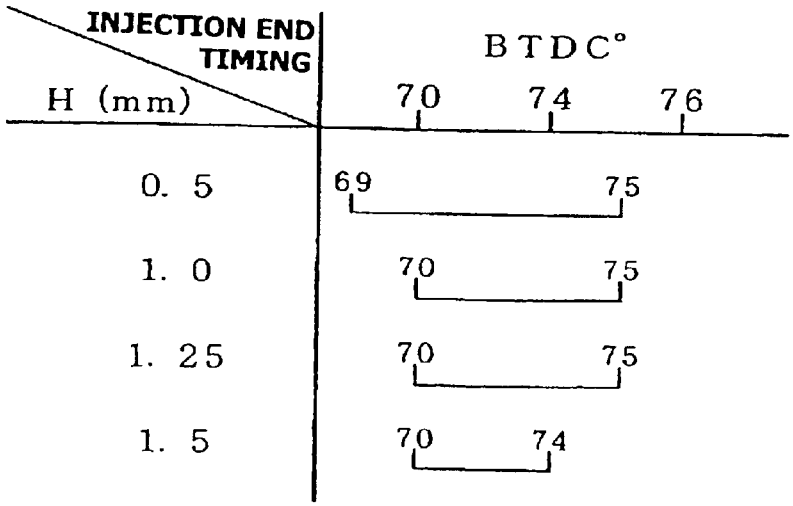
FIG. 7 is a graph showing the relationship between the range of injection end timing in which combustion is stabilized, and the projection amount of a center electrode 2 from a front end face 1D of an insulator 1.
Figure 28:
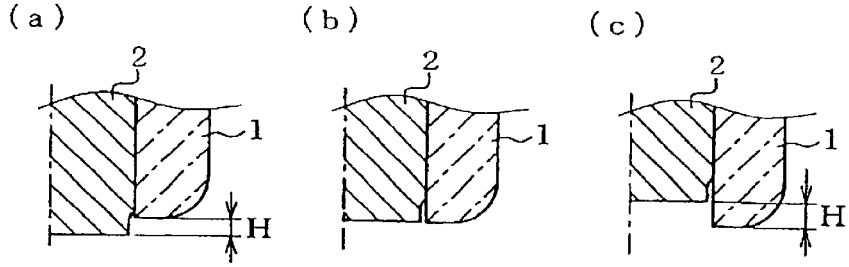
FIG. 28 is a series of views showing various typical relationships between the front end face of the center electrode and the front end face of the insulator.

As is apparent from FIG. 7, when the air gap (α) and the semi-creeping gap (β) satisfy the relationship "α<β," and the air gap (α) and the insulator gap (γ) satisfy the relationship "α>γ," employment of a projection amount (H) of the center electrode from the front end face of the insulator of not greater than 1.25 mm can widen the range of fuel injection end timing in which no misfire occurs, even though sparking arises across the semi-creepage gap (β) during high-speed operation. Thus, even in a direct-injection-type internal combustion engine, in which ignition characteristics tends to vary depending on a spark generation position, a spark which is generated from the semi-creeping discharge ground electrode 12 upon occurrence of "carbon fouling" provides sufficient ignition characteristics. Notably, the H value is herein positive as shown in FIG. 28(*a*). However, the H value may be substantially zero (i.e., the front end face of the center electrode 2 or the front end face of a noble metal chip, which will be described later, is substantially aligned with the front end face of the insulator 1) as shown in FIG. 28(*b*), or may be negative (i.e., the front end face is retracted behind the front end face of the insulator 1) as shown in FIG. 28(*c*). In this case, in view of further enhancement of resistance to channeling and cleaning property for eliminating "carbon fouling," an H value falling within a range of −0.3 mm to 0.5 mm is more preferred.

(Experiment 7: Basis for Ninth Configuration (α≦0.4×(β−γ)+γ))

Various spark plugs were prepared under the following conditions: semi-creepage gap (β) 1.6 mm; various parallel ground electrodes 11 were employed so as to establish various air gaps (α); and various pairs of semi-creeping discharge ground electrodes 12, each pair being of the same dimensions, were employed so as to establish various insulator gaps (γ). Each of the spark plugs was attached to a chamber, and a desktop test for observing a sparking direction with the interior of the chamber being pressurized to 1.0 MPa was carried out in order to check whether or not a spark is generated between the insulator 1 and the front end face 5D of the metallic shell 5. Sparking was induced at a frequency of 60 times per second for a measuring time of one minute by use of a full-transistor power supply.

Figure 8:
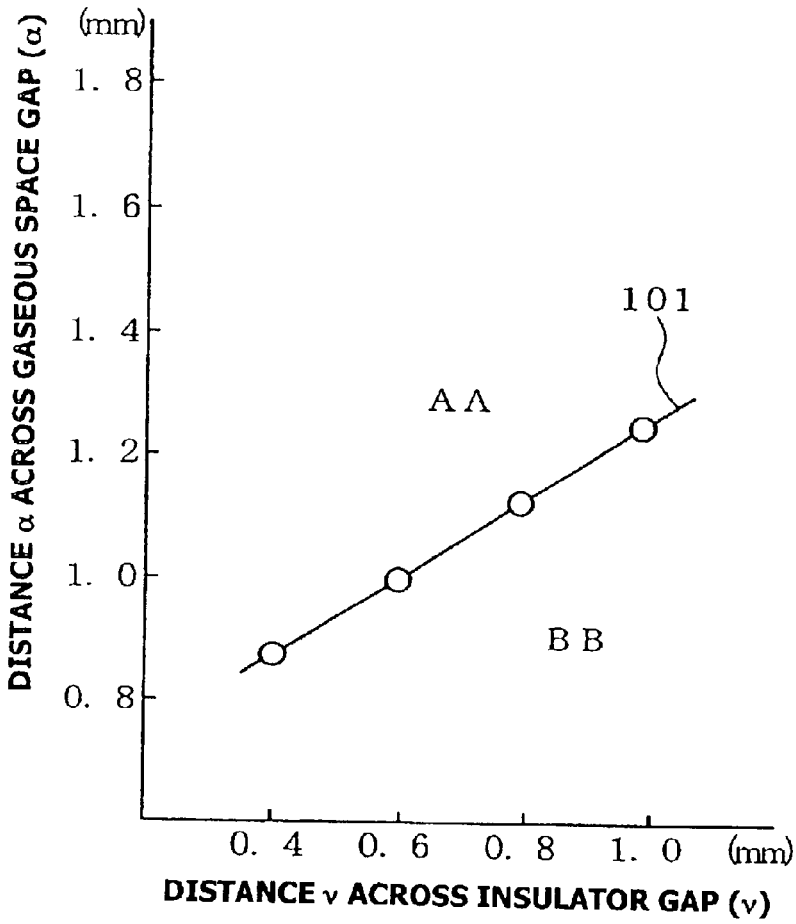
FIG. 8 is a graph with the vertical axis representing a distance $\alpha$ across an air gap ($\alpha$) and the horizontal axis representing a distance $\gamma$ across an insulator gap ($\gamma$), showing points at which sparking is initiated between the insulator 1 and a front end face 5D of a metallic shell 5.

The results are shown in FIG. 8. In FIG. 8, a straight line 101 shows a borderline of whether or not a spark is generated between the insulator 1 and the front end face 5D of the metallic shell 5. In domain AA located above the straight line, a spark was generated between the insulator 1 and the front end face 5D of the metallic shell 5, whereas, in lower domain BB, a spark was not generated. The straight line 101 is expressed by Expression (1) shown below, and serves as a borderline of whether or not a spark is generated between the insulator 1 and the front end face 5D of the metallic shell 5.

$$\alpha=0.4\times(\beta-\gamma)+\gamma \quad (1)$$

Therefore, in order to prevent sparking between the insulator 1 and the front end face 5D of the metallic shell 5, a condition expressed below by Expression (2) must be established.

$$\alpha\leqq 0.4\times(\beta-\gamma)+\gamma \quad (2)$$

Therefore, when the air gap (α) and the semi-creeping gap (β) satisfy the relationship "α<β," and the air gap (α) and the insulator gap (γ) satisfy the relationship "α>γ," establishment of the relationship "α≦0.4×(β−γ)+γ" among the air gap (α), the semi-creepage gap (β), and the insulator gap (γ) suppresses sparking between the insulator 1 and the front end face 5D of the metallic shell 5. When an ambient gas around a gap of a spark plug is flowing as in application to an actual internal combustion engine, sparking is more likely to occur between the insulator and the front end face of the metallic shell; thus, establishment of the relationship "α≦0.3×(β−γ)+γ" is more preferred.

(Experiment 8: Basis for Establishment of the Relationship "(α−γ)≦0.4 mm")

Various spark plugs were prepared under the following conditions: various parallel ground electrodes 11 were employed so as to establish various air gaps (α); and various pairs of semi-creeping discharge ground electrodes 12, each pair being of the same dimensions, were employed so as to establish various insulator gaps (γ). In order to evaluate channeling resistance of these spark plugs, Experiment 8 was carried out by use of a car having a 2500 cc, straight 6-cylinder, turbocharger-type internal combustion engine. The engine was operated continuously for 100 hours under the following conditions: shift lever at D range; 3500 rpm; and pressure in intake manifold +70 kPa. After the test operation, the spark plugs were measured for the depth of a channeling groove. The depth of a channeling groove was evaluated as follows: less than 0.2 mm: minor (○); 0.2–0.4 mm: medium (α); and in excess of 0.4 mm: serious (X). The results are shown in Table 6.

TABLE 6

| | α (mm) | | | | |
|---|---|---|---|---|---|
| γ (mm) | 0.7 | 0.8 | 0.9 | 1.0 | 1.1 |
| 0.5 | ○ | ○ | Δ | X | X |
| 0.6 | ○ | ○ | ○ | Δ | X |
| 0.7 | ○ | ○ | ○ | ○ | Δ |

As is apparent from Table 6, establishment of the relationship "(α−γ)≦0.4 mm" between the air gap (α) and the insulator gap (γ) reduces the amount of channeling. Satisfaction of the relationship can reduce the amount of channeling in an internal combustion engine involving severe channeling conditions such as an internal combustion engine with a supercharger or an internal combustion engine with high compression ratio.

(Experiment 9: Basis for Second Configuration (0.2 mm≦(α−γ)≦0.4 mm))

Various spark plugs were prepared under the following conditions: diameter of center electrode 2 2.5 mm; diametral difference (δ) between the insulator 1 and the metallic shell 5 as measured along the front end face 5D of the metallic shell 5 2.8 mm; two semi-creeping discharge ground electrodes 12; insulator gap (γ) 0.6 mm; semi-creepage gap (β) 1.6 mm; and the relationship between the air gap (α) and the insulator gap (γ) was set to various values. Experiment 9 on these spark plugs was carried out by use of a car having a 1800 cc, straight 4-cylinder, direct-injection-type internal combustion engine, under the following conditions: shift lever at D range; and idling at 600 rpm. Ignition timing of a spark plug was fixed to 150 BTDC. At each of selected (α−γ) values, there was measured the range of injection end timing in which the frequency of misfire per minute becomes substantially zero (stable combustion range). The results are shown in FIG. 9.

Figure 9:
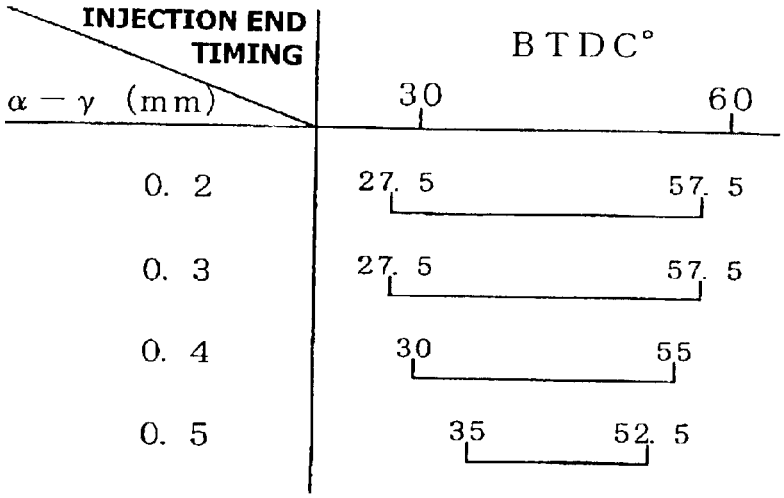
FIG. 9 is a graph showing the relationship between the range of injection end timing in which combustion is stabilized, and the difference ($\alpha-\gamma$) between the air gap ($\alpha$) and the insulator gap ($\gamma$)

As is apparent from FIG. 9, when the air gap (α) falls within a range of 0.8 mm to 1.0 mm, and the insulator gap (γ) falls within a range of 0.5 mm to 0.7 mm, satisfaction of the relationship "0.2 mm≦(α−γ)≦0.4 mm" can widen the range of injection end timing.

(Experiment 10: Basis for Employment of a Width of the Parallel Ground Electrode of Not Greater than 2.2 mm and Not Less than Two Times the Outside Diameter of the Center Electrode as Measured Along the Front End Face of the Center Electrode)

Figure 10:
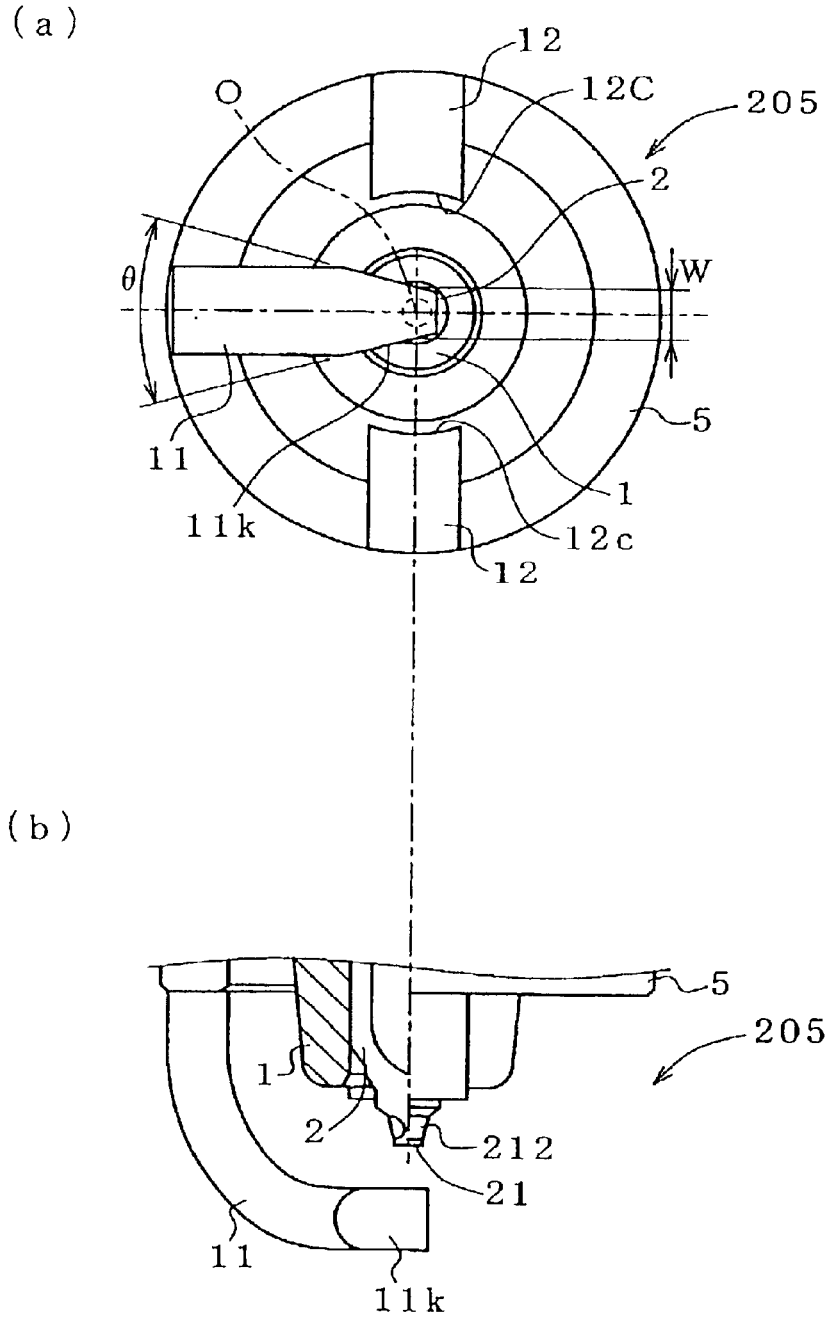
FIG. 10 is an enlarged partially sectional view showing electrodes and their peripheral portions of a spark plug according to a fifth embodiment of the first mode.

Various spark plugs were prepared under the following conditions: diameter of a trunk portion of the center electrode 2 located within the insulator 1 2.2 mm; outside diameter of a reduced-diameter portion of the center electrode 2 as measured along the front end surface of the portion, the front end surface being used to define the air gap (α), 0.6 mm; air gap (α) 1.1 mm; diametral difference (δ) between the insulator 1 and the metallic shell 5 as measured along the front end face 5D of the metallic shell 5 2.8 mm; two semi-creeping discharge ground electrodes 12; insulator gap (γ) 0.6 mm; semi-creepage gap (β) 1.6 mm; and the width W of the parallel ground electrode as viewed from an axially frontward side of the insulator 1 and measured across the center point of the center electrode was set to various values. A front end portion of the parallel ground electrode 11 was tapered as in the case of a spark plug 205 according to the fifth embodiment of the first mode shown in FIG. 10. The width W of the parallel ground electrode 11 as measured across a center point O was varied by varying the width of the entire parallel ground electrode 11 while the angle θ between taper edges 11*k* was held constant. Experiment 10 was carried out on these spark plugs by use of a car having a 2000 cc, straight 6-cylinder, direct-injection-type internal combustion engine, under the following conditions: shift lever at N range; and racing from idling at 600 rpm to 3000 rpm or higher through abrupt stepping on an accelerator. At each of selected values of the ratio between the width W and the outside diameter of the center electrode 2 as measured along the front end face of the center electrode 2, the maximum discharge voltage was measured. The results are shown in FIG. 11.

Figure 11:
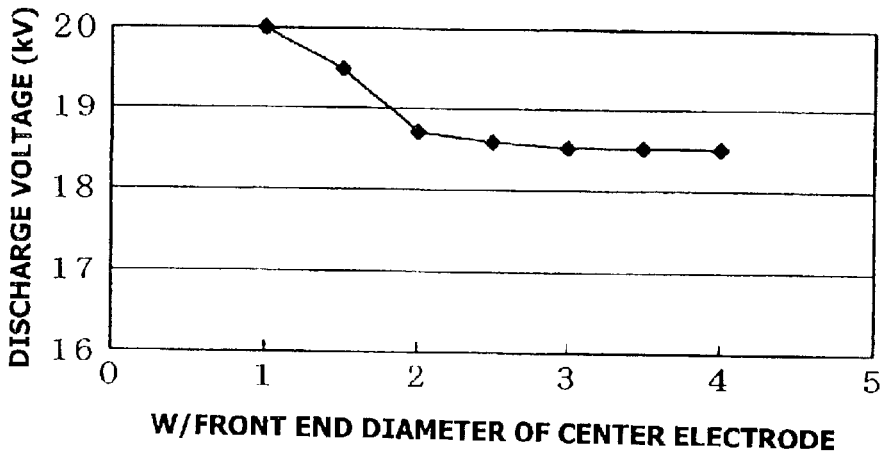
FIG. 11 is a graph showing the relationship between discharge voltage and the ratio between the front end diameter of a center electrode and the width W of a parallel ground electrode as measured across a position corresponding to the center point of the center electrode.

As is apparent from FIG. 11, when the air gap (α) falls within a range of 0.8 mm to 1.0 mm; the insulator gap (γ) falls within a range of 0.5 mm to 0.7 mm; and the air gap (α) and the insulator gap (γ) satisfy the relationship "0.2 mm≦(α−γ)≦0.4 mm," employment of a width of the parallel ground electrode of not less than two times the outside diameter of the center electrode as measured along the front end face of the center electrode sufficiently reduces discharge voltage associated with the parallel ground electrode, thereby suppressing unnecessarily frequent sparking from the semi-creeping discharge ground electrodes 12.

Figure 12:
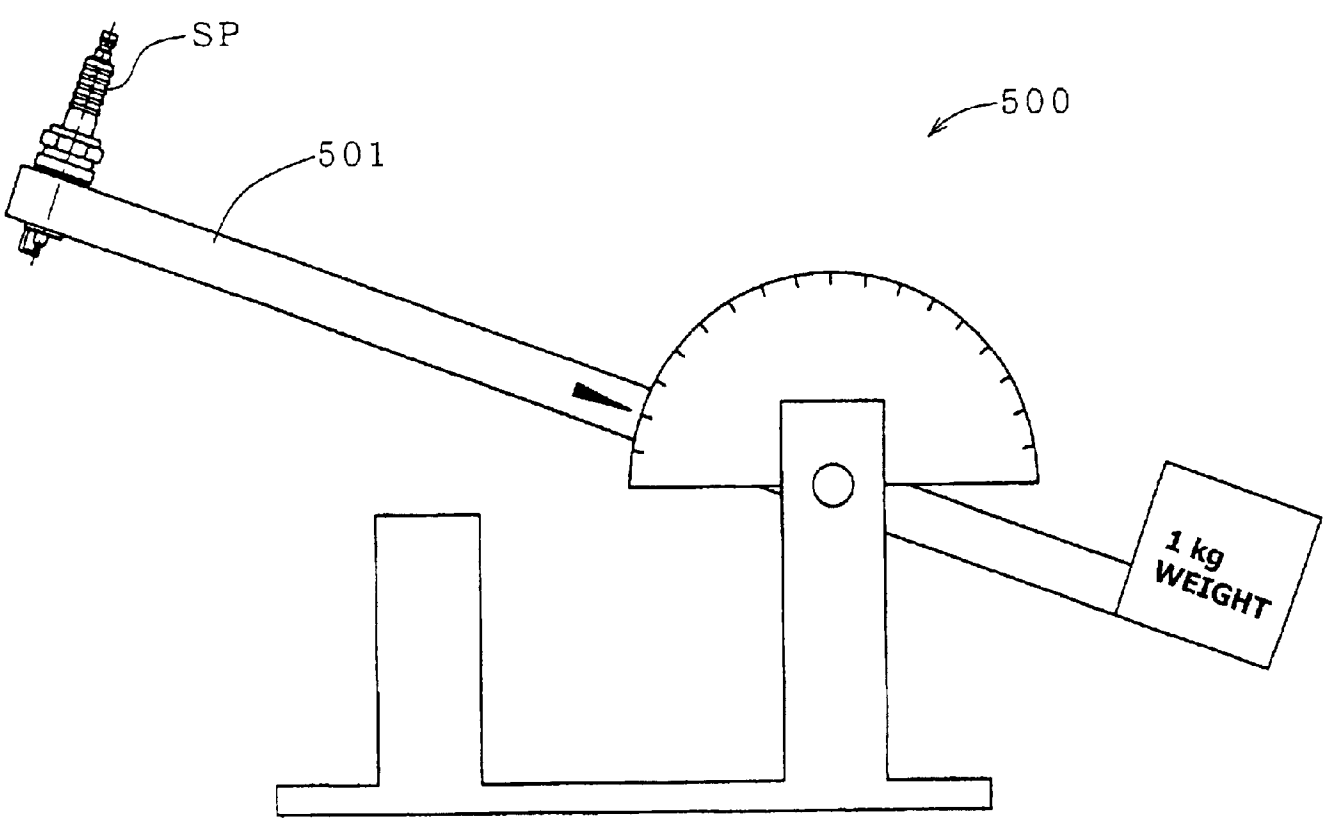
FIG. 12 is a schematic view showing a fuel bridge tester.

Next, a fuel bridge test was carried out. This test used water in place of gasoline, which is commonly used in an internal combustion engine, for the following reason. The touchstone is whether or not a fuel bridge formed across a spark discharge gap is breakable at very low temperature; i.e., at decreased viscosity. Since viscosity of water at room temperature is known to be substantially equivalent to viscosity of gasoline at about −40° C., water is the handiest substitute to be used for ensuring high breakableness of fuel bridge, attainment of which is a main object of the present invention. First, each sample SP was mounted on an arm 501 of a fuel bridge tester 500 as shown in FIG. 12. Then, about 0.05 ml of water was caused to adhere to a spark discharge gap by use of a syringe. Subsequently, the arm 501 was tilted by 30° and then allowed to fall free. This tilt-and-fall operation was repeated five times, and whether or not the bridge is broken was checked every fall. Three samples were tested for each electrode width. Each sample was not replenished with water until the end of the test.

Figures 13, 14:
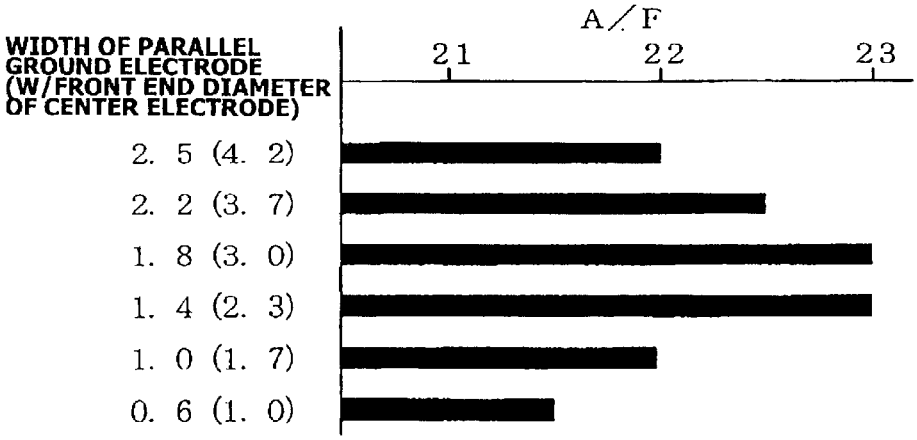
FIG. 13 is a table showing the results of a fuel bridge test.
FIG. 14 is a graph showing the relationship between ignition characteristics and the ratio between the front end diameter of the center electrode and the width W of the parallel ground electrode as measured across a position corresponding to the center point of the center electrode.

The test results are shown in FIG. 13. The mark ○ indicates that the bridge was broken, whereas the mark X indicates that the bridge was not broken. As is apparent from FIG. 13, when the air gap (α) falls within a range of 0.8 mm to 1.0 mm; the insulator gap (γ) falls within a range of 0.5 mm to 0.7 mm; and the air gap (α) and the insulator gap (γ) satisfy the relationship "0.2 mm≦(α−γ)≦0.4 mm," employment of a width of the parallel ground electrode of not greater than 2.2 mm sufficiently reduces occurrence of bridge.

Next, an ignition characteristics test was carried out by use of a car having a 2000 cc, 6-cylinder engine, under the following conditions: shift lever at D range; and running on the proving ground at 70 km/h (to simulate homogeneous lean burn). Under this engine operation condition, an A/F value as measured at 1% occurrence of misfire was judged as ignition limit. The results of this test are shown in FIG. 14. As is apparent from FIG. 14, when the air gap (α) falls within a range of 0.8 mm to 1.0 mm; the insulator gap (γ) falls within a range of 0.5 mm to 0.7 mm; and the air gap (α) and the insulator gap (γ) satisfy the relationship "0.2 mm≦(α−γ)≦0.4 mm," employment of a width of the parallel ground electrode of not greater than 2.2 mm sufficiently reduces occurrence of bridge.

The above-described test results reveal that, when the air gap (α) falls within a range of 0.8 mm to 1.0 mm; the insulator gap (γ) falls within a range of 0.5 mm to 0.7 mm; and the air gap (α) and the insulator gap (γ) satisfy the relationship "0.2 mm≦(α−γ)≦0.4 mm," employment of a width of the parallel ground electrode of not greater than 2.2 mm and not less than two times the outside diameter of the center electrode as measured along the front end face of the center electrode can sufficiently reduce discharge voltage associated with the parallel ground electrode without formation of fuel bridge, thereby providing excellent ignition characteristics.

(Experiment 11: Basis for Seventh Configuration (β≦1.1 mm, 0.5 mm≦γ≦0.7 mm, ψ≦1.8 mm))

Various spark plugs were prepared under the following conditions: diameter of a trunk portion of the center electrode 2 located within the insulator 1 2.2 mm; outside diameter of a reduced-diameter portion of the center electrode 2 as measured along the front end surface of the portion, the front end surface being used to define the air gap (α), 0.6 mm; air gap (α) 1.1 mm; diametral difference (δ) between the insulator 1 and the metallic shell 5 as measured along the front end face 5D of the metallic shell 5 2.8 mm; two semi-creeping discharge ground electrodes 12 having a width of 2.2 mm; insulator gap (γ) 0.6 mm; semi-creepage gap (β) 1.6 mm; and the difference ψ between the insulator front-end diameter φD and the width of the semi-creeping discharge ground electrode 12 was varied by varying the insulator front-end diameter φD. Experiment 11 was carried out on these spark plugs by use of a car set to conditions similar to those of Experiment 6, for measuring the range of stable combustion. The results are shown in FIG. 15.

Figure 15:
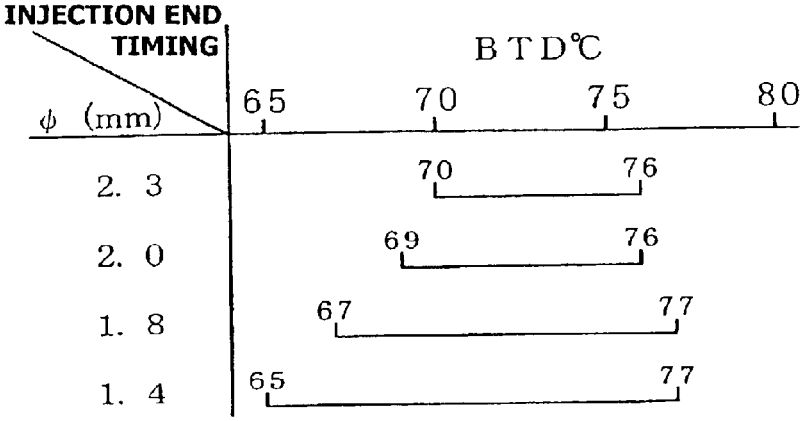
FIG. 15 is a graph showing the relationship between the range of injection end timing in which combustion is stabilized, and the difference $\psi$ between the front end diameter of the insulator and the width of the semi-creeping discharge ground electrode.

As is apparent from FIG. 15, employment of a not greater than 1.1 mm, γ falling within a range of 0.5 mm to 0.7 mm, and ψ not greater than 1.8 mm can widen the range of fuel injection end timing in which no misfire occurs (i.e., the range of stable combustion), thereby enhancing ignition characteristics in a fuel lean state. Conceivably, such a phenomenon arises for the following reason. An increase in the difference between the insulator front-end diameter and the width of the semi-creeping discharge ground electrode 12 causes a spark to considerably detour along the outer circumferential surface of a front end portion of the insulator 1 when sparking occurs between the semi-creeping discharge ground electrode 12 and the center electrode 2. When a spark is generated obliquely rearward from a rear corner portion of the end face of the semi-creeping discharge ground electrode 12, the spark hits against a front end portion of the insulator 1 and then reaches the center electrode 2. When the spark hits against a front end portion of the insulator 1, the spark creeps rearward along the outer circumferential surface of the insulator 1 and then changes directions to creep toward the circumferential side surface of the front end of the center electrode 1. Therefore, if the difference between the front-end diameter of the insulator 1 and the width of the semi-creeping discharge ground electrode 12 is large, there increases the amount of creepage of a spark when the spark creeps obliquely rearward along the outer circumferential surface of the insulator 1, with a resultant great rearward drag of the spark.

(Experiment 12: Basis for Additional Requirement 3 (the Minimum Bore Diameter (D3) of the Center Through-hole as Measured at a Front End Portion of the Insulator is Not Greater than 2.1 mm))

Figure 16:
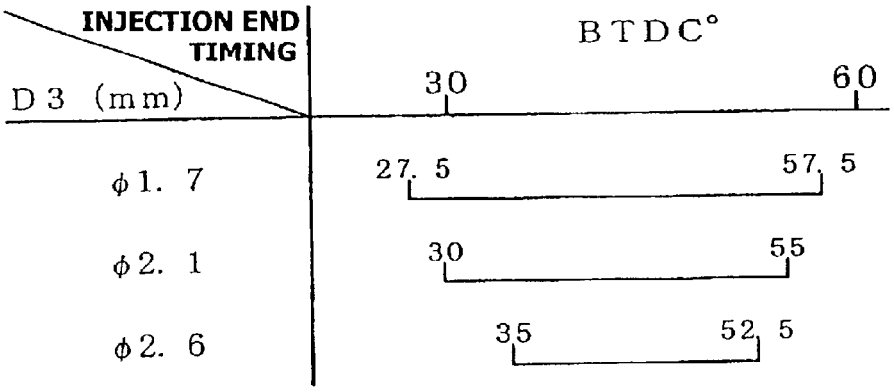
FIG. 16 is a graph showing the relationship between the range of injection end timing in which combustion is stabilized, and the minimum bore diameter (D3) of the center through-hole of the insulator as measured at a front end portion of the insulator located frontward of a retainment portion of the insulator, the retainment portion being engaged with and retained by the metallic shell.

Various spark plugs were prepared under the following conditions: diametral difference (b) between the insulator 1 and the metallic shell 5 as measured along the front end face 5D of the metallic shell 5 2.8 mm; air gap (α) 1.1 mm; two semi-creeping discharge ground electrodes 12; insulator gap (γ) 0.6 mm; semi-creepage gap (β) 1.6 mm; and the minimum bore diameter (D3) of the center through-hole as measured at a front end portion of the insulator 1 located frontward of the retainment portion 51 of the metallic shell 5 was set to various values. The outside diameter of the center electrode 2 was varied according to the bore diameter of the center through-hole. As in the case of Experiment 1, Experiment 12 was carried out on these spark plugs by use of a car having a 1800 cc, straight 4-cylinder, direct-injection-type internal combustion engine, under the following conditions: shift lever at D range; and idling at 600 rpm. Ignition timing of a spark plug was fixed to 150 BTDC. At each of selected D3 values, there was measured the range of injection end timing in which the frequency of misfire per minute becomes substantially zero (the range of stable combustion). The results are shown in FIG. 16. As is apparent from FIG. 16, employment of a minimum bore diameter of the center through-hole of the insulator 1 of not greater than 2.1 mm can widen the range of stable combustion in the course of idling operation.

The above-described spark plugs were subjected to a predelivery fouling test. Test conditions were as follows. The test was conducted using a car having a 6-cylinder direct-injection-type internal combustion engine of a piston displacement of 3000 cc, and the spark plugs were mounted on the engine. The car was placed in a low-temperature test room maintained at a temperature of −10° C. In the test room, the car was operated in cycles each consisting of a predetermined operation pattern which is specified in the low-load adaptability test section of JIS D 1606 and in which inching is performed several times at low speed. The number of cycles until 10 MΩ was reached was measured. The results are shown in Table 7.

TABLE 7

| Minimum diameter of center through-hole (mm) | Cycles until 10 MΩ is reached | Judgment |
|---|---|---|
| 2.6 | 5 | X |
| 2.1 | 11 | ○ |
| 1.9 | 13 | ○ |
| 1.7 | 15 | ○ |

As is apparent from Table 7, when the minimum diameter of the center through-hole of the insulator 1 is reduced to 2.1 mm or less, problems hardly occur in the predelivery fouling test, and 10 or more cycles can be performed before reaching 10 MΩ.

Figure 17:
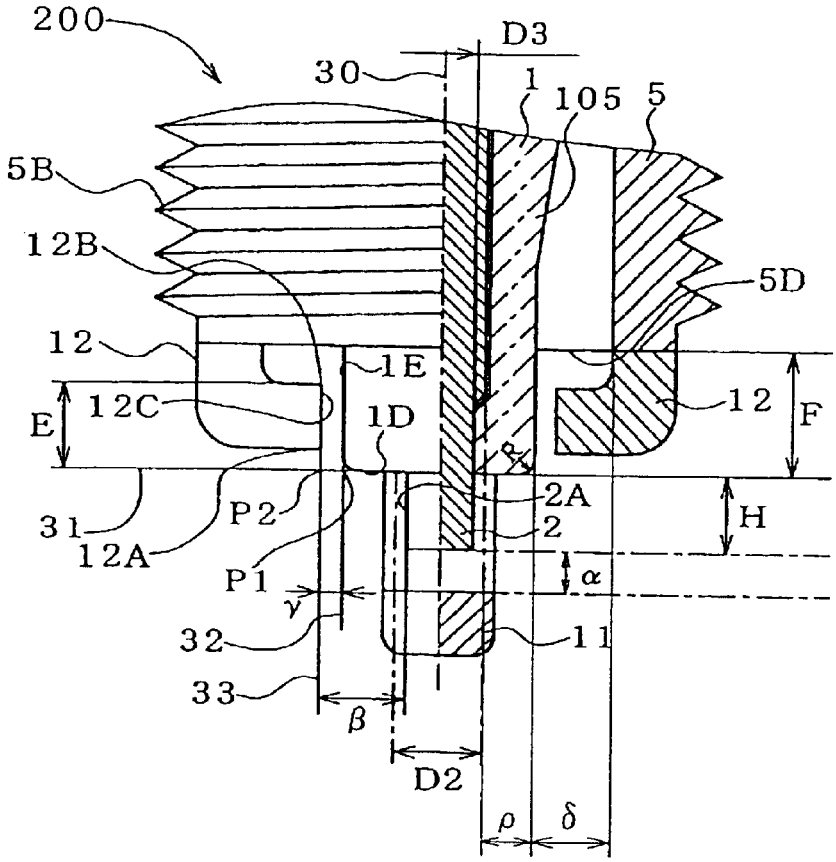
FIG. 17 is an enlarged partially sectional view showing electrodes and their peripheral portions of a spark plug according to a second mode of the present invention.

The above-described two kinds of evaluation results reveal that employment of a minimum bore diameter (D3) of the center through-hole as measured at a front end portion of the insulator 1 located frontward of the retainment portion 51 of not greater than 2.1 mm can widen the range of stable combustion even in a direct-injection-type internal combustion engine, and becomes unlikely to cause problems in the predelivery fouling test. Reduction of the bore diameter of the insulator 1 allows reduction of the outside diameter of the center electrode 2. Thus, heat received by a front end portion of the insulator 1 in the course of a combustion cycle encounters some difficulty in being relapsed toward the center electrode 2, thereby facilitating increase of the front end temperature of the insulator 1. Therefore, even in a direct-injection-type internal combustion engine, which encounters difficulty in raising the front end temperature of the insulator 1 during regular operation, there can be facilitated increase of the front end temperature of the insulator 1, thereby facilitating burning out of carbon which has been deposited through "carbon fouling." This prevents generation of a spark between the insulator 1 and the front end face 5D of the metallic shell 5 and generation of a spark in the vicinity of the retainment portion. Thus, even in application to a direct-injection-type internal combustion engine, the range of stable combustion can be widened. Similar test results were also obtained from a test on a spark plug 200 according to a second mode of the present invention shown in FIG. 17. The spark plug 200 differs from the first mode only in that the diameter of a front end portion of the center electrode 2 is reduced.

Other modes of the present invention will next be described with reference to the drawings. The modes to be described below are similar to the above-described mode except for the shape of the insulator 1, the metallic shell 5, and the center electrode 2. Thus, only different features will be described, while redundant description of similar features is omitted. The following description refers to the enlarged partially sectional views of FIGS. 18–22 showing a front end portion of the center electrode 2, the parallel ground electrode 11, the semi-creeping discharge ground electrodes 12, and a front end portion of a metallic shell 5'.

Figure 18:
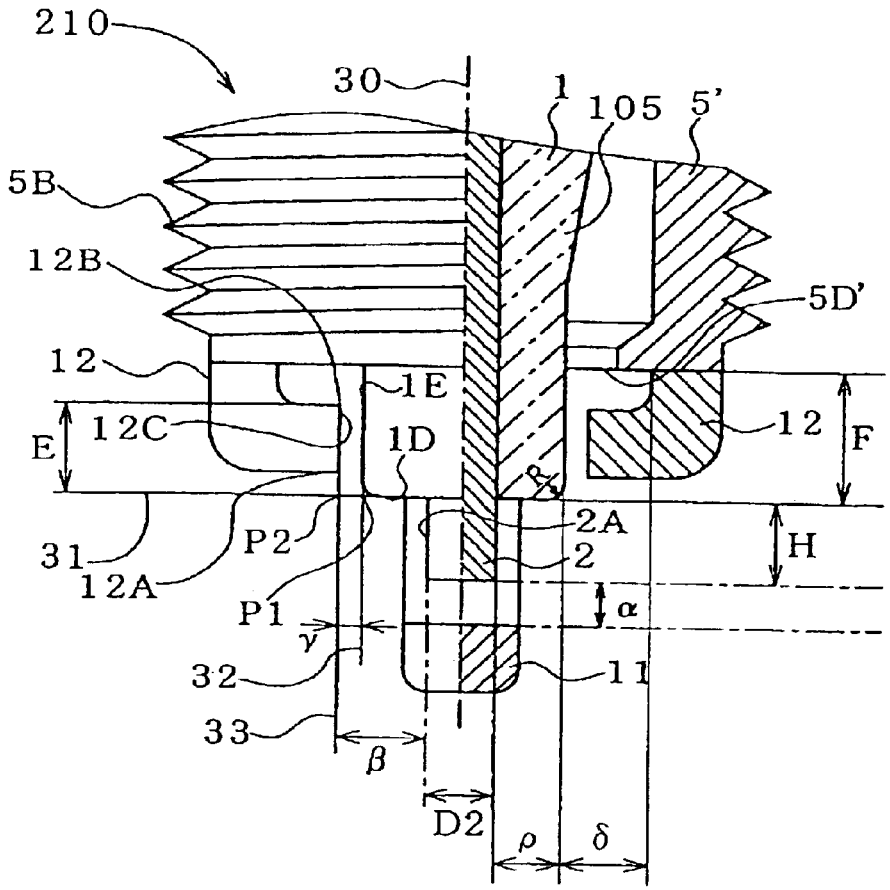
FIG. 18 is an enlarged partially sectional view showing electrodes and their peripheral portions of a spark plug according to a third mode of the present invention.

A spark plug 210 according to a third mode of the present invention shown in FIG. 18 is configured such that the inside diameter of a front end portion of a metallic shell 5' is reduced to thereby increase the area of a front end face 5D'. Impartment of such a shape to a front end portion of the metallic shell 5' suppresses entry of fuel into the interior of the metallic shell 5'. In a direct-injection-type internal combustion engine, since a fuel injection nozzle is directed toward a piston, fuel hits against the piston and springs back to approach a spark plug from a position obliquely forward of the spark plug while being influenced by tumble and squish. Fuel which reaches the spark plug at this angle is likely to enter the interior of a metallic shell. According to the present mode, the inside diameter of a front end portion of the metallic shell 5' is reduced, thereby facilitating suppression of entry of fuel into the interior of the metallic shell 5'. Since the area of a front end face 5D' increases, welding of a ground electrode is facilitated, and the thickness of a ground electrode can be increase, for a spark plug having a plurality of ground electrodes as in the case of the present invention. Further, since an internal space located frontward of a retainment portion 51' of the metallic shell 5' can be increased, potential occurrence of sparking in the vicinity of the retainment portion 51' can be suppressed. When the inside diameter of a front end portion of the metallic shell 5' is to be reduced, the inside diameter of the diameter-reduced portion may be determined such that the diametral difference 6 in relation to the insulator 1 and the air gap (α) satisfy the relationship "$\delta \leqq 2.6 \times \alpha$."

Figure 19:
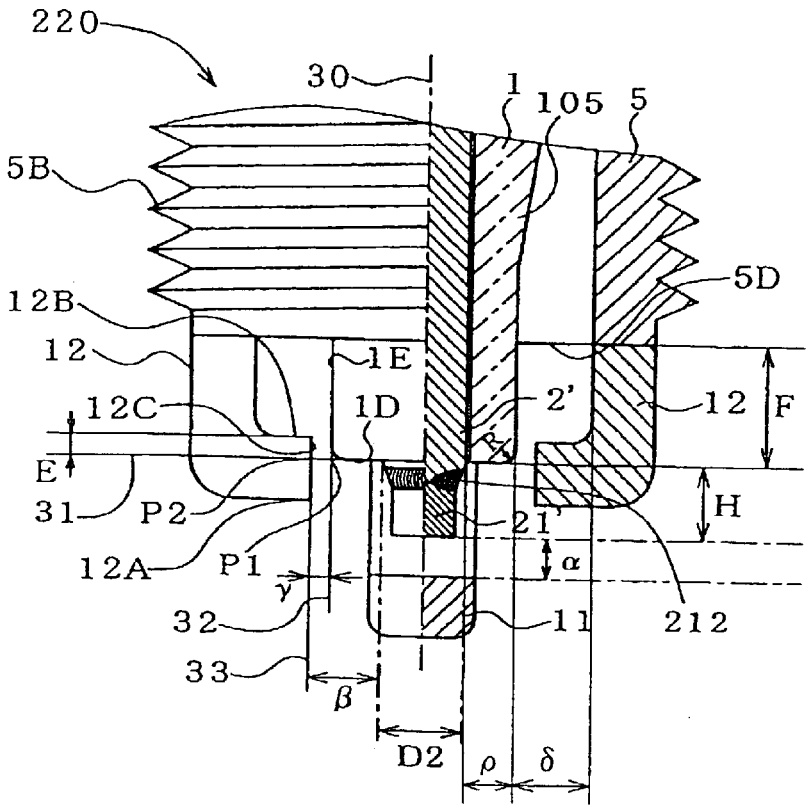
FIG. 19 is an enlarged partially sectional view showing electrodes and their peripheral portions of a spark plug according to a fourth mode of the present invention.

A spark plug 220 according to a fourth mode of the present invention shown in FIG. 19 is configured such that a front end portion of an electrode base material of a center electrode 2' located frontward of the front end face 1D of the insulator 1 is reduced in diameter, and a noble metal chip 21' is joined to the end of the front end portion through laser beam welding along the entire circumference. The semi-creeping discharge ground electrodes 12 are disposed such that the first extension line 31 formed through outward extension of a line indicative of the front end face 1D of the insulator 1 hits against the end faces 12C of the semi-creeping discharge ground electrodes 12. In the present mode, for example, the center-electrode base material has a diameter of 1.8 mm, and an Ir-5% by mass Pt chip having a diameter of 0.8 mm is joined to the end of the center-electrode base material. According to the present mode, the distance β across the semi-creepage gap (β) is a distance as measured along a direction perpendicular to the axis of the spark plug between the end face of the semi-creeping discharge ground electrode 12 and an outer circumferential surface of the center electrode 2 corresponding to the position of the front end face 1D of the insulator 1; i.e., an outer circumferential surface of the center electrode 2 located rearward of a starting position of reducing the diameter of the center-electrode base material.

Figure 20:
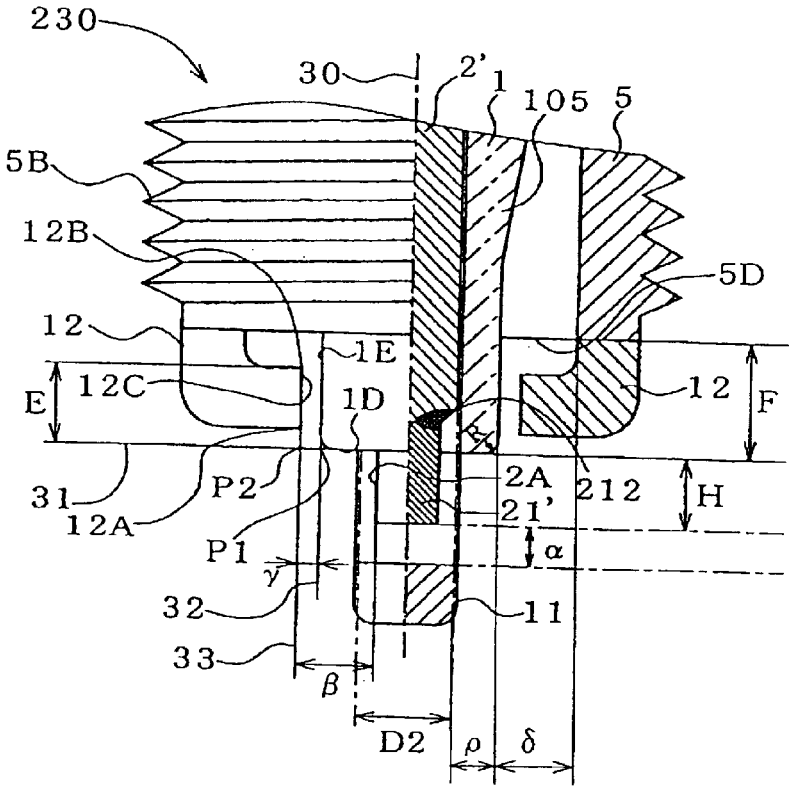
FIG. 20 is an enlarged partially sectional view showing electrodes and their peripheral portions of a spark plug according to a fifth mode of the present invention.

A spark plug 230 according to a fifth mode of the present invention shown in FIG. 20 is configured such that a front end portion of an electrode base material of the center electrode 2' is reduced in diameter, and the noble metal chip 21' is joined to the end of the front end portion through laser beam welding along the entire circumference.

Figure 21:
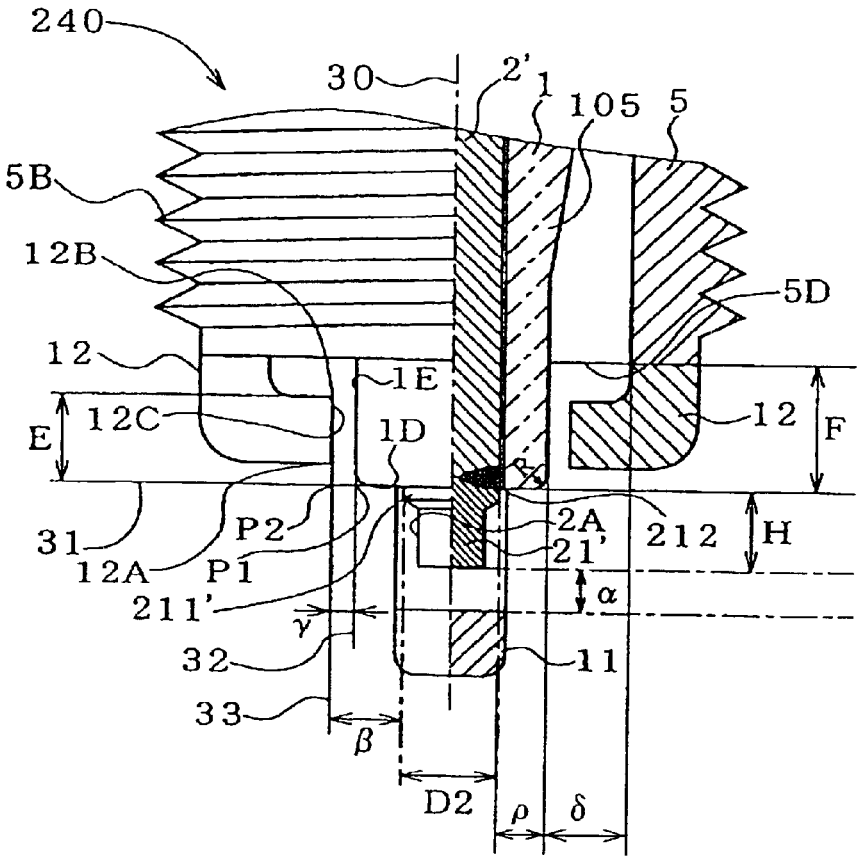
FIG. 21 is an enlarged partially sectional view showing electrodes and their peripheral portions of a spark plug according to a sixth mode of the present invention.

A spark plug 240 according to a sixth mode of the present invention shown in FIG. 21 is configured such that the diameter of a front end portion of an electrode base material of the center electrode 2' is not reduced, and a noble metal chip 21' having a substantially T-shaped cross section is joined to the end of the front end portion through laser beam welding along the entire circumference. The front end of a laser beam weld zone 212 is substantially aligned with the front end face 1D of the insulator 1. In the present mode, for example, the center-electrode base material has a diameter of 1.8 mm, and an Ir-20% by mass Rh chip whose front end portion has a diameter of 0.6 mm and whose diametrally enlarged portion 211' has a diameter of 1.8 mm is joined to the end of the center-electrode base material. The center through-hole of the insulator 1 has a bore diameter of 1.9 mm. According to the present mode, the distance β across the semi-creepage gap (β) is a distance as measured along a direction perpendicular to the axis of the spark plug between the end face of the semi-creeping discharge ground electrode 12 and an outer circumferential surface of the center electrode 2 corresponding to the position of the front end face 1D of the insulator 1; i.e., an outer circumferential surface of the diametrally enlarged portion 211' of the noble metal chip 21'. This configuration can prevent dropping off of the noble metal chip 21' from the center-electrode base material even when sparking arises across the semi-creepage gap (β). In the event of sparking across the semi-creepage gap (β), a spark is generated between the side surface of the noble metal chip 21' and the semi-creeping discharge ground electrode 12. Even when frequent occurrence of such sparking causes ablation of a portion of the noble metal chip 21' in the vicinity of the front end face 1D of the insulator 1, the ablated portion does not become thinner than a front end portion of the noble metal chip 21', thereby preventing dropping off of the front end portion of the noble metal chip 21'. Since the diameter of a front end portion of the noble metal chip 21' is small, discharge voltage associated with sparking across the air gap (α) can be decreased, thereby enhancing ignition characteristics. Particularly, in application to a direct-injection-type internal combustion engine, the range of stable combustion can be widened.

Figure 22:
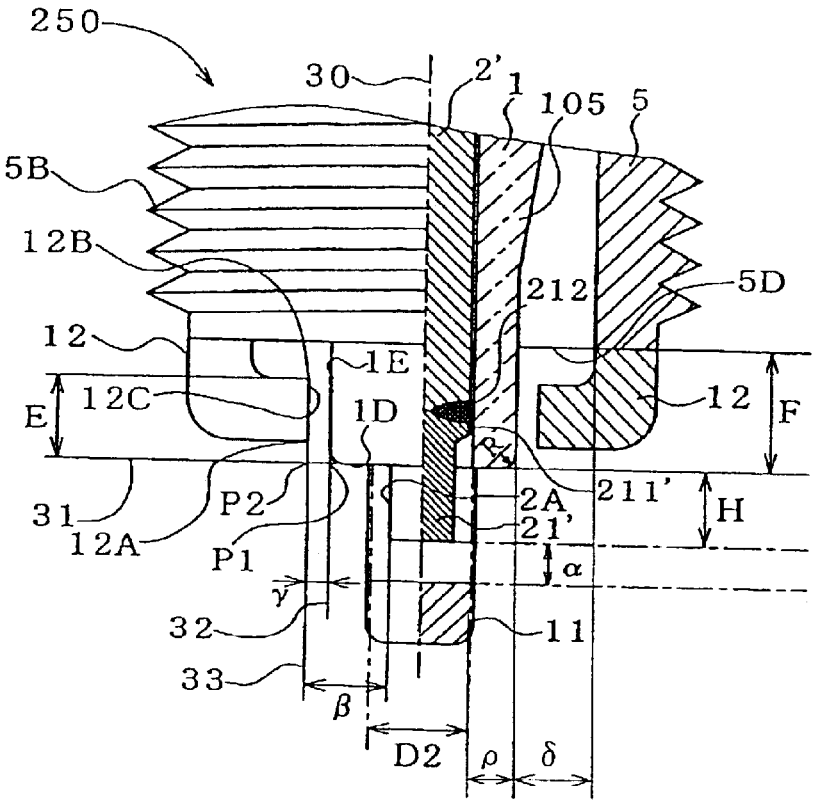
FIG. 22 is an enlarged partially sectional view showing electrodes and their peripheral portions of a spark plug according to a seventh mode of the present invention.

A spark plug according to a seventh mode of the present invention shown in FIG. 22 is configured such that the diameter of a front end portion of an electrode base material of the center electrode 2' is not reduced, and the noble metal chip 21' having a substantially T-shaped cross section is joined to the end of the front end portion through laser beam welding along the entire circumference. In the present mode, the diametrally enlarged portion 211' of the noble metal chip 21' is retracted inward from the front end portion 1D of the insulator 1. In the present mode, for example, the center-electrode base material has a diameter of 1.8 mm, and an Ir-20% by mass Rh chip whose front end portion has a diameter of 0.6 mm and whose diametrally enlarged portion 211' has a diameter of 1.8 mm is joined to the end of the center-electrode base material. Since the center through-hole of the insulator 1 has a bore diameter of 1.9 mm, the diametral difference between the bore diameter of the center through-hole of the insulator 1 and the outside diameter of the noble metal chip 21' is 0.1 mm. According to the present mode, the distance β across the semi-creepage gap (β) is a distance between the end face of the semi-creeping discharge ground electrode 12 and an outer circumferential surface of the center electrode 2 corresponding to the position of the front end face 1D of the insulator 1; i.e., an outer circumferential surface of a diametrally reduced portion of the noble metal chip 21'.

When a spark is generated across the semi-creepage gap (i), the spark creeps along the front end face 1D of the insulator 1 and then along the inner wall of the center through-hole of the insulator 1, and then reaches the diametrally enlarged portion 211' of the noble metal chip 21'. Therefore, even though the diametrally enlarged portion 211' is located within the center through-hole of the insulator 1, a spark is generated between the diametrally enlarged portion 211' and the semi-creeping discharge ground electrode 12, thereby preventing dropping off of a front end portion of the noble metal chip 21'. Since the diameter of a front end portion of the noble metal chip 21' is small, discharge voltage associated with sparking across the air gap (α) can be decreased, thereby enhancing ignition characteristics. Particularly, in application to a direct-injection-type internal combustion engine, the range of stable combustion can be widened. Since the minimum diametral difference between the outside diameter of the noble metal chip 21' and the bore diameter of the center through-hole of the insulator 1 and is 0.1 mm, ablation of the base material of the center electrode 2', the ablation potentially being induced by spark discharge, can be readily suppressed, conceivably for the following reason. When a spark is generated across the semi-creepage gap (β), the spark creeps along the inner wall of the center through-hole of the insulator 1. At this time, if the diametral difference between the outside diameter of the noble metal chip 21' and the bore diameter of the center through-hole of the insulator 1 is large, the spark may not head for the noble metal chip 21', but may creep deep into the center through-hole up to the base material of the center electrode 2'. The base material of the center electrode 2' is lower in spark ablation resistance than the noble metal chip 21', and thus is prone to quick ablation, potentially resulting in dropping off of the chip. Therefore, reduction of the diametral difference suppresses a phenomenon that a spark reaches the base material of the center electrode 2', thereby enhancing durability.

Figure 30:
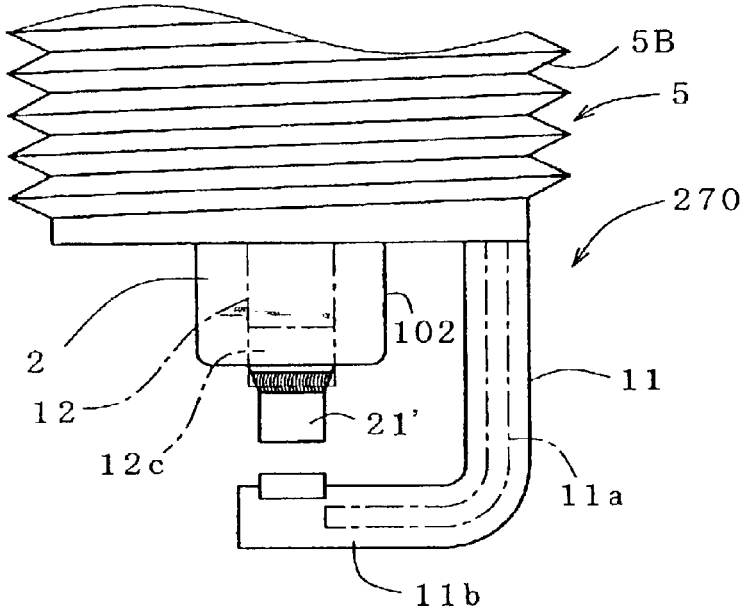
FIG. 30 is a side view showing an essential portion of an example spark plug in which a noble metal chip is joined to the parallel ground electrode.

As shown in FIG. 30, a noble metal chip 50 may be welded to the parallel ground electrode 11 in such a manner as to face an air gap. A spark plug 270 of FIG. 30 is formed through provision of the noble metal chip 50 on the parallel ground electrode 11 of the spark plug 220 of FIG. 9. A material for the noble metal chip 50 may be similar to that for the noble metal chip 21' provided on the parallel ground electrode 11. When a spark plug is used at such voltage polarity that the polarity of the center electrode 2 becomes negative, spark ablation associated with the parallel ground electrode 11 is slightly gentle as compared with that associated with the center electrode 2. Therefore, the melting point of the noble metal chip 50 can be lower than that used with the center electrode 2 (e.g., when the noble metal chip 21' used with the center electrode 2 is of an iridium alloy, the noble metal chip 50 used with the parallel ground electrode 11 can be of platinum or a platinum alloy).

The parallel ground electrode 11 and the semi-creeping discharge ground electrode 12 can use nickel or a nickel alloy as a base material, which serves as a surface layer portion thereof. In this case, the electrodes 11 and 12 may use different base materials. Specifically, the base material of the parallel ground electrode 11 may be a first nickel-type base metal containing a predominant amount of nickel, whereas the base material of the semi-creeping discharge ground electrode 12 can be a second nickel-type base metal containing a predominant amount of nickel.

For example, in FIG. 30 (the form of the semi-creeping discharge ground electrode is similar to that of FIG. 2 or FIG. 19; reference numerals are cited from FIGS. 2 and 19), a noble metal chip is not welded to the end face 12C of the semi-creeping discharge ground electrode 12, and an entire end face portion of the semi-creeping discharge ground electrode 12 is formed of the second nickel-type base metal, whereas an at least surface layer portion 11*b* of the parallel ground electrode 11 is formed of the first nickel-type base metal, and the noble metal chip 50 is welded to a face of the parallel ground electrode 11 that faces the center electrode 2. In this case, the nickel content of the first nickel-type base metal can be lower than that of the second nickel-type base metal. Since the noble metal chip 50 is welded to the parallel ground electrode 11, a spark ablation problem does not arise seriously in relation to the base material of the parallel ground electrode 11. Since the semi-creeping discharge ground electrode 12 is lower in sparking frequency than the parallel ground electrode 11, no noble metal chip is welded to the semi-creeping discharge ground electrode 12 for reduction of cost. Further, since the base material surface of the semi-creeping discharge ground electrode 12 serves as discharge surface, the nickel content thereof is increased so as to suppress spark ablation. In this case, preferably, the nickel content of the second nickel-type base metal is not lower than 85% by mass. For example, the first nickel-type base metal may be INCONEL 600 (trade name), whereas the second nickel-type base metal may be a 95% by mass nickel alloy (balance: chromium, manganese, silicon, aluminum, iron, etc.).

(Other Modes)

The above-described modes employ two semi-creeping discharge ground electrodes 12. However, a single semi-creeping discharge ground electrode 12 may be employed. Alternatively, three or more semi-creeping discharge ground electrodes 12 may be employed. However, employment of a single semi-creeping discharge ground electrode 12 encounters difficulty in burning out carbon along the entire circumference of the end face of the insulator 1 by use of sparks, resulting in impaired spark-utilized cleaning property. Therefore, employment of two to four semi-creeping discharge ground electrodes 12 is preferred. Many of the above modes are described while mentioning the semi-creeping discharge ground electrodes 12 that are disposed such that the entire end faces 12C thereof face the straight tubular portion 102 of the insulator 1. However, the semi-creeping discharge ground electrodes 12 may be disposed such that the first extension line 31 formed through outward extension of a line indicative of the front end face 1D of the insulator 1 hits against the end faces 12C of the semi-creeping discharge ground electrodes 12. The above-described spark plugs are configured such that the diameter of the center electrode is not reduced (i.e., so-called "thermo-type" is not employed for the center electrode) within a front end portion of the insulator 1. However, the diameter of the center electrode may be reduced once or two times.

Figure 23:
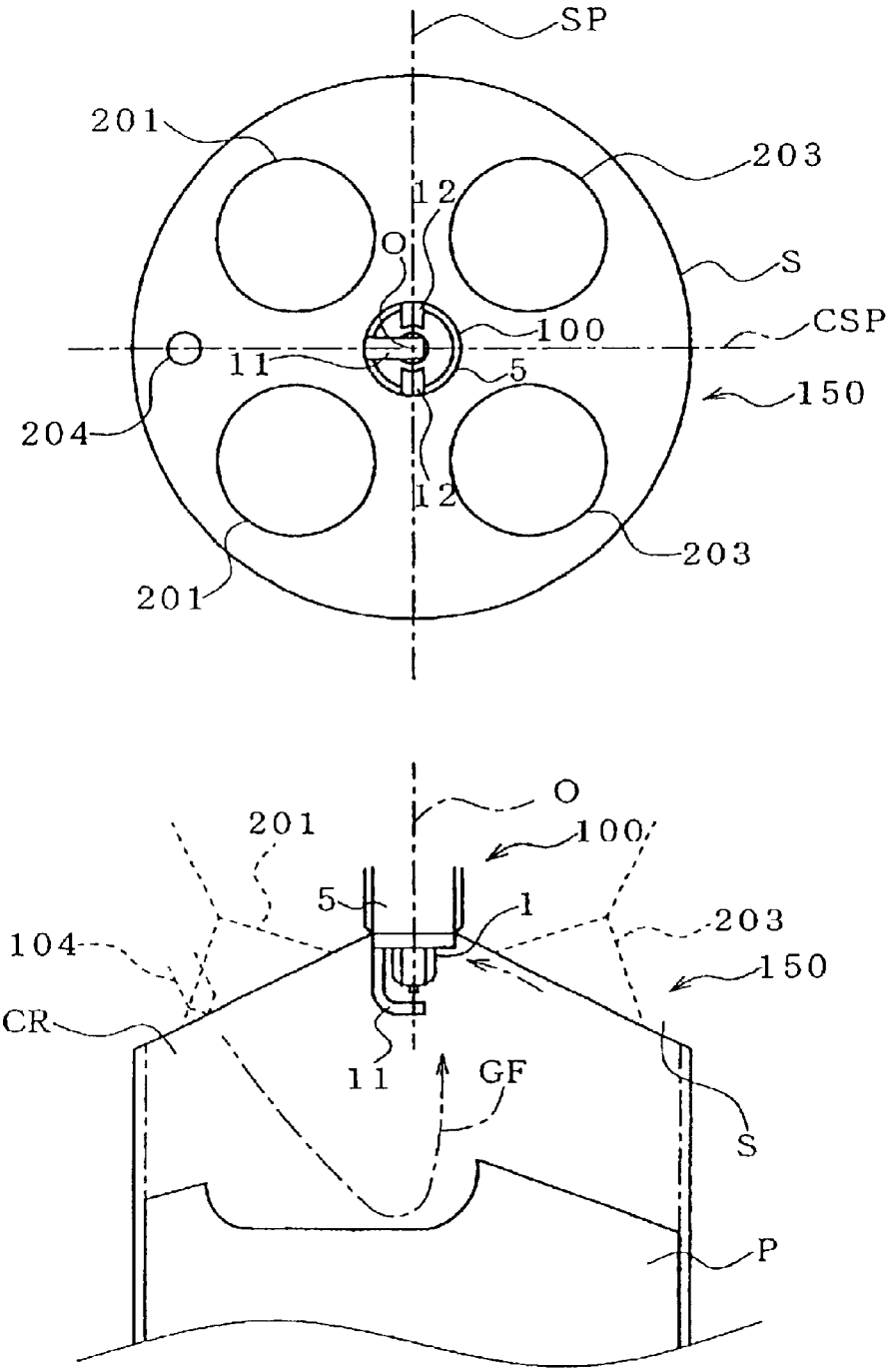
FIG. 23 is an explanatory view showing an example form of attachment of a spark plug to a direct-injection-type engine.
Figure 29:
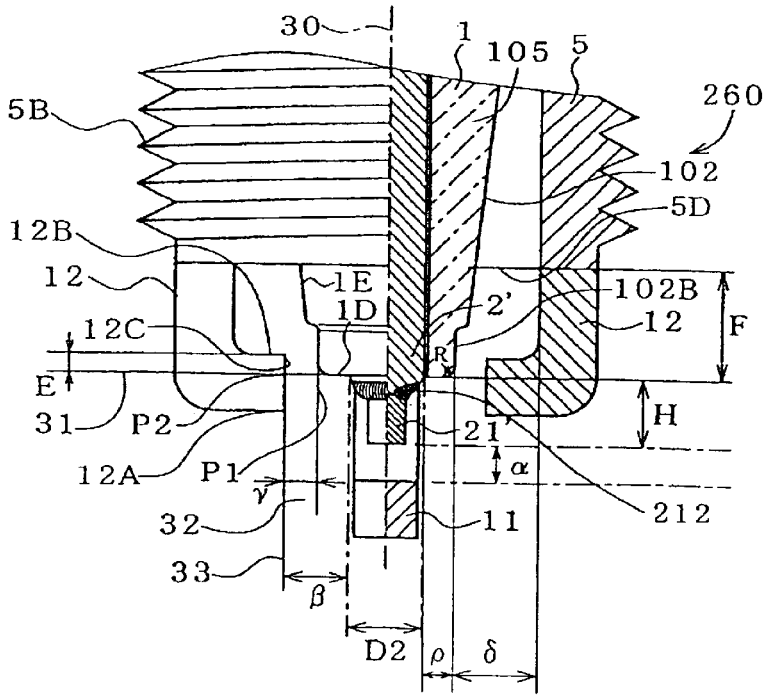
FIG. 29 is a partially sectional front view showing an essential portion of an example spark plug whose insulator has a stepped straight tubular portion.

In a spark plug 260 of FIG. 29, a straight tubular portion 102B is formed via a steplike diametrally reduced portion. In the spark plug 100 or 260 shown in FIG. 23 or FIG. 29, a front end portion of the insulator 1 is formed into the straight tubular portion 102 or 102B. The straight tubular portion 102 or 102B has a length of 0.5–1.5 mm as measured along the axis 30. In these configurations, a tapered bulge portion 105 as shown in FIG. 31(*c*) or a steplike bulge portion 102A as shown in FIG. 31(*a*) is formed rearward of and adjacent to the straight tubular portion 102 or 102B.

If the above-described bulge portion is too close to the rear edge 12B of the end face 12C of the semi-creeping discharge ground electrode 12, a spark from the rear edge 12B tends to be dragged rearward. For example, in FIG. 32(*a*), electric field tends to be concentrated on a radiused transitional part 102T of the steplike bulge portion 102A. A spark SP3 discharged from the rear edge 12B of the semi-creeping discharge ground electrode 12 is directed toward the transitional part 102T, and thus is dragged rearward; as a result, the spark SP3 considerably detours backward along the circumferential side surface of the insulator 1. Needless to say, such sparking impairs ignition characteristics.

Figure 31:
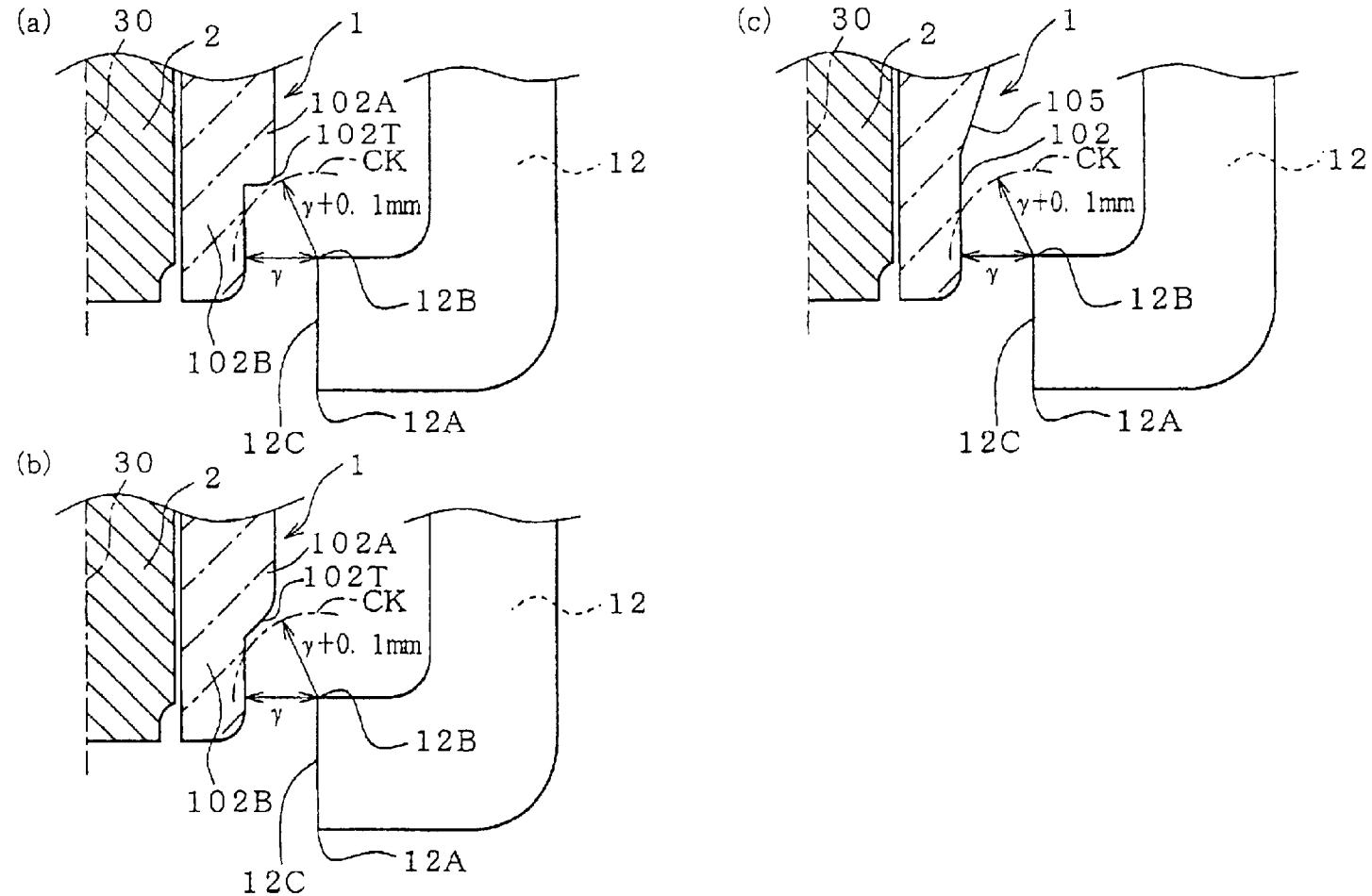
FIG. 31 is a series of views showing various typical relationships between a straight tubular portion of the insulator and a semi-creepage gap.
Figure 32:
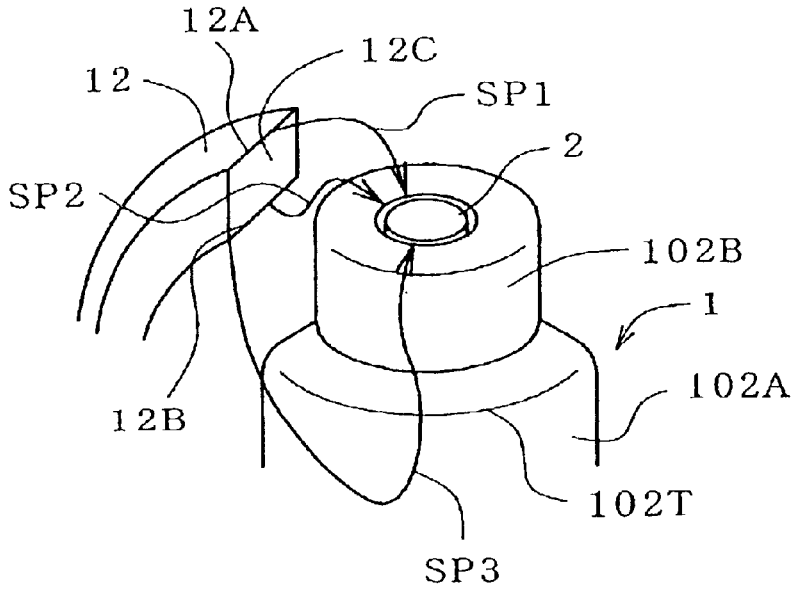
FIG. 32 is a series of explanatory views showing the relationship between various sparking forms and the shape of an end face, in the semi-creeping discharge ground electrode.
Figure 32:
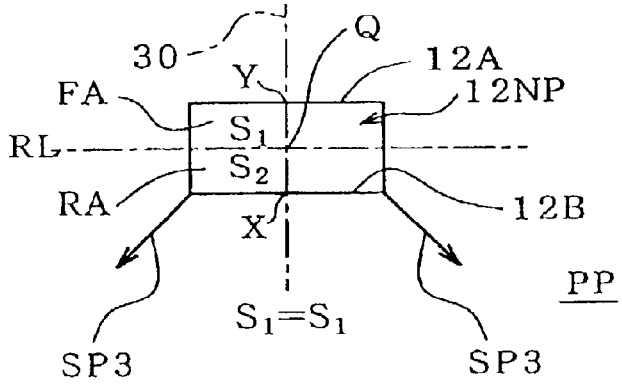
Figure 32:
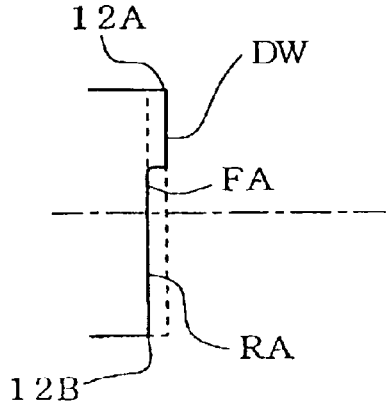

In order to cope with the problem, as shown in FIG. 31, on a virtual plane including the axis 30 of the insulator 2 and a midpoint of the rear edge 12B, as viewed along the axial direction of the insulator 2, of the end face 12C of the semi-creeping discharge ground electrode 12, the bulge portion 102A is located entirely outside a circle Ck with a center thereof at the midpoint of the rear edge 12A and a radius of ($\gamma$+0.1) mm, where $\gamma$ (unit: mm) is a distance across the semi-creepage gap, thereby effectively preventing dragging of spark such as SP3 in FIG. 32. As shown in FIG. 31(*b*), when the transitional part 102T of the bulge portion 102A assumes the form of an inclined surface along the circle Ck, as compared with a form such that the transitional part 102T rises perpendicularly from the outer circumferential surface of the straight tubular portion 102B as shown in FIG. 31(*a*), the length of the straight tubular portion 102B can be reduced, and the inclined transitional part 102T is unlikely to involve a small-angled edge portion, which is prone to concentration of electric field, thereby more effectively preventing dragging of spark.

In order to confirm the above-described effects, the following experiment was carried out.

(Experiment 13)

Various spark plugs of FIG. 3 were prepared according to the following types: type A: the straight tubular portion 102 of the insulator 1 assumes the form of FIG. 31(*c*); and type B: the straight tubular portion 102 of the insulator 1 assumes the form of FIG. 31(*a*), as well as under the following conditions: the parallel ground electrode 11 was removed; two semi-creeping discharge ground electrodes 12; insulator gap ($\gamma$) 0.6 mm; semi-creepage gap ($\beta$) 1.6 mm; level difference E between the front end face 1D of the insulator 1 and the rear edge 12B of the end face 12C of the semi-creeping discharge ground electrode 12 0.9 mm; and the length of the straight tubular portion (102 or 102B) was set to various values ranging from 0.9 mm to 1.8 mm shown in Table 8. In Table 8, the mark "*" indicates that the bulge portion 105 or 102A overlaps with the above-mentioned circle with a radius of ($\gamma$+0.1) mm, and the mark "○○" indicates the bulge portion 105 or 102A is located outside the circle. Experiment 13 was carried out on these spark plugs in the following manner. Each of the spark plugs was attached to a chamber; the interior of the chamber was pressurized to 0.6 MPa; and sparking was induced at a frequency of one time per second for one minute by use of a full-transistor power supply. The sparking condition was shot by use of a video camera. The image was analyzed to obtain the maximum length L of a spark which was generated from the rear edge 12B of the end face 12C of the semi-creeping discharge ground electrode 12 and dragged rearward along the direction of the axis 30. The criteria of evaluation are as follows: good (○): length L not longer than 2.5 mm; defective (X): length L longer than 2.5 mm. The results are shown in Table 8.

TABLE 8

| Type | Length of straight tubular portion (mm) | Position of bulge portion | Evaluation |
|---|---|---|---|
| A | 0.9 | ○○ | ○ |
| | 1.2 | ○○ | ○ |
| | 1.5 | ○○ | ○ |
| | 1.8 | ○○ | X |
| B | 0.9 | * | X |
| | 1.2 | * | X |
| | 1.5 | ○○ | ○ |
| | 1.8 | ○○ | X |

As is apparent from Table 8, when the length of the straight tubular portion is not longer than 1.5 mm or when the bulge portion is located outside the above-mentioned circle with a radius of ($\gamma$+0.1) mm, dragging of a spark is effectively suppressed.

Next, the form of sparking from the end face 12C of the semi-creeping discharge ground electrode 12 can be improved through impartment of an appropriate shape to the end face 12C. In order to specify the shape of the end face 12C, the following geometric definition is employed. In FIG. 2(*b*), a side toward a front end portion of the insulator 1 along the direction of the axis 30 is defined as the front side, and the opposite side is defined as the rear side. A plane of projection PP is defined as a plane including the axis 30 and perpendicularly intersecting a virtual plane VP including the axis 30 and a midpoint M1 of the rear edge 12B of the end face 12C of the semi-creeping discharge ground electrode 12. Reference numeral 12NP denotes the end face 12C as orthogonally projected on the plane of projection PP (hereinafter referred to as the orthogonally projected end face 12NP). When the end face 12C is in parallel with the plane of projection PP as shown in FIG. 26, the orthogonally projected end face 12NP becomes geometrically congruent with the end face 12C as shown in FIG. 2(*b*). When the end face 12C is formed into an arcuate plane instead of a flat plane as shown in FIG. 21, although the end face 12C is curved, as shown in FIG. 2(*c*) the orthogonally projected end face 12NP assumes the basically same shape as that shown in FIG. 2(*b*).

When the semi-creeping discharge ground electrode 12 is formed of a wire member having, for example, a rectangular cross section through bending, the orthogonally projected end face 12NP also becomes rectangular as shown in FIG. 32(*b*). In this case, on the plane of projection PP, when, with X referring to a point of intersection of the axis 30 and the rear edge 12B and Y referring to a point of intersection of the axis 30 and the front edge 12A, a reference line RL is drawn as a line passing through a midpoint Q of segment XY and perpendicularly intersecting the axis 30, area S1 of a domain (hereinafter referred to as the front domain FA) located frontward of the reference line RL becomes substantially equal to area S2 of a domain (hereinafter referred to as the rear domain RA) located rearward of the reference line RL. Notably, in a discussion about matter on the plane of projection PP, the expression "orthogonal projection of" is omitted for the sake of simplicity, and merely "rear edge 12B," "front edge 12A," etc. are used for referring to "orthogonal projection of rear edge 12B," "orthogonal projection of front edge 12A," etc.

In the case of the end face 12C whose orthogonally projected end face 12NP is shaped as described above, the front domain FA and the rear domain RA exhibit substantially the same sparking frequency per unit time. For example, as shown in FIG. 32(*c*), on the assumption that spark ablation is locally delayed at a domain DW, a gap associated with the less ablated domain DW becomes smaller than that associated with the remaining domain. As a result, the frequency of spark discharge from the domain DW tends to become more frequent. As is known from this, in order to avoid forming an locally abnormal gap to the greatest possible extent, the semi-creeping discharge ground electrode 12 must be configured such that the end face 12C, which serves as a discharge face, is ablated uniformly over the entire face; in other words, sparking frequency per unit area and per unit time must be substantially uniform over the entire end surface 12C. Since the two domains of the orthogonally projected end face 12NP separate by the reference line RL; i.e., the front domain FA and the rear domain RA have the area S1 and the area S2, respectively, which are equal, the domains FA and RA exhibit substantially the same sparking frequency per unit time. Since sparking occurs at substantially the same frequency on the front domain FA and the rear domain RA, suppression of channeling and enhancement of ignition characteristics cannot be expected.

Figure 33:
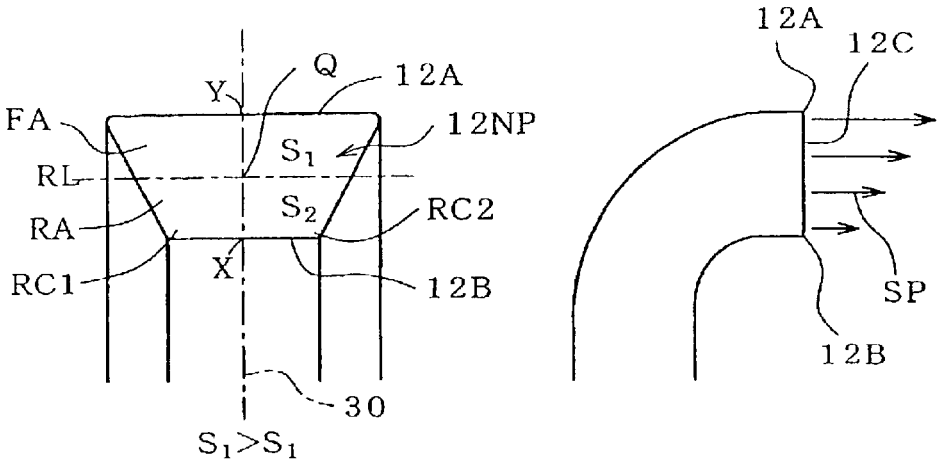
FIG. 33 is a pair of side view and front view showing a first improvement example of the end face shape of the semi-creeping discharge ground electrode.
Figure 34:
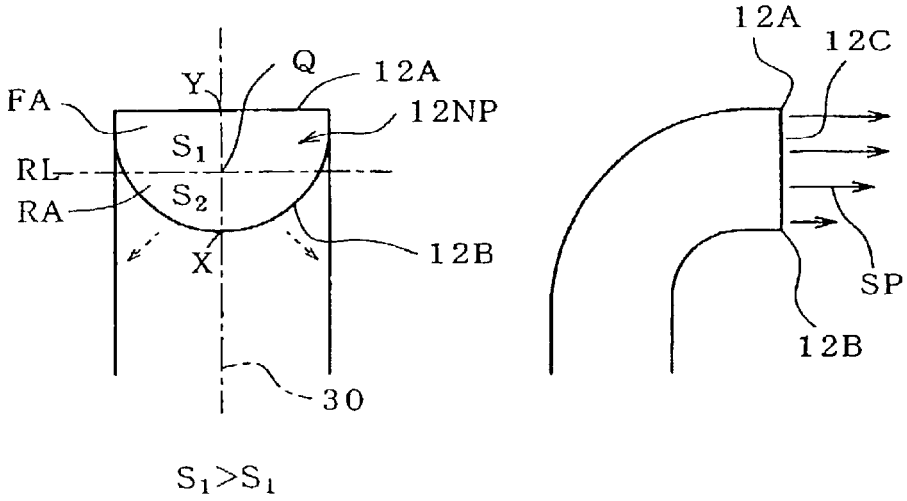
FIG. 34 is a pair of side view and front view showing a second improvement example of the end face shape of the semi-creeping discharge ground electrode.

Therefore, in FIG. 33, the end face 12C is shaped such that the area S1 of the front domain FA of the orthogonally projected end face NP is greater than the area S2 of the rear domain RA of the end face NP. In such a semi-creeping discharge ground electrode 12, the front domain FA exhibits a generation frequency of spark SP that is increased according to an areal increment. Since sparking from the front domain FA—which sparking exhibits rather weak attack on the insulator 1—increases, suppression of channeling and enhancement of ignition characteristics can be effectively attained. In FIG. 33, the end face 12C assumes a trapezoidal shape such that a short one of two parallel opposite sides is the rear edge 12B. The generation frequency of spark SP is schematically represented by means of the length of an arrow. FIG. 34 shows an example shape of the end face 12C such that the rear edge 12B assumes an arcuate or semicircular shape. As is apparent from FIG. 34, S1 is greater than S2.

In the case of the semi-creeping discharge ground electrode 12 whose end face 12C assumes a rectangular shape as shown in FIG. 32(*b*), if corner portions thereof, particularly opposite corner portions of the rear edge 12B, are sharp, the corner portions tend to serve as starting points of sparking such that sparks SP3 are discharged from the corner portions obliquely outwardly downward in FIG. 32(*b*). As shown in FIG. 32(*a*), such a spark SP3 may be dragged considerably downward along the axial direction of the insulator 1, potentially significantly impairing ignition characteristics. Particularly, when a sharp steplike transitional part 102T is formed at a root of the straight tubular portion 102B, the spark SP3 detours considerably while heading for a ridge thereof, on which electric field tends to concentrate, thus accelerating a dragging condition and therefore leading to a significant impairment in ignition characteristics.

Figure 35:
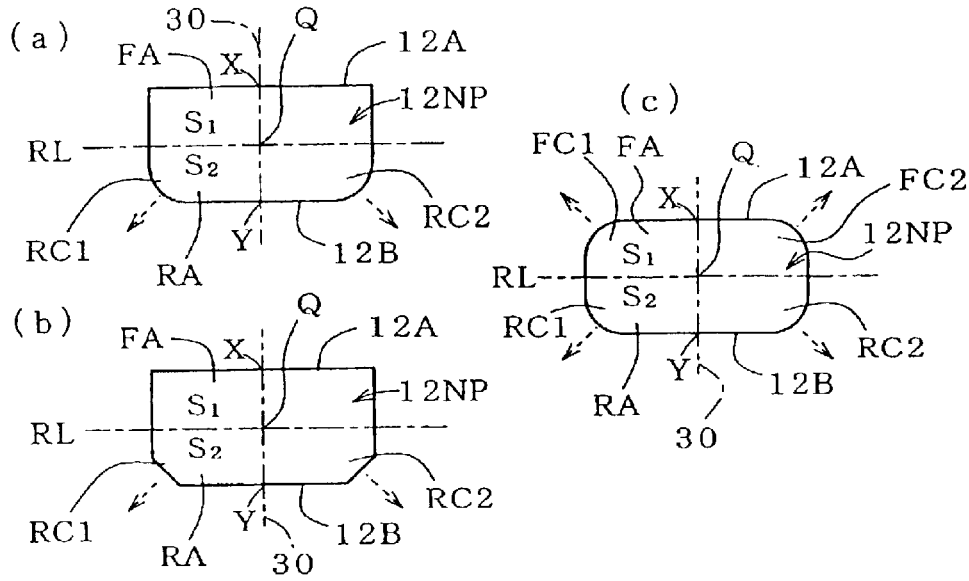
FIG. 35 is a series of side views showing third, fourth, and fifth improvement examples of the end face shape of the semi-creeping discharge ground electrode.

In order to cope with the above problem, as shown in FIG. 35, the end face 12C is shaped such that a sharp corner portion does not appear on the orthogonally projected end face 12NP; specifically, such that at least corner portions of the rear domain RA are radiused at a radius of curvature of not less than 0.2 mm or chamfered at a width of not less than 0.2 mm, or two sides defining each of the corner portions form an angle greater than 90 degrees, thereby effectively suppressing sparking that involves dragging as described above. Also, elimination of a sharp corner portion, which tends to become a sparking start point, from the rear domain RA decreases the spark generation frequency of the domain RA.

In an end face example shown in FIG. 35(*a*), corner portions (two sides defining each of the corner portions form an angle of about 90° C.) RC1 and RC2 located at opposite ends of the linear rear edge 12B are radiused at a radius of curvature of not less than 0.2 mm (e.g., up to about 1.0 mm). In an end face example shown in FIG. 35(*b*), the corner portions RC1 and RC2 are chamfered at a width of not less than 0.2 mm. In this case, corners are formed at opposite ends of each chamfered portion. However, two sides defining each of the corners form an obtuse angle, and thus are unlikely to serve as sparking starting points. Therefore, the radius of curvature may be less than 0.2 mm.

In FIGS. 35(*a*) and 35(*b*), only the corner portions RC1 and RC2 located at opposite ends of the rear edge 12B are radiused or chamfered. As a result, the area S1 of the front domain FA becomes slightly greater than the area S2 of the rear domain RA, thereby yielding effect associated with establishment of "S1>S2," to some extent. However, as shown in FIG. 35(*c*), all of four corner portions including corner portions FC1 and FC2 located at opposite ends of the front edge 12A can be radiused (or chamfered), so that S1 and S2 become substantially equal. In the configuration of FIG. 33, the orthogonally projected end face 12NP assumes a substantially trapezoidal shape, and corner portions RC1 and RC2 located at opposite ends of the rear edge 12B are of an obtuse angle, thereby yielding the effect of eliminating formation of sharp corners. In the configuration of FIG. 34, the rear edge 12B assumes an arcuate shape, which intrinsically involves no sharp corner, thereby eliminating formation of sharp corners.

Figure 36:
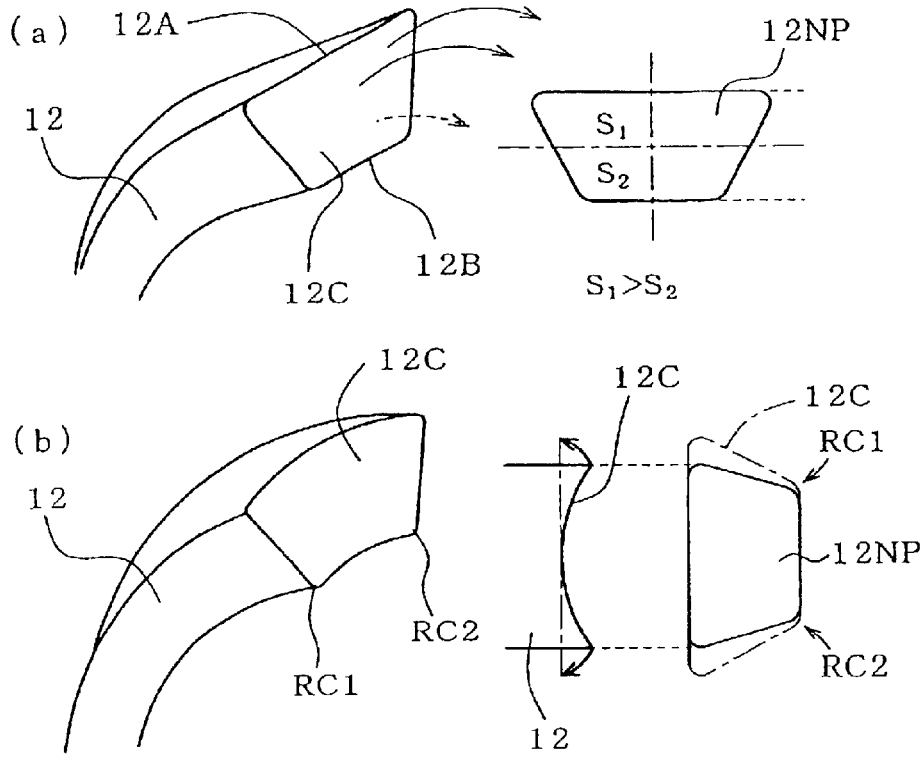
FIG. 36 is a series of explanatory views showing sixth and seventh improvement examples of the end face shape of the semi-creeping discharge ground electrode.

FIG. 36(*a*) exemplifies the trapezoidal end face 12C of FIG. 33 having corner portions radiused. The thus-configured end face 12C ideally attains the effect that is yielded through attainment of the relationship "S1>S2," and the effect of eliminating sharp corners. In this case, the end face 12C shown in FIG. 36(*b*) assumes a cylindrical shape as shown in FIG. 27. As is apparent from development of the end face 12C, two sides that define each of corner portions RC1 and RC2 located at opposite ends of the rear edge 12B form a greater angle, thereby further enhancing the effect of suppressing spark generation.

The semi-creeping discharge ground electrode 12 whose end face is shaped as shown in any one of FIGS. 33 to 36 can be formed, through bending, from a wire member having a cross section that is substantially the same as a desired shape of an orthogonally projected end face of the electrode 12.

What is claimed is:

1. A spark plug comprising an insulator having a center through-hole formed therein; a center electrode held in the center through-hole and disposed at an end portion of the insulator; a metallic shell for holding the insulator such that an end portion of the insulator projects from an end face thereof; a parallel ground electrode disposed such that one end thereof is joined to a front end face of the metallic shell, and a side face of the other end faces, in parallel, an end face of the center electrode; and a plurality of semi-creeping discharge ground electrodes disposed such that one end of each of the electrodes is joined to the metallic shell, and the other end of each of the electrodes faces a circumferential side surface of the center electrode and/or a circumferential side surface of the insulator; and the spark plug being characterized in that an air gap ($\alpha$) is formed between the parallel around electrode and the end face of the center electrode; a semi-creepage gap ($\beta$) is formed between the end face of each of the semi-creeping discharge around electrodes and the circumferential side surface of the center electrode; an insulator gap ($\gamma$) is formed between the end face of each of the semi-creeping discharge around electrodes and the circumferential side surface of the insulator; a distance $\alpha$ (unit: mm) across the air gap ($\alpha$) and a distance $\beta$ (unit: mm) across the semi-creepage gap ($\beta$) satisfy a relationship $\alpha<\beta$; and the distance $\alpha$ across the air gap ($\alpha$) and a distance $\gamma$ (unit: mm) across the insulator gap ($\gamma$) satisfy a relationship $\alpha>\gamma$, and wherein the air gap ($\alpha$) is not greater than 1.1 mm; the insulator gap ($\gamma$) falls within a range of 0.5 mm to 0.7 mm; and a diametral difference $\delta$ (unit: mm) between the insulator and the metallic shell as measured along the front end face of the metallic shell is not less than 3.6 mm.

2. A spark plug as described in claim 1, wherein the air gap ($\alpha$) falls within a range of 0.8 mm to 1.0 mm; the insulator gap ($\gamma$) falls within a range of 0.5 mm to 0.7 mm; and the air gap ($\alpha$) and the insulator gap ($\gamma$) satisfy a relationship $0.2\ \text{mm} \leqq (\alpha-\gamma) \leqq 0.4$ mm.

3. A spark plug as described in claim 2, wherein a diameter of a front end portion of the center electrode is reduced; and a width W of the parallel ground electrode as viewed from an axially frontward side of the insulator and measured across a center point of the center electrode is not greater than 2.2 mm and is not less than two times a diameter of the center electrode as measured along the front end face of the center electrode.

4. A spark plug as described in claim 1, wherein a projection amount F (unit: mm) of the insulator projecting frontward beyond dimension A specified in an applicable JIS Standard (JIS B 8031) or a corresponding ISO Standard comparatively described in the JIS Standard falls within a range of 3.0 mm to 5.0 mm.

5. A spark plug as described in claim 4, wherein the parallel ground electrode includes a base material, which is used to form a surface layer portion thereof, and a material of good heat conduction, which is used to form an inner layer portion thereof and whose thermal conductivity is higher than that of the base material.

6. A spark plug as described in claim 1, wherein the air gap ($\alpha$) is not greater than 1.1 mm; the insulator gap ($\gamma$) falls within a range of 0.5 mm to 0.7 mm; and a difference $\psi$ (unit: mm) between an insulator front-end diameter $\phi$D (unit: mm) and a width of the semi-creeping discharge ground electrode is not greater than 1.8 mm, where, in an orthogonal projection of the insulator onto a virtual plane in parallel with an axis of the insulator, the insulator front-end diameter $\phi$D is defined as a distance between two points of intersection of a first extension line formed through outward extension of a line indicative of the front end face of the insulator and two second extension lines formed through frontward extension of two lines indicative of the circumferential side surface of the insulator located in opposition to each other with respect to the axis of the insulator and facing the semi-creepage gap ($\beta$).

7. A spark plug as described in claim 6, wherein a minimum distance (hereinafter referred to merely as "insulator front-end wall thickness" $\rho$ (unit: mm)) between a point of intersection of the first extension line and the second extension line formed through frontward extension of the line indicative of the circumferential side surface of the insulator facing the semi-creepage gap (β) and a point of intersection of the first extension line and an extension line indicative of a wall of the center through-hole is not greater than 0.9 mm.

8. A spark plug as described in claim 1, wherein a projection amount H (unit: mm) of the center electrode projecting from the front end face of the insulator is not greater than 1.25 mm.

9. A spark plug as described in claim 8, wherein the projection amount H of the center electrode projecting from the front end face of the insulator is not greater than 0.5 mm.

10. A spark plug as described in claim 1, wherein the air gap (α), the semi-creepage gap (β), and the insulator gap (γ) satisfy a relationship $\alpha \leqq 0.4\times(\beta-\gamma)+\gamma$.

11. A spark plug as described in claim 1, (wherein a width of the semi-creeping discharge ground electrode as viewed from an axially frontward side of the insulator and measured at at least the end face thereof is greater than a diameter of the center through-hole of the insulator as measured at the front end thereof.

12. A spark plug as described in claim 1, wherein a diameter of the center through-hole of the insulator is reduced at a front end portion of the insulator.

13. A spark plug as described in claim 1, wherein a front end portion of the insulator is formed into a straight tubular portion having a reduced diameter, and a portion of the insulator located axially rearward of and adjacent to the straight tubular portion is formed into a bulge portion having a diameter greater than that of the straight tubular portion;

a length of the straight tubular portion is not greater than 1.5 mm; and on a virtual plane including the axis of the insulator and a midpoint of the rear edge, as viewed along the axial direction of the insulator, of the end face of the semi-creeping discharge ground electrode, the bulge portion is located entirely outside a circle with a center thereof at the midpoint of the rear edge and a radius of (γ+0.1) mm, where γ (unit: mm) is a distance across the insulator gap (γ).

14. A spark plug as described in claim 1, wherein with the term "frontward" referring to a side toward the front end portion of the insulator along the axial direction of the insulator and with a plane of projection being defined as a plane including the axis of the insulator and perpendicularly intersecting a virtual plane including the axis of the insulator and a midpoint of the rear edge of the end face of the semi-creeping discharge ground electrode, the end face as orthogonally projected on the plane of projection is shaped such that, on the plane of projection, with X referring to a point of intersection of the axis and the rear edge, Y referring to a point of intersection of the axis and the front edge, and a reference line being defined as a line passing through a midpoint of segment XY and perpendicularly intersecting the axis, area S1 of a domain located frontward of the reference line is greater than area S2 of a domain located rearward of the reference line.

15. A spark plug as described in claim 1, wherein with the term "frontward" referring to a side toward the front end portion of the insulator along the axial direction of the insulator and with a plane of projection being defined as a plane including the axis of the insulator and perpendicularly intersecting a virtual plane including the axis of the insulator and a midpoint of the rear edge of the end face of the semi-creeping discharge ground electrode, the end face as orthogonally projected on the plane of projection is shaped such that, on the plane of projection, with X referring to a point of intersection of the axis and the rear edge, Y referring to a point of intersection of the axis and the front edge, and a reference line being defined as a line passing through a midpoint of segment XY and perpendicularly intersecting the axis, at least a corner portion of a domain located rearward of the reference line is radiused at a radius of curvature of not less than 0.2 mm or chamfered at a width of not less than 0.2 mm, or two sides defining the corner portion form an angle greater than 90 degrees.

16. A spark plug as described in claim 1, wherein a front end portion of the insulator is formed into a straight tubular portion, and the straight tubular portion extends rearward of the front end face of the metallic shell.

17. A spark plug as described in claim 1, wherein the center electrode is configured such that a noble metal chip formed of a noble metal or noble metal alloy having a melting point not lower than 1600° C. is joined to a front end portion of a base material, and a joint of the chip and the base material is located within the center through-hole.

18. A spark plug as described in claim 17, wherein the noble metal chip is configured such that an outside diameter of a joint portion is greater than that of a the front end portion.

19. A spark plug as described in claim 17, wherein a minimum diametral difference between an outside diameter of the noble metal chip and a bore diameter of the center through-hole as measured at the front end portion of the insulator located frontward of a retainment portion of the metallic shell, the insulator being engaged with and retained by the retainment portion, is not greater than 0.2 mm.

20. A spark plug as described in claim 1, wherein a minimum bore diameter D3 (unit: mm) of the center through-hole as measured at a front end portion of the insulator located frontward of a retainment portion of the metallic shell, the insulator being engaged with and retained by the retainment portion, is not greater than 2.1 mm.

21. A spark plug as described in claim 1, wherein the parallel ground electrode includes a base material, which is used to form a surface layer portion thereof, and a material of good heat conduction, which is used to form an inner layer portion thereof and whose thermal conductivity is higher than that of the base material.

22. A spark plug as described in claim 1, wherein the spark plug is used in a direct-injection-type internal combustion engine.

23. A spark plug comprising an insulator having a center through-hole formed therein; a center electrode held in the center through-hole and disposed at an end portion of the insulator; a metallic shell for holding the insulator such that an end portion of the insulator projects from an end face thereof; a parallel ground electrode disposed such that one end thereof is joined to a front end face of the metallic shell, and a side face of the other end faces, in parallel, an end face of the center electrode; and a plurality of semi-creeping discharge ground electrodes disposed such that one end of each of the electrodes is joined to the metallic shell, and the other end of each of the electrodes faces a circumferential side surface of the center electrode and/or a circumferential side surface of the insulator; and the spark plug being characterized in that an air gap (α) is formed between the parallel ground electrode and the end face of the center electrode; a semi-creepage gap (β) is formed between the end face of each of the semi-creeping discharge ground electrodes and the circumferential side surface of the center electrode; an insulator gap (γ) is formed between the end face of each of the semi-creeping discharge ground electrodes and the circumferential side surface of the insulator;

a distance α (unit: mm) across the air gap (α ) and a distance β (unit: mm) across the semi-creepage gap (β) satisfy a relationship α<β; and the distance a across the air gap (α) and a distance γ (unit: mm) across the insulator gap (γ) satisfy a relationship α>γ, and wherein the air gap (α) is not greater than 0.9 mm; the insulator gap (γ) falls within a range of 0.5 mm to 0.7 mm; and the diametral difference δ between the outside diameter of the insulator and the inside diameter of the metallic shell as measured along the front end face of the metallic shell is not less than 2.8 mm.

24. A spark plug comprising an insulator having a center through-hole formed therein; a center electrode held in the center through-hole and disposed at an end portion of the insulator; a metallic shell for holding the insulator such that an end portion of the insulator projects from an end face thereof; a parallel ground electrode disposed such that one end thereof is joined to a front end face of the metallic shell, and a side face of the other end faces, in parallel, an end face of the center electrode; and a plurality of semi-creeping discharge ground electrodes disposed such that one end of each of the electrodes is joined to the metallic shell, and the other end of each of the electrodes faces a circumferential side surface of the center electrode and/or a circumferential side surface of the insulator; and the spark plug being characterized in that an air gap (α) is formed between the parallel around electrode and the end face of the center electrode; a semi-creepage gap (β) is formed between the end face of each of the semi-creeping discharge ground electrodes and the circumferential side surface of the center electrode; an insulator gap (γ) is formed between the end face of each of the semi-creeping discharge around electrodes and the circumferential side surface of the insulator; a distance α (unit: mm) across the air gap (α ) and a distance β (unit: mm) across the semi-creepage gap (β) satisfy a relationship α<β; and the distance α across the air gap (α) and a distance γ (unit: mm) across the insulator gap (γ) satisfy a relationship α>γ, and wherein a front end portion of the insulator is formed into a straight tubular portion; with the term "frontward" referring to a side toward the front end portion of the insulator along an axial direction of the insulator, a rear edge of the end face of the semi-creeping discharge ground electrode is aligned with or is located frontward of a rear end position of the straight tubular portion; and a level difference E (unit: mm) along the axial direction between a front end face of the insulator and the rear edge of the end face of the semi-creeping discharge ground electrode, and a radius of curvature R (unit: mm) of a curved surface extending from the front end face of the insulator to the circumferential side surface of the insulator satisfy a relationship indicative of a difference therebetween R−E≦0.1 mm.

25. A spark plug as described in claim 24, wherein the level difference E is not greater than 0.5 mm.

26. A spark plug comprising an insulator having a center through-hole formed therein; a center electrode held in the center through-hole and disposed at an end portion of the insulator; a metallic shell for holding the insulator such that an end portion of the insulator projects from an end face thereof; a parallel ground electrode disposed such that one end thereof is joined to a front end face of the metallic shell, and a side face of the other end faces, in parallel, an end face of the center electrode; and a plurality of semi-creeping discharge ground electrodes disposed such that one end of each of the electrodes is joined to the metallic shell, and the other end of each of the electrodes faces a circumferential side surface of the center electrode and/or a circumferential side surface of the insulator; and the spark plug being characterized in that an air gap (α) is formed between the parallel ground electrode and the end face of the center electrode; a semi-creepage gap (β) is formed between the end face of each of the semi-creeping discharge around electrodes and the circumferential side surface of the center electrode; an insulator gap (γ) is formed between the end face of each of the semi-creeping discharge ground electrodes and the circumferential side surface of the insulator; a distance α (unit: mm) across the air gap (α) and a distance β (unit: mm) across the semi-creepage gap (β) satisfy a relationship α<β; and the distance α across the air gap (α) and a distance γ (unit: mm) across the insulator gap (γ) satisfy a relationship α>γ, and wherein a noble metal chip is not welded to an end face portion of the semi-creeping discharge ground electrode; the end face portion is entirely formed of a second nickel-type base metal containing a predominant amount of nickel; at least a surface layer portion of the parallel ground electrode is formed of a first nickel-type base metal containing a predominant amount of nickel; a noble metal chip is welded to the parallel ground electrode in such a manner as to face the center electrode; and the nickel content of the second nickel-type base metal is higher than that of the first nickel-type base metal.

27. A spark plug as described in claim 26, wherein the nickel content of the second nickel-type base metal is not less than 85% by mass.

* * * * *